US012687011B2

(12) United States Patent
Bilge

(10) Patent No.: US 12,687,011 B2
(45) Date of Patent: Jul. 21, 2026

(54) UNIVERSAL Z-Z CHANNEL FOR MOUNTING WALL PANELS TO EXISTING WALL

(71) Applicant: Henry H. Bilge, Fort Lee, NJ (US)

(72) Inventor: Henry H. Bilge, Fort Lee, NJ (US)

( * ) Notice: Subject to any disclaimer, the term of this patent is extended or adjusted under 35 U.S.C. 154(b) by 78 days.

(21) Appl. No.: 17/560,249

(22) Filed: Dec. 22, 2021

(65) Prior Publication Data

US 2022/0220730 A1 Jul. 14, 2022

Related U.S. Application Data

(63) Continuation-in-part of application No. 17/203,283, filed on Mar. 16, 2021, now abandoned, which is a continuation-in-part of application No. 17/180,859, filed on Feb. 21, 2021, now Pat. No. 11,499,319, which is a continuation-in-part of application No. 17/091,255, filed on Nov. 6, 2020, now Pat. No. 11,608,644.

(51) Int. Cl.
*E04B 1/76* (2006.01)
*E04F 13/08* (2006.01)

(52) U.S. Cl.
CPC ..... *E04B 1/7629* (2013.01); *E04F 13/0803* (2013.01)

(58) Field of Classification Search
CPC .. E04F 13/0803; E04F 13/0875; E04B 1/7629
See application file for complete search history.

(56) References Cited

U.S. PATENT DOCUMENTS

D272,886 S * 3/1984 Holcombe ..... D8/380
2014/0007533 A1* 1/2014 Wadsworth ..... E04B 1/7629 52/309.1

FOREIGN PATENT DOCUMENTS

FR 2614340 A1 * 10/1988

* cited by examiner

*Primary Examiner* — Patrick J Maestri
(74) *Attorney, Agent, or Firm* — Olivo IP Law Group, P.C.; John W. Olivo, Jr.

(57) ABSTRACT

Disclosed is a system of cladding along an existing exterior wall of a building featuring a plurality of Z-shaped components deployed in a parallel spaced apart arrangement, with an insulation panel in between two of the Z-shaped components. The Z-shaped components having a J-wall to enforce a moisture gap between exterior wall paneling and insulation. The Z-shaped components may feature Edge-components when the line of insulation panels needs to be interrupted or when it reaches a corner or edge of a wall. The Z-shaped components and Edge components may contain a group having a plurality of air gaps. Other embodiments of Z-shaped components may contain a plurality of retaining slots that provide anchor points for holding pegs, clips and/or rods, which can then be used to secure insulation panels between adjacent Z-shaped components without unnecessarily breaching exterior sheeting. The use of clips or pegs further speeds the installation process and reduces the cost and efficiency of insulation, while improving the thermal insulation of the final assembly.

21 Claims, 61 Drawing Sheets

90
70
70
70

20
10
10
18
18
14
14
14
14
22
22
24
24
16
16
26
26
28
28
30
30
32
32
34
34
36
36
38
38
40
40
42
42
44
44
46
46
48
48
50
50
52
52
54
54
56
56
58
58
60
60
62
62
64
64

UNIVERSAL Z-Z CHANNEL FOR MOUNTING WALL PANELS TO EXISTING WALL

REFERENCE TO RELATED APPLICATION

The present application is a Continuation-in-part of U.S. patent application Ser. No. 17/203,283, filed on Mar. 16, 2021 to the same inventor herein and entitled UNIVERSAL Z-Z CHANNEL FOR MOUNTING WALL PANELS TO EXISTING WALL, which is a Continuation-in-part of U.S. patent application Ser. No. 17/180,859, filed on Feb. 21, 2021 to the same inventor herein and entitled UNIVERSAL Z-Z CHANNEL FOR MOUNTING WALL PANELS TO EXISTING WALL, which is a Continuation-in-Part of U.S. patent application Ser. No. 17/091,255 filed on Nov. 6, 2020 to the same inventor herein and entitled UNIVERSAL Z-Z CHANNEL FOR MOUNTING WALL PANELS TO EXISTING WALL, the entire contents and disclosure of which are incorporated herein by reference.

BACKGROUND OF THE INVENTION

The present invention relates generally to a wall system, and more particularly, to a system for easily mounting wall panels over an existing wall while concealing exterior insulation.

Exterior decorative works of an existing wall are exposed to elements, in particular, to moisture. Although caulking and other gap remediation techniques abound and are well known, moisture may still penetrate. Despite moisture penetration, good airflow will wick away water before mold and other destructive consequences set in. For this reason, sound construction practices, and in some instances, building code, require that exterior panels are separated from insulation by a gap of approximately 2.5 centimeters.

This gap is also highly desirable to promote conservation of energy inside building structures. Due to the principal of conduction, even insulation will transfer hot or cold onto a surface it is insulating and thus eventually loose some of its effectiveness. To overcome the loss of insulating efficiency caused by conduction, sound construction practices recommend creating an air gap between an exterior layer of exterior insulation and the layer of exterior wall paneling. This air gap creates a reflective barrier, where the hot or cold air radiating from the exterior wall panel is reflected by the insulation layer due to the presence of the air gap.

Enforcement of the air gap between the insulation layer and the exterior wall paneling is a known practice that is often dictated by the building code. However, there is presently no standard and failsafe compliance method. Instead, contractors attempt to comply by inserting a separate strip of material between the exterior paneling and the insulation. Existing methods have several serious shortcomings. The first one is higher cost and length of installation. The cost is increased due to the requirement of purchasing, stocking and components required in ensuring that a gap is present. Secondly, installation requires a separate step involving a non-standard component. Third, it is often difficult to keep the thickness of the air gap uniform when utilizing non-standard and disparate components. Finally, the presence of an additional structural component adds to the complexity of a project and increases the risk of mistake or accident occurring due to the additional level of complexity.

Furthermore, just the presence of a gap may not be sufficient in some situations. For example, certain facades will permit a small amount of water to trickle through and behind wall cladding. This moisture needs to have a drainage outlet and must be completely ventilated to discourage accumulation of damaging moisture, mold, or mildew. Existing solutions do not adequately address the problems identified above.

Practically, the technological disclosures of this application are mounted onto exterior facades of buildings and represent an external or first line of installation that is installed outside of waterproof later of wall sheeting. It is therefore important to ensure that installation of insulation used at this level does not undermine the waterproofing qualities of water membranes used. Under the existing methodologies, insulation paneling is often stapled of fastened to the wall sheeting to keep it in place, which inevitably perforates the waterproof membrane. An optimal deployment would require that that both rigid, semi-rigid and flexible insulation solutions at this level can be fixed into place without having to be bolted to the wall. The solution is an attachment to the same girts that are used to attach exterior wall panels.

It is therefore desirable to provide a system that creates a single structural component which form a frame for attaching exterior insulation to an existing wall, which also serves as a point of attachment of exterior paneling, and which enforces a uniform air gap between the exterior paneling and the layer of insulation.

SUMMARY OF THE INVENTION

It is an object of the present invention to provide for a simple and uniform means of ensuring that an air gap exists between an exterior or cladding covering and a layer of exterior insulation.

It is another object of the present invention to provide a sustainable and adequate airflow between cladding panels and insulation, which among other benefits, prevents unchecked moisture buildup.

It is still another object of the present invention to provide a first moisture gap that is enforceable by the shape of the Z-girt or Z-shaped component holding the insulation panels and exterior wall panels.

It is still another object of the present invention to provide a wide first moisture gap above the insulation panels and below the cladding panels, and a second moisture gap between the insulation panels and an existing wall of the structure.

It is still another object of the present invention to provide way of retaining insulation panels between two neighboring Z-shaped components by use of a rod spanning the two Z-shaped components.

It is still another object of the present invention to enable the use of insulation panels of varying thickness, where the panels are nonetheless securely retained between the Z-shaped components through use of rods of various thicknesses or diameters.

It is still another object of the present invention to enable the use of insulation panels of varying thicknesses where a plurality of holding pegs fitted within retention slots securely retain insulation panels of varying thickness between Z-shaped components irrespective of whether moisture draining openings are also present.

Therefore, in accordance with the present invention, a system for ensuring that exterior insulation is installed at a desired distance from shell or cladding panels, includes a plurality of Z-shaped components. The plurality of Z-shaped components attaching in a parallel and spaced apart association with each other along the exterior of an existing wall. Each Z-shaped component is made of a first wall, a second wall and a J-shaped third wall. The first wall having a first end and a second end is. The first wall being preferably parallel to an existing wall and is mounted either vertically, horizontally, or diagonally thereon.

The second wall extends forwardly at an angle, preferably a right angle, from the first wall. The free end of the second wall contains the J-shaped wall. The J-shaped wall is made of two portions. The first portions is parallel to the first wall but extends in the opposite direction from the first wall. The second portion extends rearwardly from the free end of the first portion, with a free end of the second portion being located at a distance above the first wall. The first portion of the J-shaped wall is configured to accept an exterior or cladding paneling bolted thereto.

The J-shaped wall extends for the entire length of the Z-shaped component and forms a hollow channel that is open on one side, namely between the free end of the second portion and the second wall. In an alternative embodiment an insert is configured to serve as a strength element and to receive the mounting bolts. The strength element is inserted into the hollow channel formed by the J-shaped portion. Additional durability cladding may in the form of a protective bracket placed on the surface of the first wall and which may include a front lip to further shield the first wall. The protective bracket configured to receiving the fastening bolt.

In another embodiment, the second wall of the Z-shaped component also comprises an upper lip. The protruding upper lip extending obliquely and at an angle, preferably a right angle, to the first side of the second wall. The upper lip is set off from the free end of the first side and is co-planar to the free end of the second portion. In an embodiment in which the second wall is not oriented perpendicularly to the first wall, the upper lip will preferably be disposed parallel to the first wall, which would translate to an acute or obtuse angle with respect to the second wall.

In another embodiment the second wall of the Z-shaped component contains a flared section along its height. The concave section may exist throughout the length of the second wall and appear on both or one of the first and second sides of the second wall. The flared section is intended to burrow into the first end of an insulation panel adjacent to the second side and the second end of the next insulation panel that is adjacent to the first side, to induce a greater moisture seal between the adjacent components. The next insulation panel's first end will similarly be encased against a flared protrusion of the second side of the next Z-shaped component.

An edge component is disclosed. The edge component being in a spaced apart parallel relation to at least one Z-shaped component in the plurality of Z-shaped components deployed in parallel to each other along an existing wall. The edge component terminating a section of insulating panels. An edge component is comprised of a first wall, a second wall extending forwardly at an angle, preferably a right angle, from the first wall, and a J-shaped wall on the free end of the second wall extending in the same direction as the first wall in a parallel and spaced apart configuration with the first wall. The J-shaped wall of the edge component formed from first portion and second portion. The first portion being parallel to the first wall and configured to accept an external or cladding panel bolted to the exterior surface of the first portion. The second portion extending rearwardly from the free end of the first portion and having a free end that terminates at a distance above the first wall. The free end of the second portion on the edge component being co-planar with the free end of the second portion of a contiguous Z-shaped component. Meaning that the free ends of the second portion being at the same distance relative to the first wall of their respective first walls. The free end of either the Z-shaped component or the edge component forming and enforcing the desired air gap between the exterior surface of an insulation panel and the bottom surface of an exterior panel.

The J-shaped wall of the edge component forms a hollow channel that is open on one side, namely the side between the free end of the second component and the second wall. An insert forming a strength element is disclosed for the hollow channel of the edge component. This insert being interchangeable with the insert for any of the other Z-shaped components. The insert may be placed into the hollow channel by inserting it into the opening on the either side of the hollow channel or by wedging the insert into the open side of the hollow channel.

In another embodiment of the disclosed system of supporting wall cladding presents Z-shaped components having a plurality of openings to allow air to move freely between Z-shaped components. Preferably this means that each second wall further comprises a plurality of elongated air gaps and the second portion of the J-shaped wall also comprises air openings.

BRIEF DESCRIPTION OF THE DRAWINGS

FIG. 32 is a perspective view of the device shown in FIG. 32.

DESCRIPTION OF THE PREFERRED EMBODIMENTS

Figure 1:
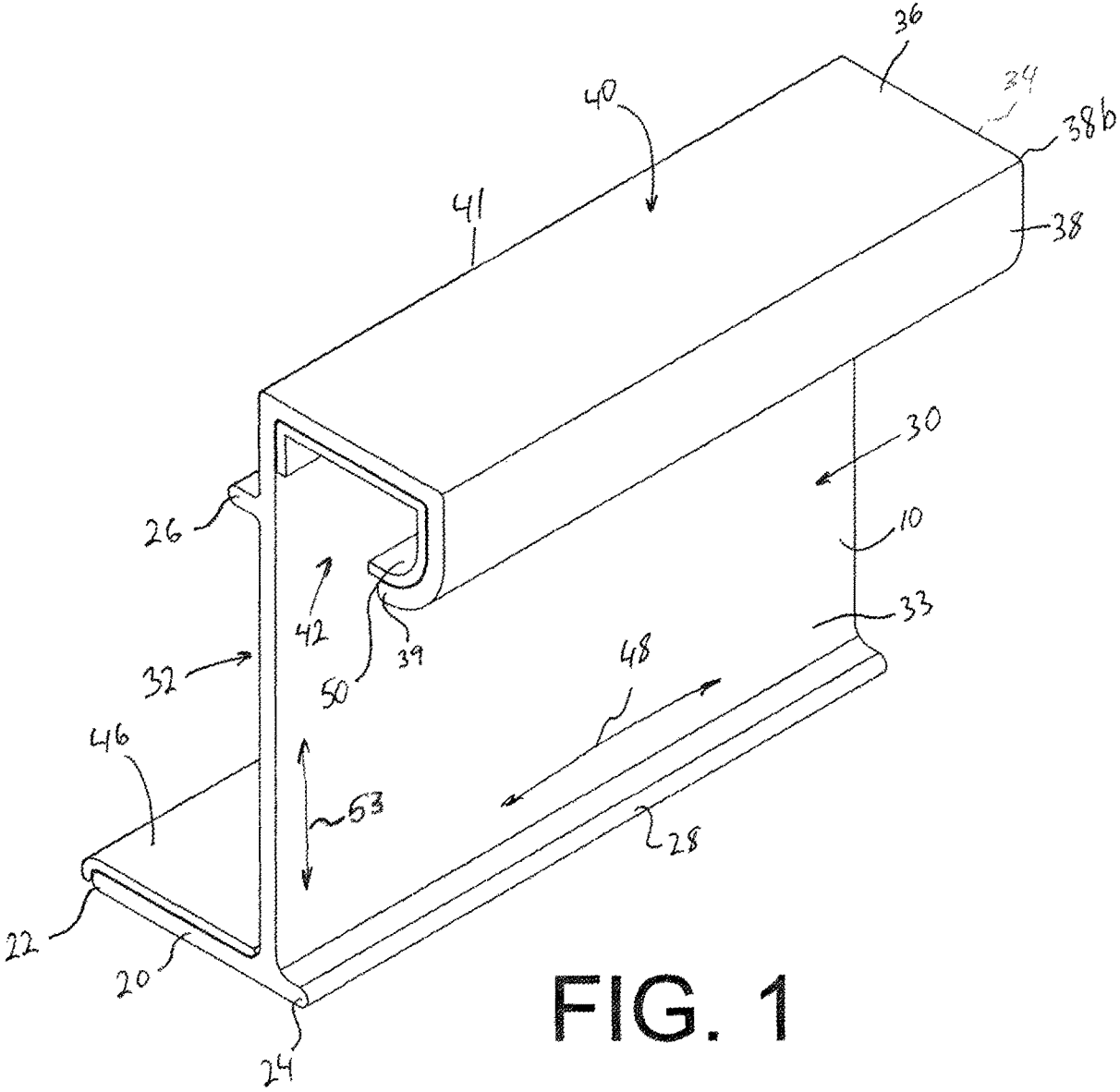
FIG. 1 is a perspective view of the preferred embodiment of the Z-shaped component.

The preferred embodiments of the present invention will now be described with reference to the drawings. Identical elements in the various figures are identified with the same reference numerals.

Reference will now be made in detail to embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Turning now descriptively to the drawings, shown in FIG. 1 is one embodiment of the Z-shaped component 10, having a first wall 20, the second wall 30 and the J-shaped wall 34. The first wall 20, having the first end 22 and the second end 24. The second wall 30 extends forwardly, at an angle, preferably a right angle, from the second end 24, or slightly offset from the second end 24, of the first wall 20. In the embodiment shown in FIG. 1, the second wall 20 is set off from the second end 24, and this set off creating a lower lip 28 that is coplanar with the rest of the first wall 20. The set off creating the lower lip 28 is preferably uniform for the entire length 48.

The free end 41 contains the J-shaped wall 34. The J-shaped wall 34 is further comprised of the first portion 36, which is substantially plane and in parallel orientation with the lower lip 28 of the first wall 20 but extends in the direction opposite to the first wall 20. The first portion 36 contains an outer surface 40, which as will be demonstrated in figures below, is configured to accept exterior wall panels 90. The second portion 38 extends rearwardly from the free end 38*b* of the first portion 36. Approximately halfway down along the height of the second portion 38, the second portion 38 bends towards the fir side 33, with the free end 39 terminating at a distance from the second side. The structure of the J-shaped wall 34 creates a hollow channel 42, which may admit an insert 55.

While only one Z-shaped component 10 is shown in FIG. 1, preferably a plurality of Z-shaped components 10 are fastened to the exterior surface of an existing wall, in a parallel spaced apart orientation to each other, with an insulation panel 72 (FIG. 5) fitting between each two parallel Z-shaped components. The length 48 of the Z-shaped component 10 is variable and commensurate to the wall of the building or with a deployment plan of insulating panels or exterior panel. The height 53 of each Z-shaped component 10, and in particular, the second wall 30, in the plurality of such Z-shaped components, may be uniform or variable from one component to the next to support an uneven surface design of exterior wall panels, or wall panels of varied thickness.

Figure 2:
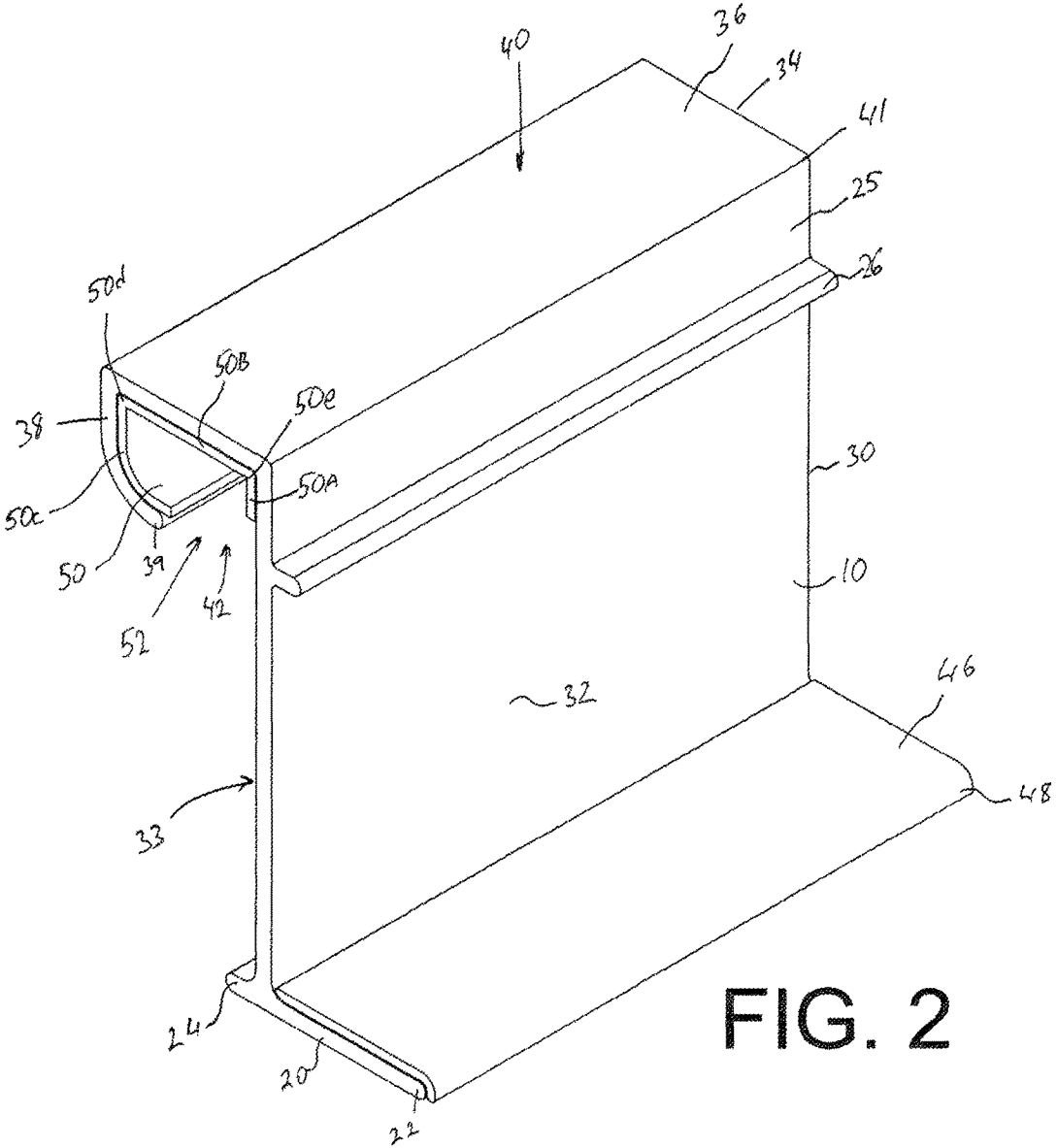
FIG. 2 is a perspective view of the preferred embodiment shown in FIG. 1.

FIG. 2 demonstrates a perspective top view of the Z-shaped component 10. Shown in figure is the first wall 20, the second wall 30, the J-shaped wall 34. The upper lip 26 juts out laterally from the first side 32, at an angle, preferably a right angle, to the second wall 30. The lip 24 is set off from free end 41 creating a gap 25. The height of the gap 25 may be equal to or different from the depth of the hollow channel 42.

A protective bracket 46 may be used to cover the surface of the first wall 20. The protective bracket 46 may additionally contain a flange 48 extending rearwardly. The flange 48 being adjacent to the first end 22. The protective bracket 46 accepts a fastener pierced therethrough and offers a stronger anchor location than the first wall 20. The first wall 20, as well as the overall Z-shaped component, are made from a polymeric composition which may be fibrous for strength.

Visible in FIG. 2 is the removable insert 50. The removable insert 50 is comprised of a first wall 50*a*. The first wall 50*a* is adjacent to the second wall 30. Extending laterally from the first wall 50*a* is a second wall 50*b*. The second wall

50*b* being adjacent to the first portion 36 of the J-shaped wall 34. Extending rearwardly from the second wall 50*b* is the third wall 50*c*. The third wall 50*c* being adjacent to the second portion 38 and having a shape conforming to the shape of the second portion 38. The corner 50*e* between the first and second walls 50*a* and 50*b* is adjacent to the angle formed by the second wall 30 and the J-shaped wall 34. The corner 50*d* is adjacent to the corner formed by the first portion 36 and second portion 38. The insert 50 may be introduced into the hollow channel 42 through the side openings 52 or through the gap between the free end 39 and the second side 33.

It should be appreciated that the insert 50 need not be shaped in the fashion demonstrated in FIG. 2 but can be shaped as a solid rod or cuboid. The insert 50 is intended additional strength to J-shaped wall 34 and serve as an anchor point for a fastener that carries the exterior wall paneling. The insert 50 need not be the same length as the hollow channel 42.

Figure 3:
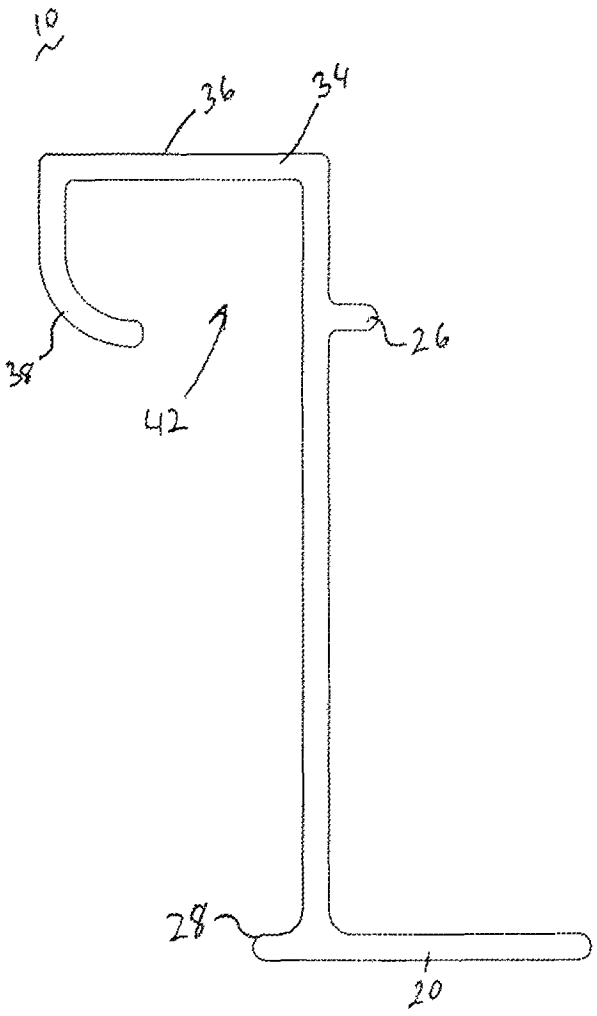
FIG. 3 is a side elevational view of a Z-shaped component.
Figure 3A:
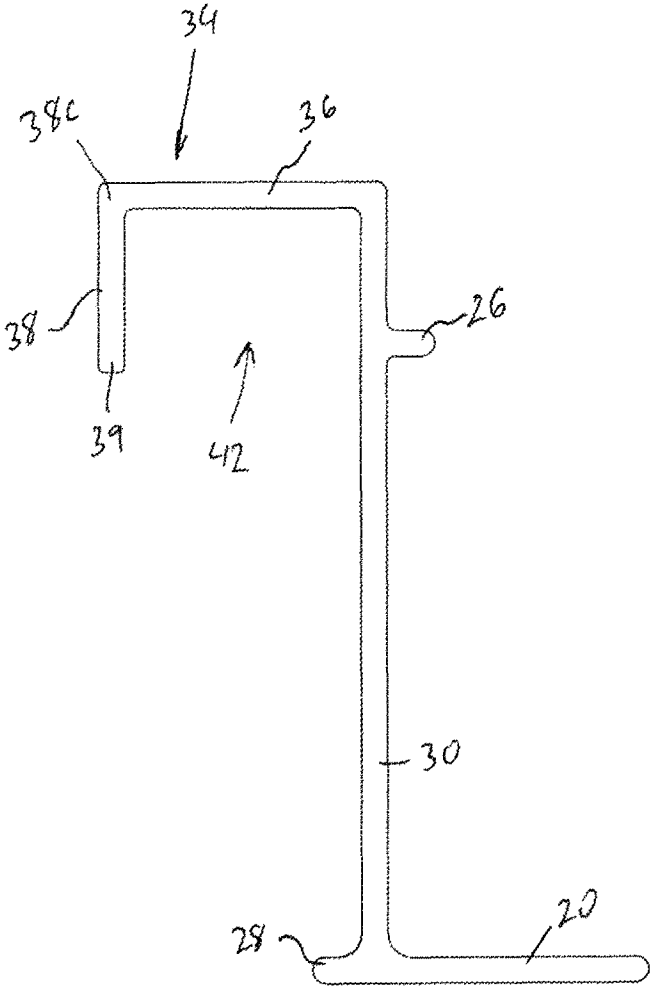
FIG. 3A-3H demonstrating various different shapes of the second portion of the J-shaped wall of either the Z-shaped component or the Edge component.
Figure 3B:
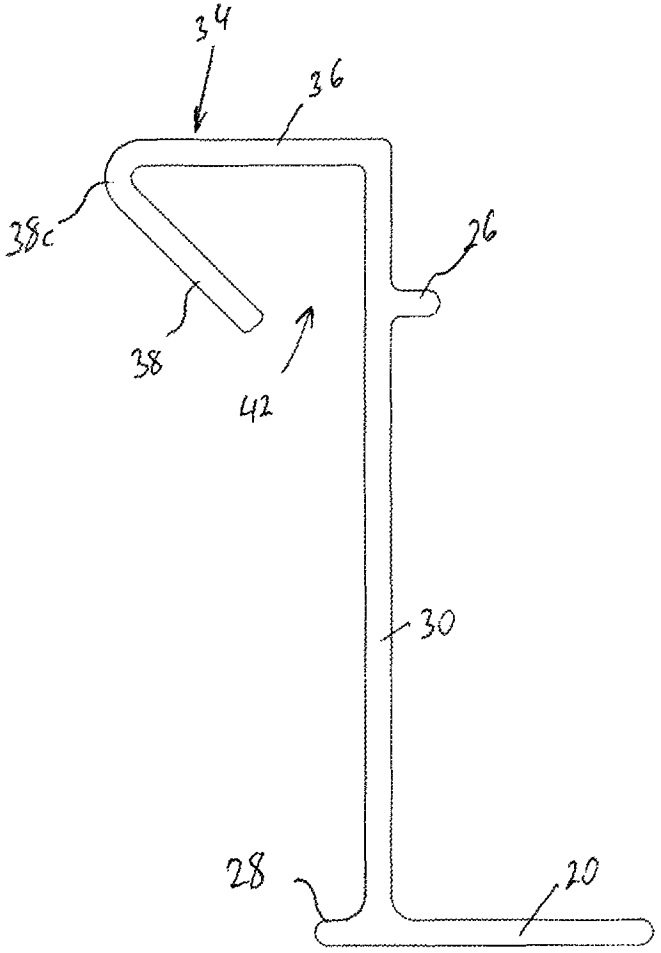
Figure 3C:
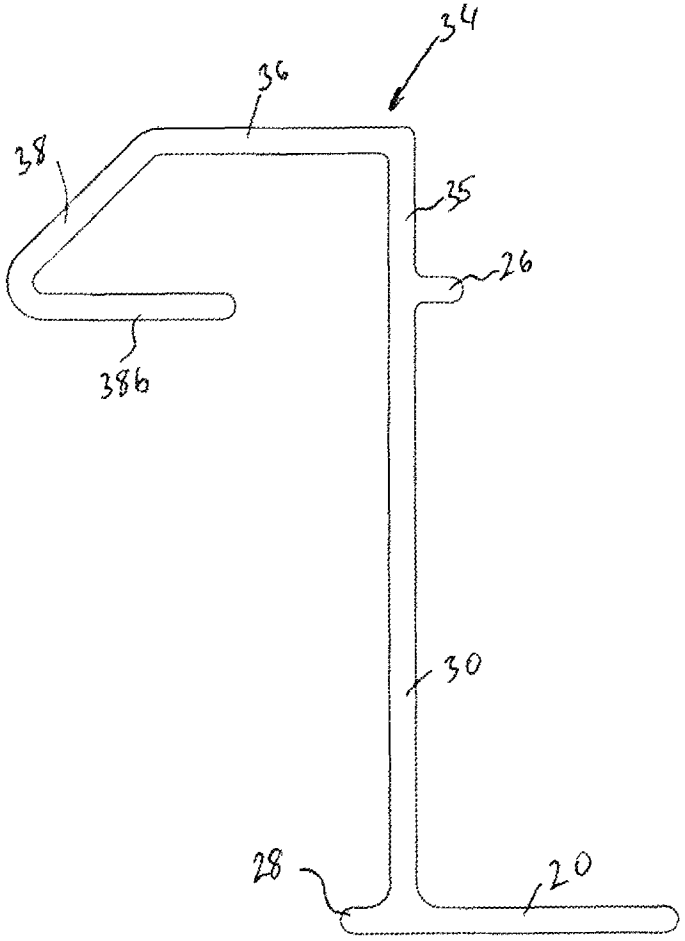
Figure 3D:
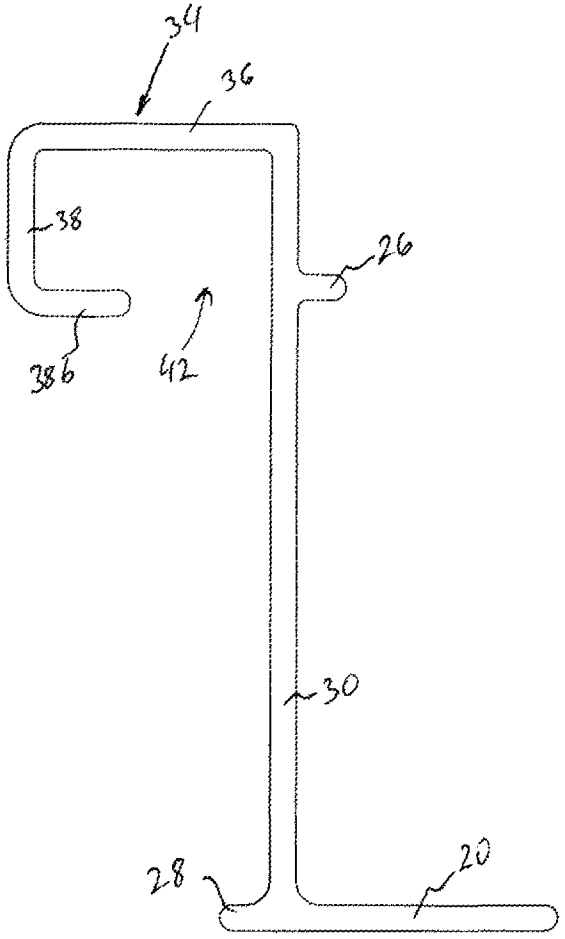
Figure 3E:
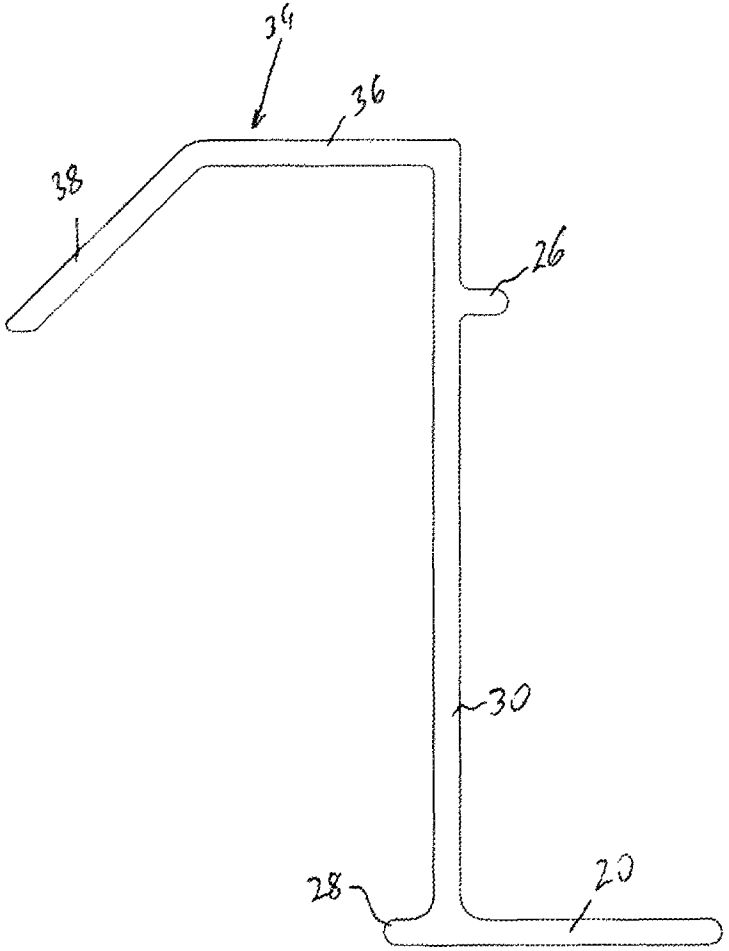
Figure 3F:
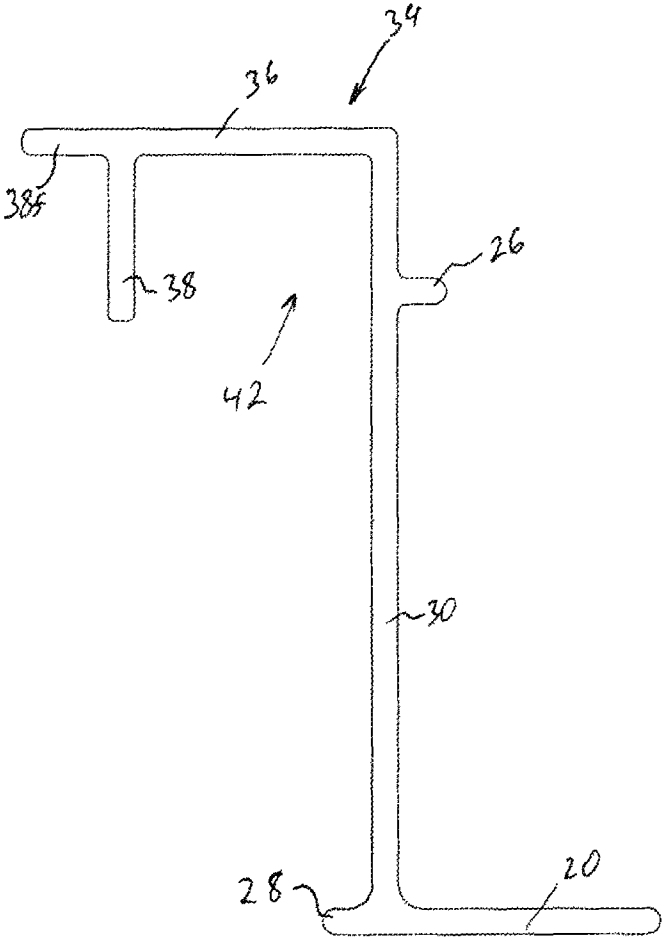

The J-wall 34 enforces the first moisture gap between an insulation panel and exterior decorative panel. It should be appreciated however, that the J-wall wall 34 need assume the shape of a "J" but may be executed in a plurality of other shapes. FIGS. 3A-3H demonstrate some of the alternative designs for the J-wall 34. The first portion 36 may be at a right angle with the second portion 38, with the second portion 38 not bending laterally towards the first side 33 but remaining substantially straight until the free end 39, as shown in FIG. 3A, or the free end may bend laterally for form a wall 38*b* that is coplanar with the lip 24 (FIG. 3*d*). Alternatively, the first portion 36 may meet the second portion 38 at an acute angle 38*c* (FIG. 3B) or an obtuse angle (FIG. 3*e*). The J-shaped wall 34 may assume a substantially trapezoidal shape (FIG. 3C), with the first wall 35 bending slightly laterally, and meeting the first portion 36 at an obtuse angle, with the first portion 36 connecting to the second portion at an obtuse angle and to wall 38*b* at an acute angle, with the wall 38*b* being co-planar with the upper lip 26. The second portion 38 may be extend rearwardly from the free end of the first portion 36 but set off at a distance from the free end, creating an overhanging extension 38*f* (FIG. 3F).

Figure 3G:
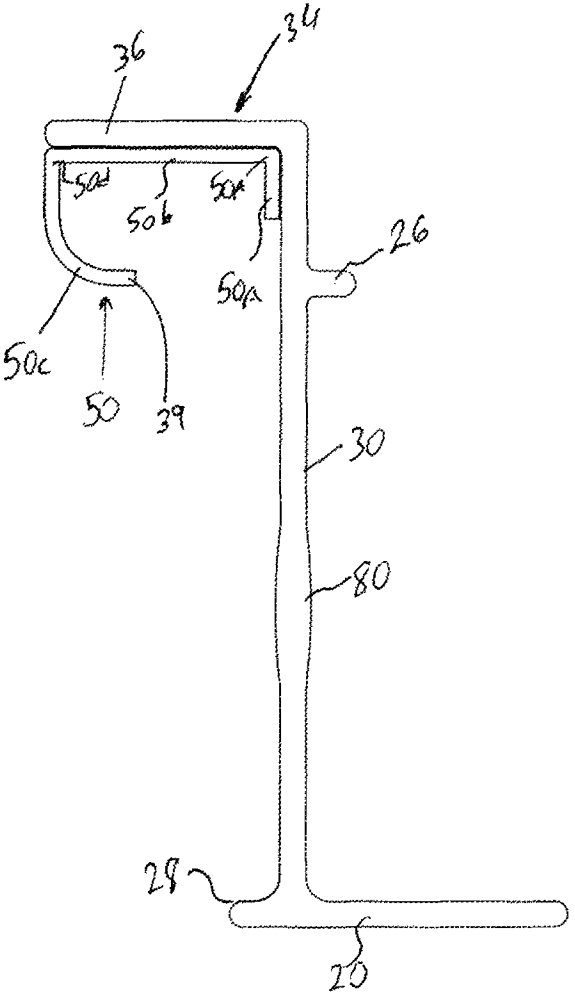
Figure 3H:
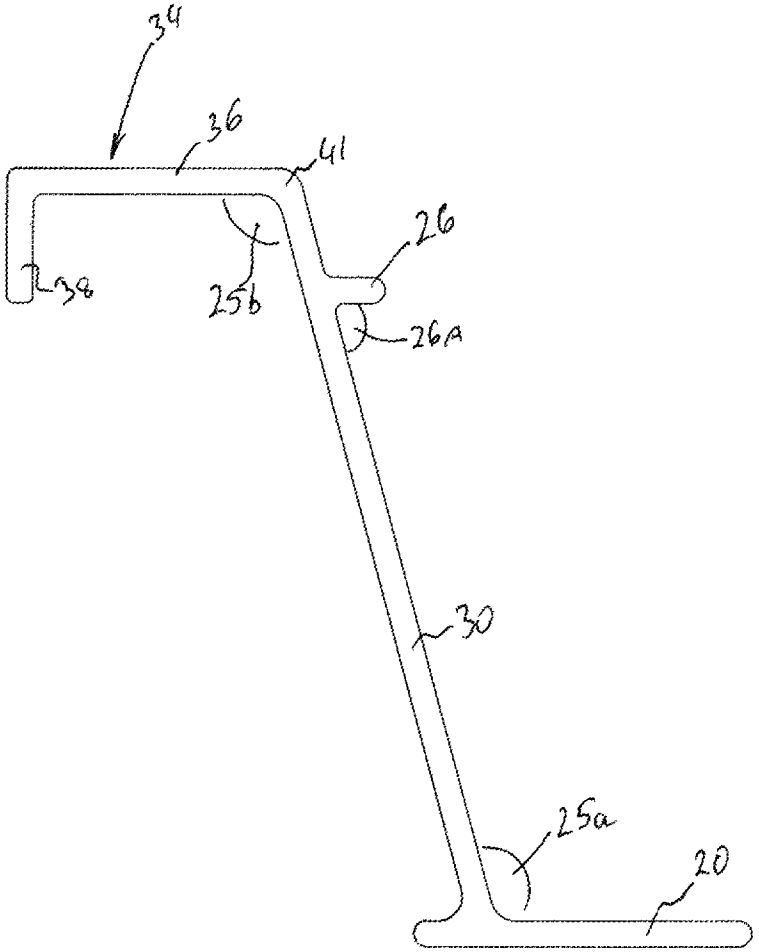
Figure 11:
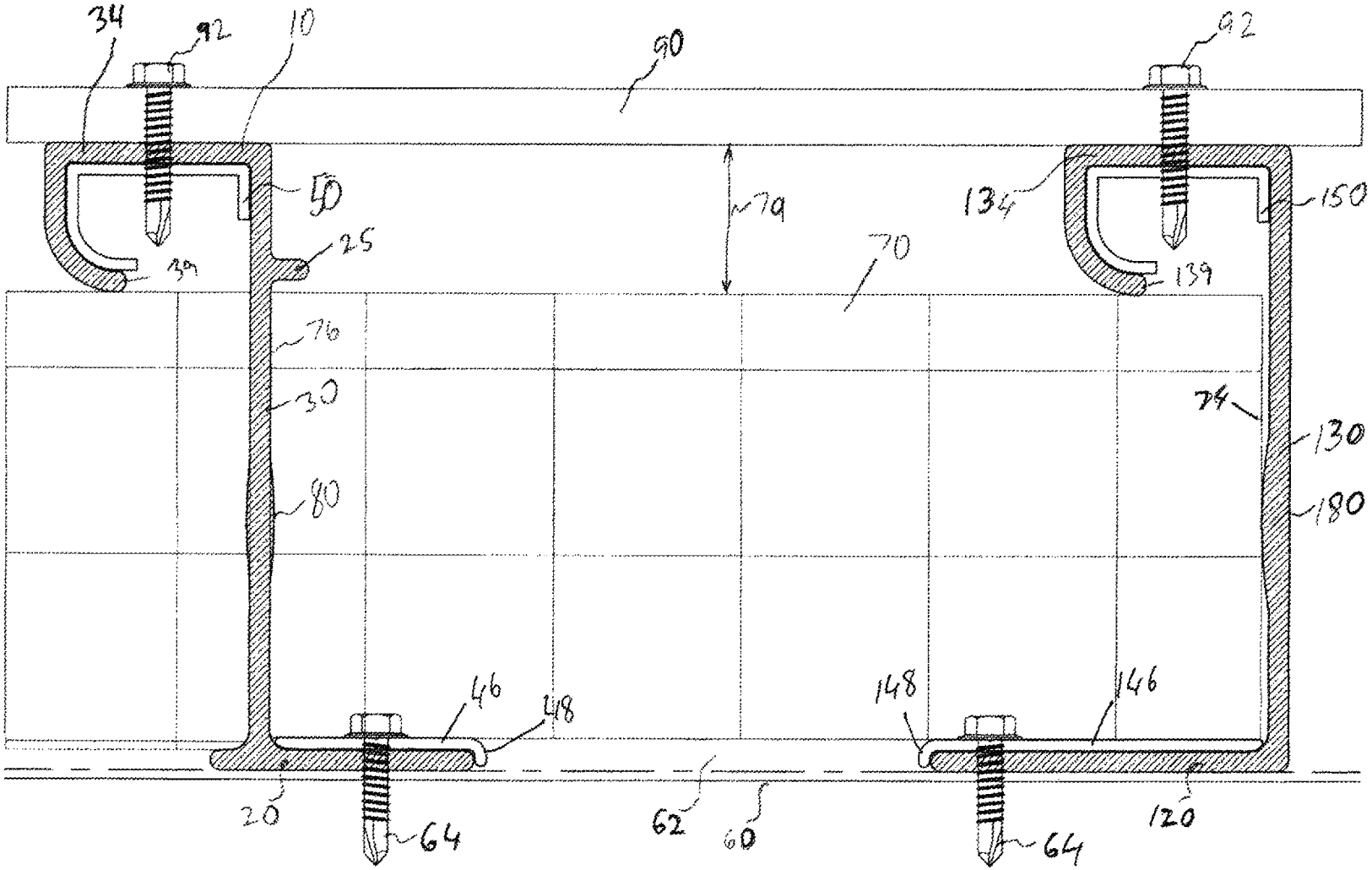
FIG. 11 showing the sideways views of the Z-shaped component and Edge component.

As shown in FIG. 3G, the second portion 38 may be replaced by the removable insert 50. The third wall 50*c* of the insert 50 fulfilling the function of the second portion 38. The free end 39, of the insert 50 now enforcing the thickness of the first moisture gap 79 (FIG. 11). The second wall 30 may be at an angle 25*a* to the first wall 20, that is more of an obtuse angle. The same obtuse angle 25*b* would then preferably be present at free end 41 of the second wall 30 if it is desirable that the first portion 36 remain parallel to the plane of the first wall 20. The upper lip 26 would preferably remain parallel to the plane of the first wall 20, creating an acute angle 26*a*.

Figure 4:
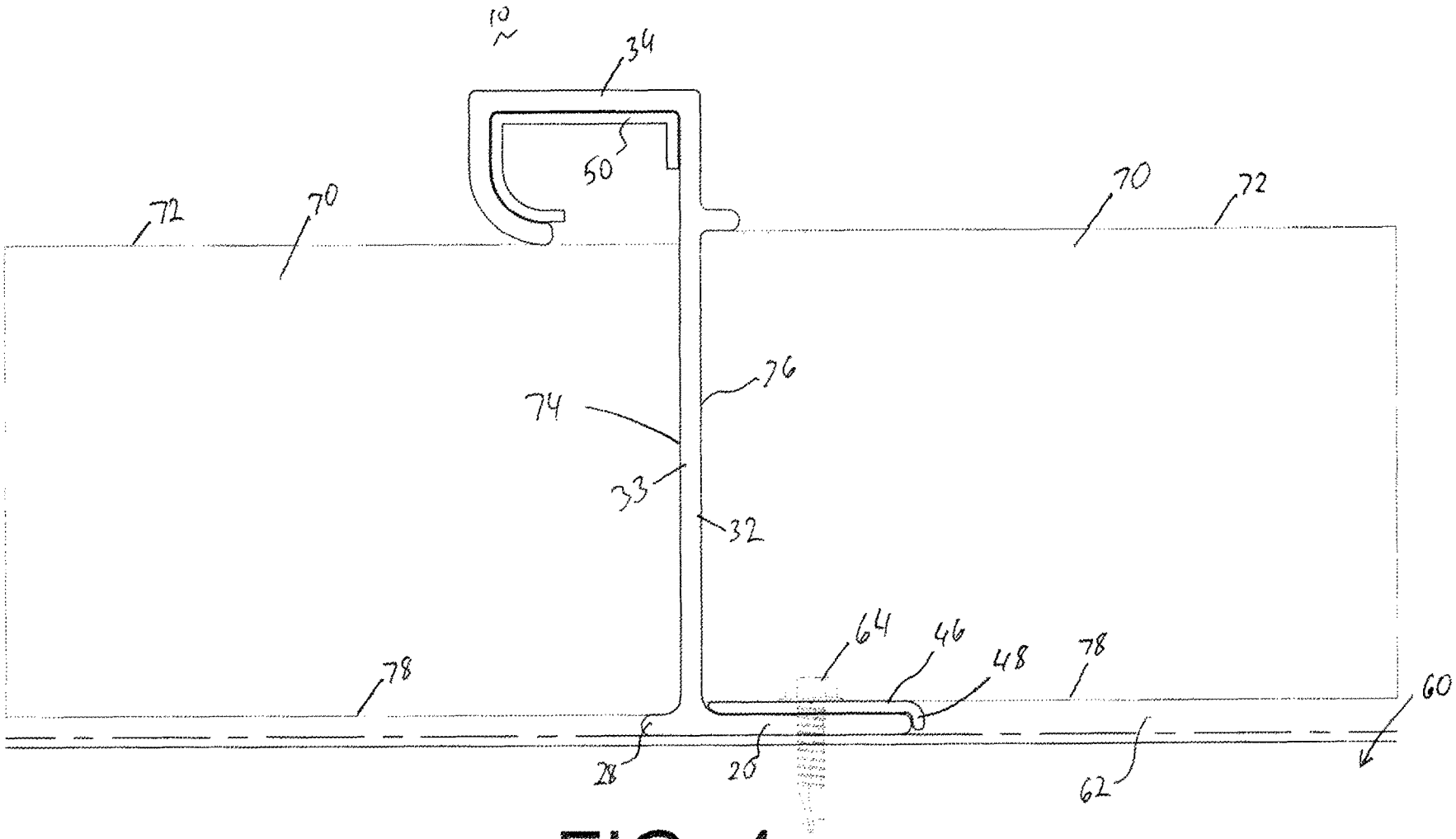
FIG. 4 is another sideview of the Z-shaped component showing insulation panels installed adjacently to first and second sides of the second wall.

FIG. 4 demonstrates the Z-shaped component 10 mounted onto an existing wall 60 with a fastener 64. The fastener 64 is shown perforating the protective bracket 46 and the first wall 20. In this respect the protective bracket 46 functions as a washer and anchor point to ensure that the first wall 20 does not fracture under the strain of the fastener 64. The insert 50 and the protective bracket 46 permit the Z-shaped component to be manufactured out of polymers or other composite materials to minimize cost of manufacturing or weight of the overall construction, with insert 50 and the protective bracket 46 adding strength to the arrangement.

The first end 74 of each insulation panel 70 is adjacent to the second side 33 of the second wall 30 and the first end 76 is adjacent to the second side 32. Each insulation panel 70 is secured in place along its top surface 72 by the lip 25 of one Z-shaped component 10 and the free end 39 of the next Z-shaped component 10. The space 79 then represents the first moisture gap.

The bottom surface 78 of each insulation panel 70 rests on the lip 24 of the first wall 20 of one Z-shaped component 10 and the first wall 20 of an adjacent Z-shaped component 10. The thickness of the first wall 20 creates the second moisture gap 62 between an existing wall 60 and each insulation panel 70.

Figure 5:
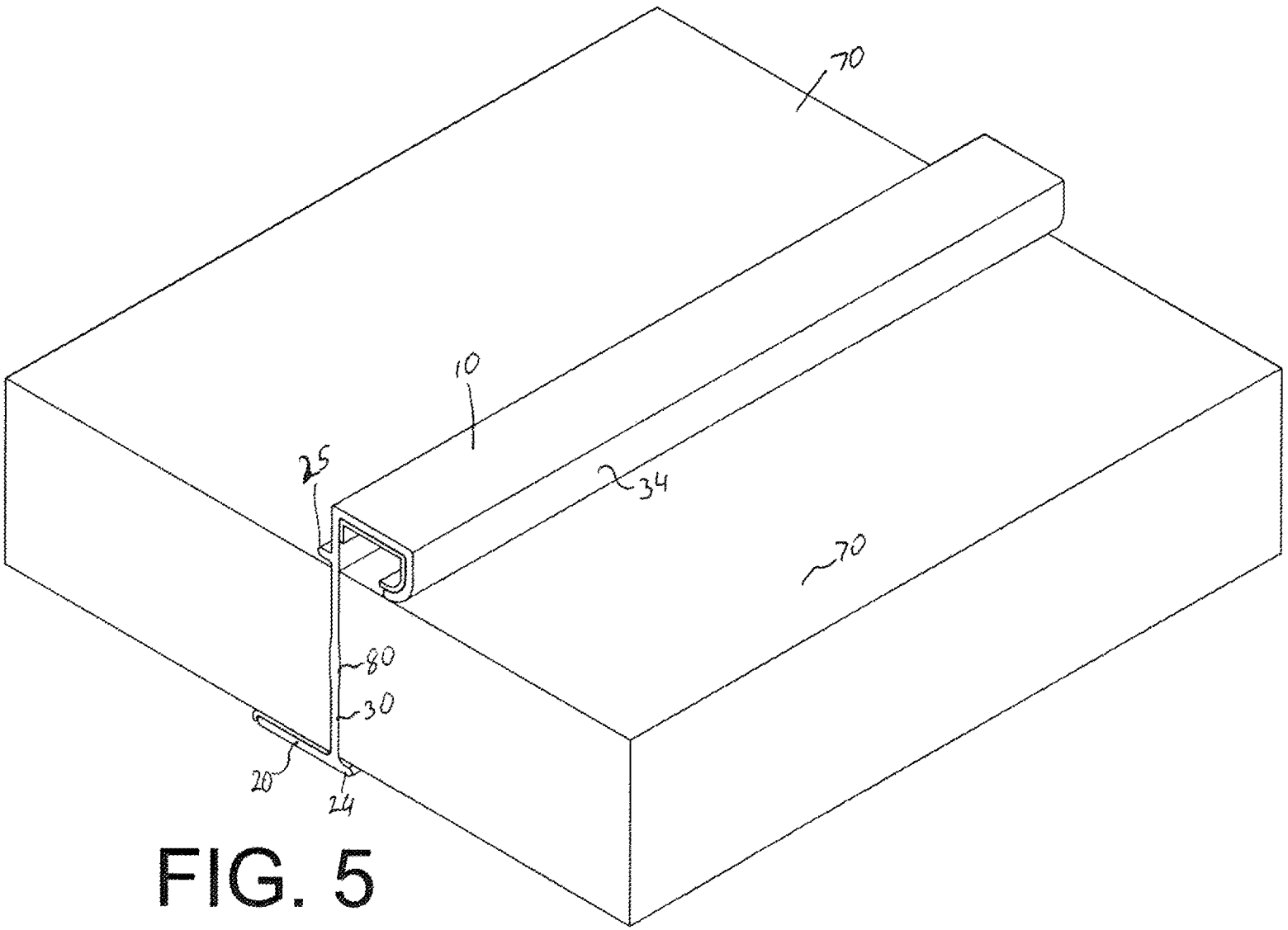
FIG. 5 is a perspective view of the Z-shaped component shown in FIG. 4, which also shows the concave section along the height of the second wall.
Figure 6:
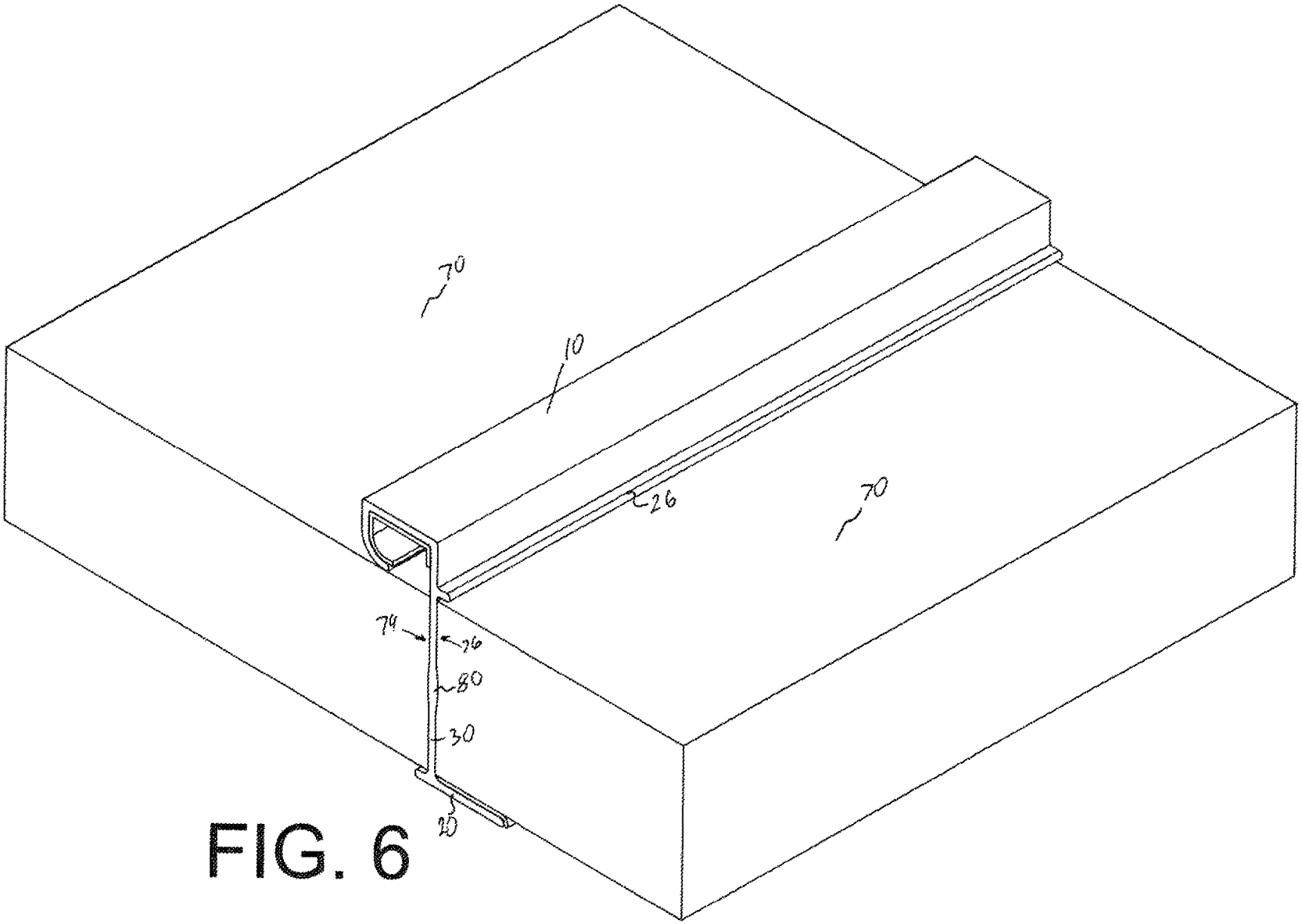
FIG. 6 is the perspective view showing the second side of the Z-shaped component shown in FIG. 5.

FIG. 5 demonstrates the general deployment of Z-shaped component 10 that is shown between two insulation panels 70. The insulation panels 70 are shown contained between the upper lip 26 and J-wall 34 and the lower lip 28 and first wall 20. FIGS. 5 and 6 demonstrate and embodiment featuring a concave section 80 along the height of the second wall 30. The concave section 80 may contain a flared section on at least one side of the second wall 30 and is intended to immobilize and seal the point of contact between the second wall 30 and the first and second ends 76 and 74 of the insulating panels 70.

Figure 7:
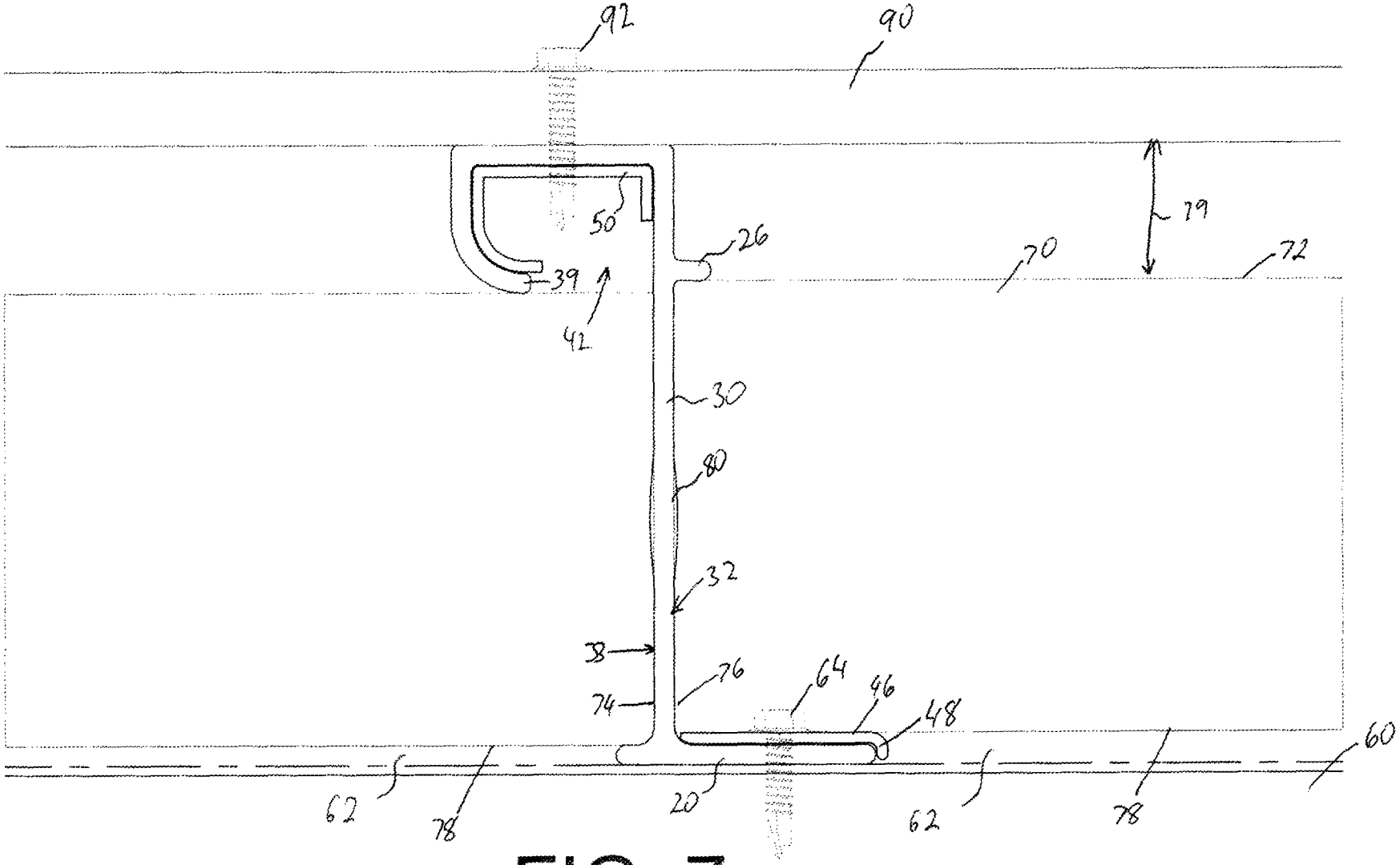
FIG. 7 is a sideways view of the Z-shaped component showing concave section and an external panel bolted to the outer surface of the first portion of the J-shaped wall.

FIG. 7 demonstrates the full deployment of one of a plurality of Z-shaped components 10. The first wall 20 is shown attached to the existing wall 60 with a fastener 64. Extending forwardly at an angle, preferably a right angle, from the first wall 20 is the second wall 30. The second wall 30 is in joined communication with first and second ends 76 and 74 of the insulating panels 70, which are further immobilized by the flared section 80. An upper lip 26 captures the top surface 72 of one of the insulation panels. The set off 25 of the upper lip 26 from the free end 41 of the second wall enforces along the first side 32 the required first moisture gap 79, otherwise known as thermal gap. The wall panel 90 representing an external or cladding paneling 90 is fastened to the outer surface 40 of the J-wall 34. The free end 39 of the J-wall 34 enforces the air or moisture gap 79 along the second side 33 of the Z-shaped component 10. The insert 50, if deployed within the hollow channel 42 and is also used as the anchor point for the fastener 92. The preferred thickness of the moisture gap 79 may be preferably between 1.5 and 2.5 centimeters.

Figure 8:
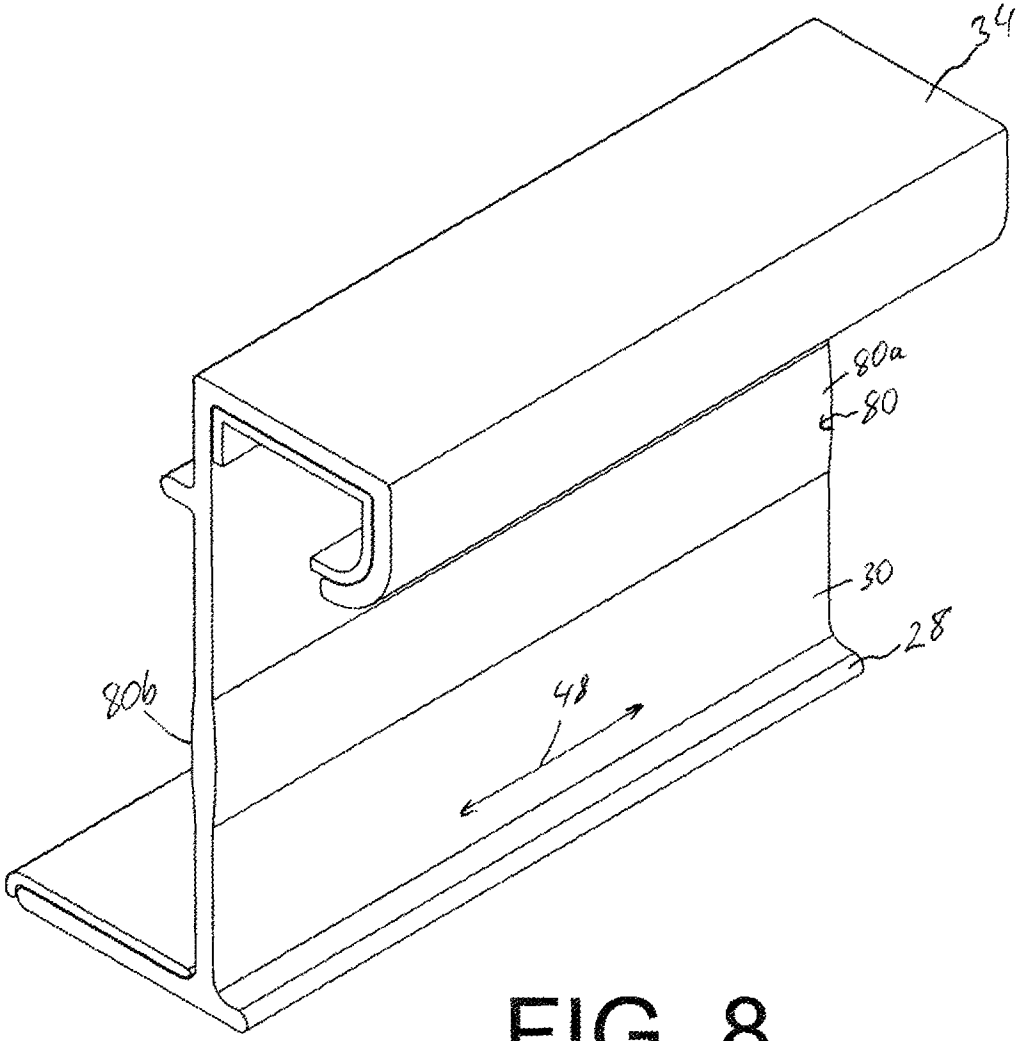
FIGS. 8 and 9 demonstrated the concave section along the height of the second wall.
Figure 9:
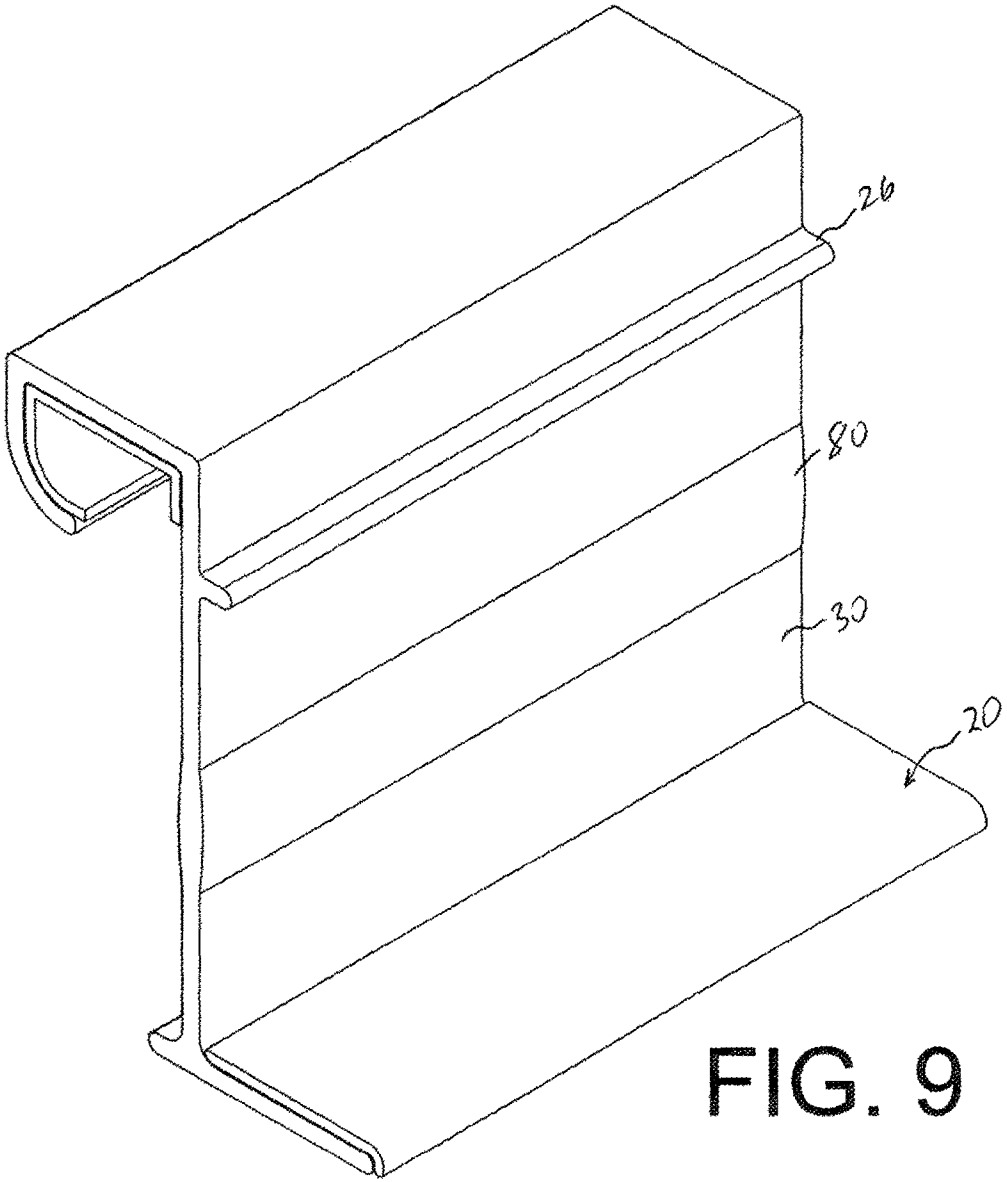

FIGS. 8 and 9 further demonstrate the flared section 80 shown here to be disposed along the entire length of the second wall 30 and on both sides thereof. Alternatively, the flared section 80 may be placed in one or several locations along the length 48 or on only one of the two sides of the second wall 30. There may be a flared section 80*a* and 80*b* on either side of the second wall 80 or just on one of the sides.

Figure 10:
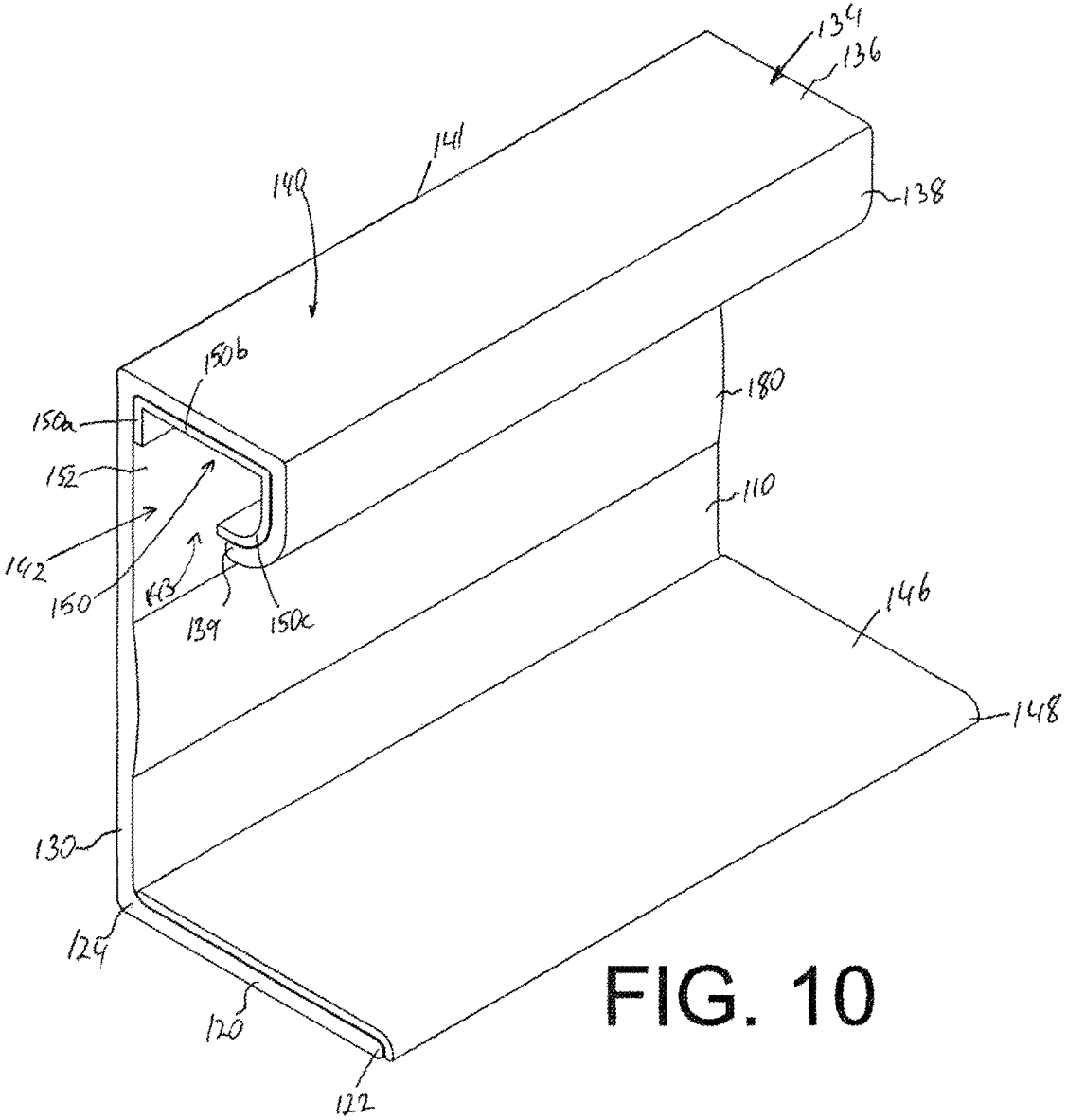
FIGS. 10 and 10A are perspective views of the edge component, with FIG. 10 having the flared section along the second wall.

FIG. 10 demonstrates an edge component 110. Shown is the first wall 120, having a first end 122 and a second end 124. The first wall 120 being parallel with an existing wall 60 (FIG. 11) and being fastened thereon. Extending forwardly at an angle, preferably a right angle, from the free end, otherwise known as the second end 124, is the second wall 130. Extending from the free end 141 of the second wall 130 is the J-wall 134. The first portion of the J-wall 136 extends in the same direction, and in a parallel orientation as the first wall 120. The second portion 138 extends downward from the free end of the first portion 136, with the free end 139 bending toward the second wall 130 and stopping at a distance therefrom, thus creating a gap 143. The curvature of the J-wall 134 forming a hollow channel 142.

The insert 150 is preferably present and is removably inserted into the hollow channel 142 either through the side opening 132 or through the gap 143. The insert 150 having the first wall 150*a*, shown substantially as a stub wall adjacent to the second wall 130. Extending laterally at an angle, preferably a right angle, from the first wall 150*a*, is the second wall 150*b* that is adjacent with and parallel to the first portion 136. Extending downwardly from the free end of the second wall 150*b* is the third wall 150*c*, which in this embodiment is adopted to mirror the curvature of the second portion 138. It should be appreciated that the walls 150*a*-150*c* may be shaped differently and not be completely or actually adjacent to the outer walls forming the hollow channel 142. It should alto be appreciated that the insert 150 may be a solid rod or cuboid or extending part of the way within the length of the hollow channel 142. It should further be appreciated that FIGS. 3A-3E depicting various shapes of the J-wall 134 of the Z-shaped component 10 may be implemented with the Edge component 100 with equal effectiveness. The embodiment shown in FIG. 10 demonstrates the protective bracket 146, further having the flange 148.

Figure 10A:
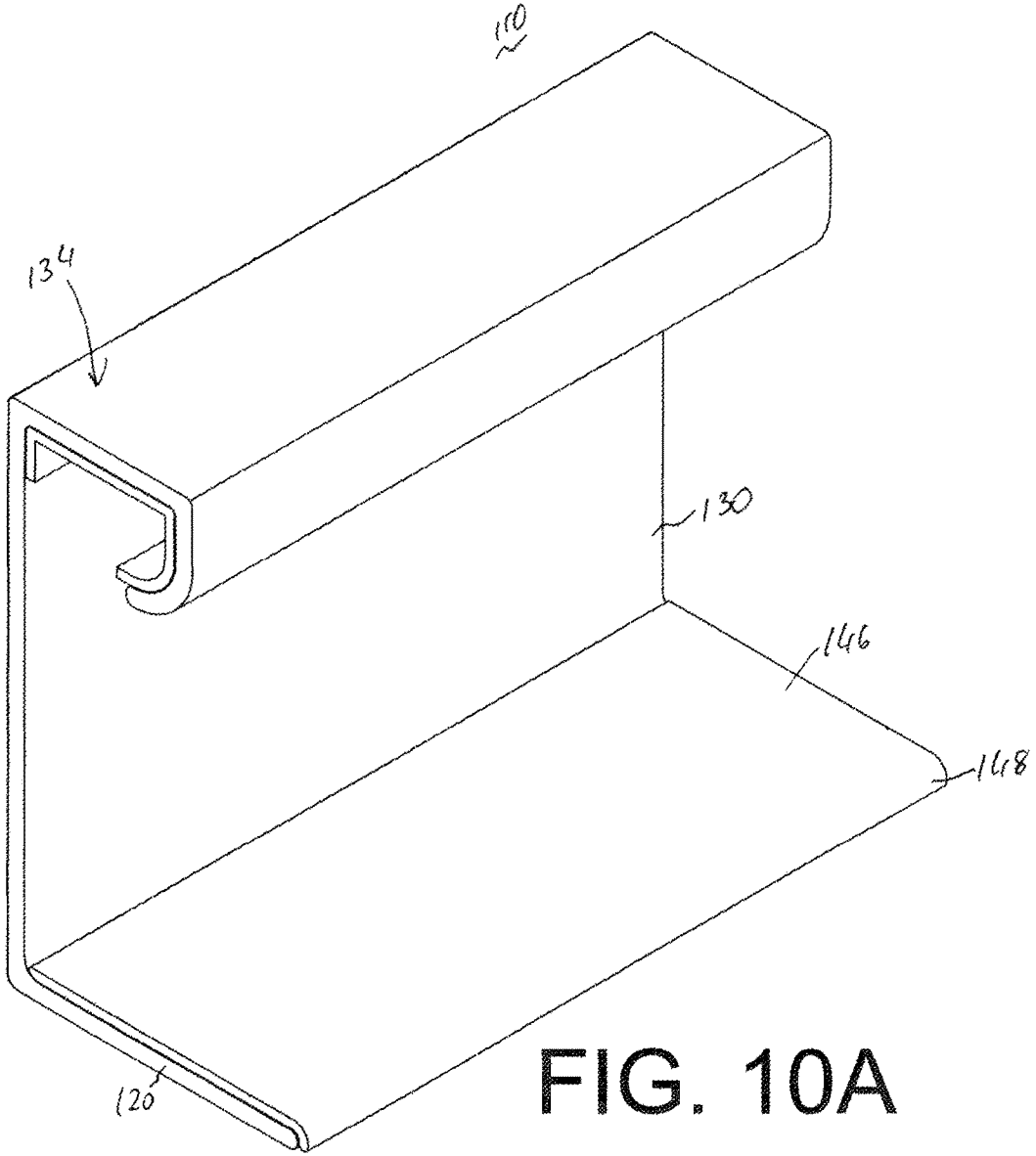

FIG. 11 demonstrates the implementation of the edge component 110 along with the Z-component 10. The edge component 100 is deployed along an existing wall 60 in a parallel, spaced apart configuration with one of a plurality of the Z-shaped components 10. An insulation board is retained between the edge component 100 and the adjacent Z-shaped component 10. Where the first end 76 is adjacent to the second wall 30 and the second end 74 is adjacent to the second wall 130. The embodiment shown further comprises flared section 80 on the second wall and the flared section 180 on the second wall 130. However, as shown in FIG. 10A, the second wall 130 need not include the flared section 180. Either or both the Z-shaped component 10 or the edge component 100 may be deployed with the second wall thereof not featuring a flared section.

It is preferred that the free end 39 of the Z-shaped component 10, the free end 139 of the Z-shaped component 100 and the upper lip of the Z-shaped component 10 are coplanar, to enforce a uniform, or minimum, moisture or thermal gap 79 between the top surface of the insulation panel and the exterior or cladding paneling 90. The exterior panel 90 is fastened to the J-wall 34 and the J-wall 134. The second moisture gap 62 is enforced by the first wall 20 and the first wall 120 of the Z-shaped component 10 and the edge component 100, respectively.

Figure 12:
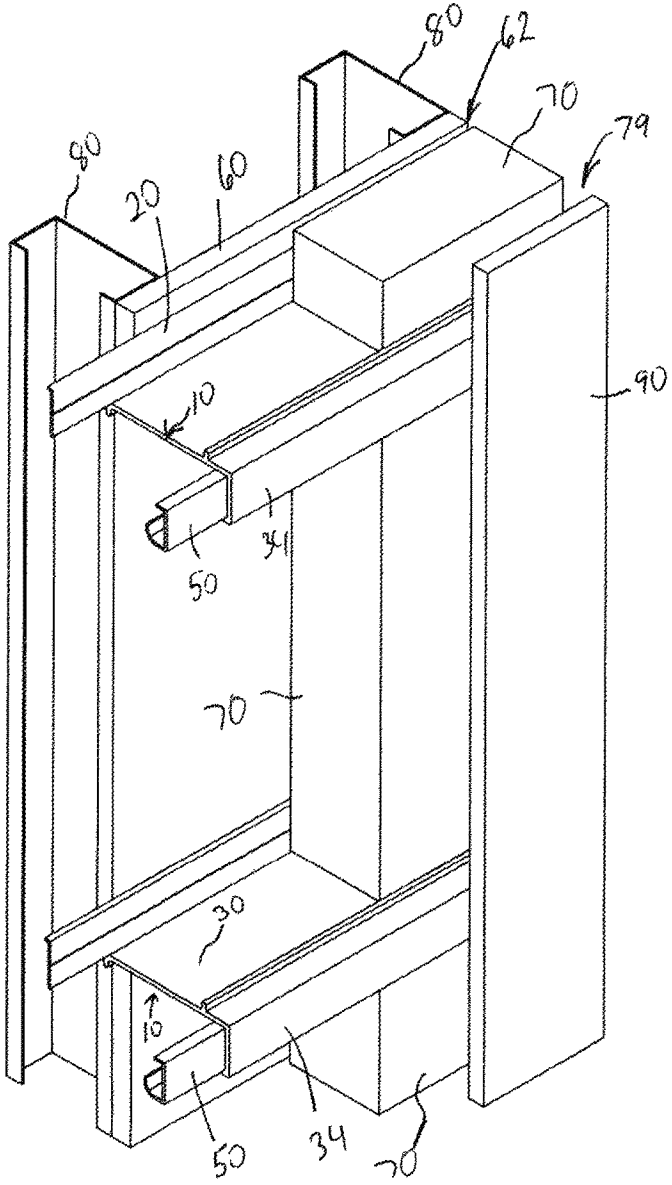
FIG. 12 is a view of a plurality of Z-shaped components with insulation panels installed therebetween.

FIG. 12 demonstrates the plurality Z-shaped components 10, deployed in a parallel and spaced apart configuration along an existing wall 60. The plurality of insulation panels 70, with each panel retained within the space between two adjacent Z-shaped components 10, or adjacent Z-shaped component and an Edge component. A plurality of exterior wall panels 90 fastened to the J-walls 34 of the Z-shaped components 10 or/and the edge components. The J-wall 34 is shown creating the first moisture gap 79, and the first wall 20 is shown creating the second moisture gap 62.

Figure 13:
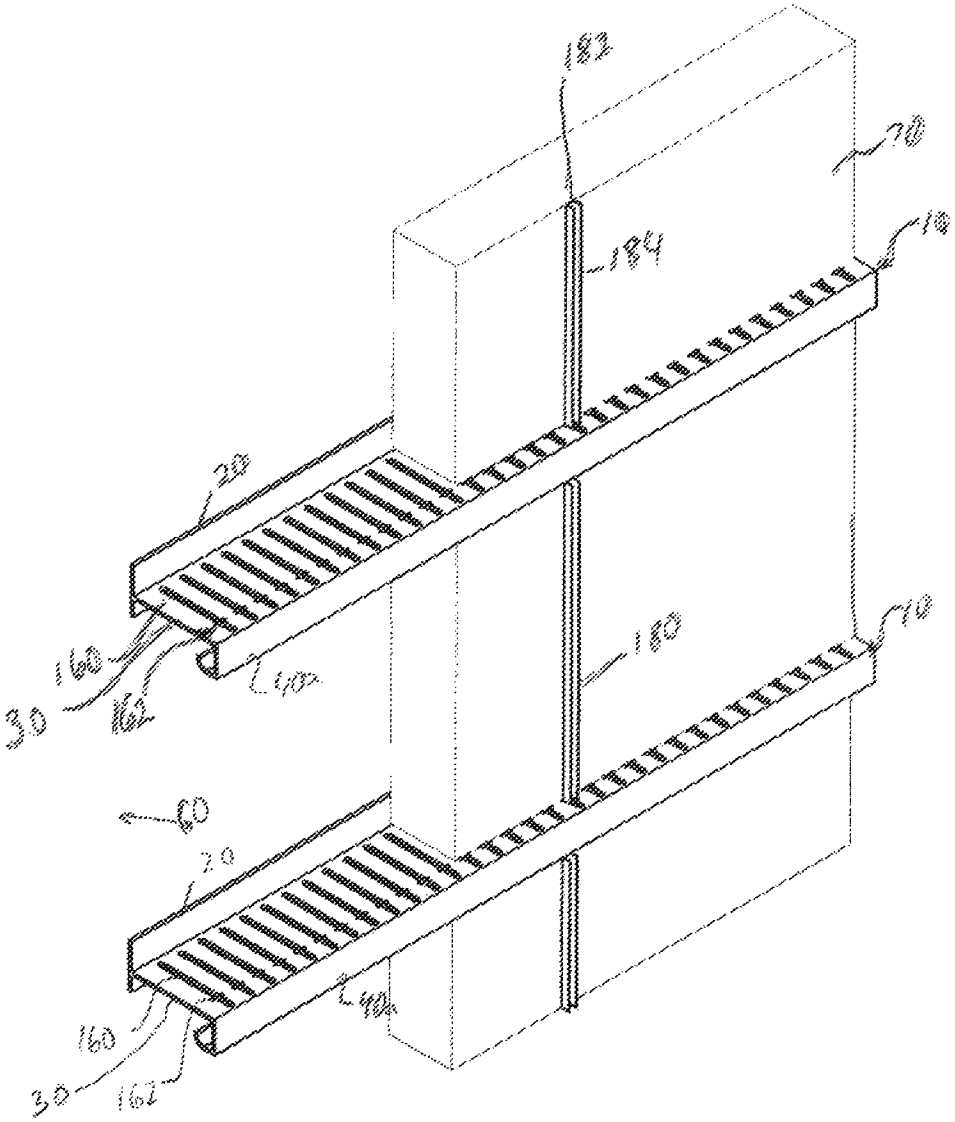
FIG. 13 demonstrates an alternative embodiment of Z-shaped components with an insulation panel installed therebetween and secured with intersecting rods.

FIG. 13 demonstrates an alternative embodiment of the system of securing insulation panels using the Z-shaped component 10. Each Z-shaped component 10 shown contains a plurality of elongated air slots 160. The elongated slots 160 are in a parallel and spaced apart relation to each other. At least one intersecting slot 162 intersects each of the elongated slots 160. The intersecting slot 160 is configured to admit the base wall 182 of the rod 180 inserted therethrough. The rod 180 spans the distance between two adjacent Z-shaped components 10 and is used to lock the insulation panel in place with respect to the wall 60 and the first moisture gap 79. One rod 180 may intersect two or more adjacent Z-shaped components in a series of adjacently placed Z-shaped components 10 or a separate rod 180 may span each distance between any two Z-shaped components 10.

Figure 14:
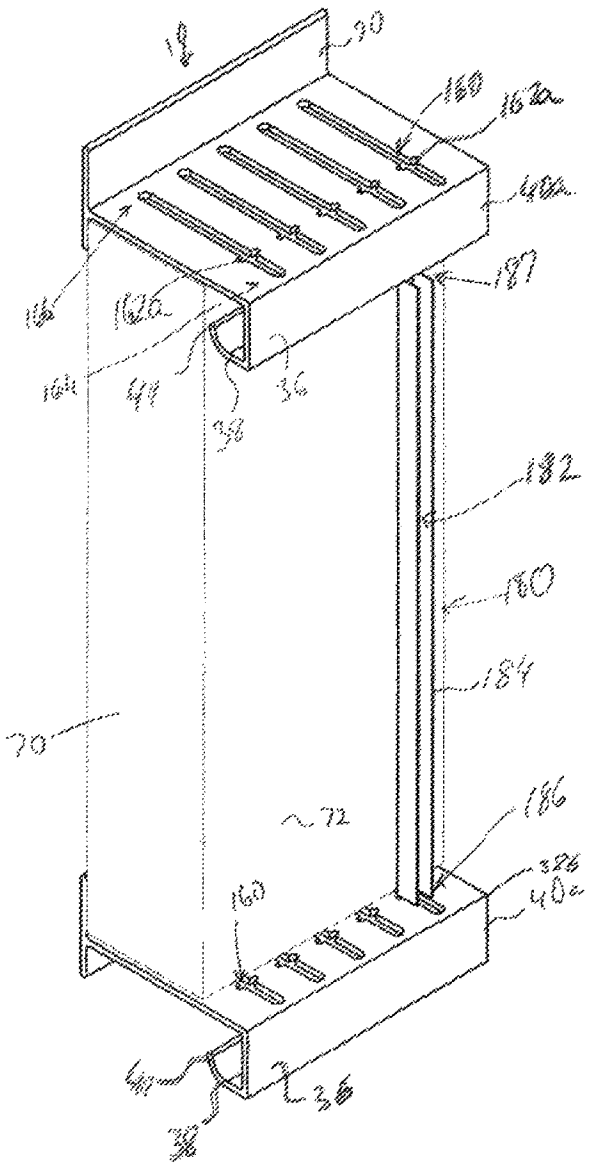
FIG. 14 is a closer view of the embodiment shown in FIG. 13.

The embodiment shown in FIG. 13 is demonstrated in FIG. 14 in greater detail. Shown is a Z-shaped component 10, having a first wall 20, a second wall 30 and a rearwardly extending wall 40*a*. The rearwardly extending wall 40*a* has been previously referred to as the J-shaped wall. The shape and structure of the rearwardly extending wall 40*a* may vary, as provided in previous drawings. Also shown in FIG. 14 is a plurality of elongated air gaps 160 disposed at intervals throughout the third wall 30. The elongated air gaps 160 are shown to be perpendicular to the axis of the first wall 20 but may be offset at an angle thereto. Each elongated air gap 160 having an A end 164 oriented proximally or near to the free end 38*a* of the second wall 30, and a B end 166, oriented proximally, or near, to the first wall 20. An intersecting slot 162 intersecting the elongated air gap 160 at a distance from the A end. As shown in FIG. 14, it is preferred that all intersecting slots 162 are located at the same level and parallel with each other. Additional intersecting slots may be made along the length of the elongated air gap 160 (not shown) to accommodate thinner insulation panels 70.

Still referring to FIG. 14, shown is the rod 180. The rod 180 preferably has at least one second wall 184 extending at angle, preferably a right angle, from the base wall 182. The first end 186 of the base wall 182 is inserted into one of the intersecting slots 162 and the second end 187 is inserted beneath the free end 41 of an adjacent Z-shaped component or continues through to the intersecting slot 162*a* of the adjacent Z-shaped component. The second wall 184 abuts the second wall 30 of one Z-shaped component 10 and the second portion 38 of the rearwardly extending wall 40*a* of the adjacent Z-shaped component 10 to maintain a certain degree of insertion of first and second points 186 and 187, respectively, with respect to the slots 162 and 162*a*. Appreciably there may be a separate rod inserted into each intersecting slot 160 and a corresponding slot 162*a*. Or there may be fewer rods 180 than the number of elongated slots 160.

Figure 15:
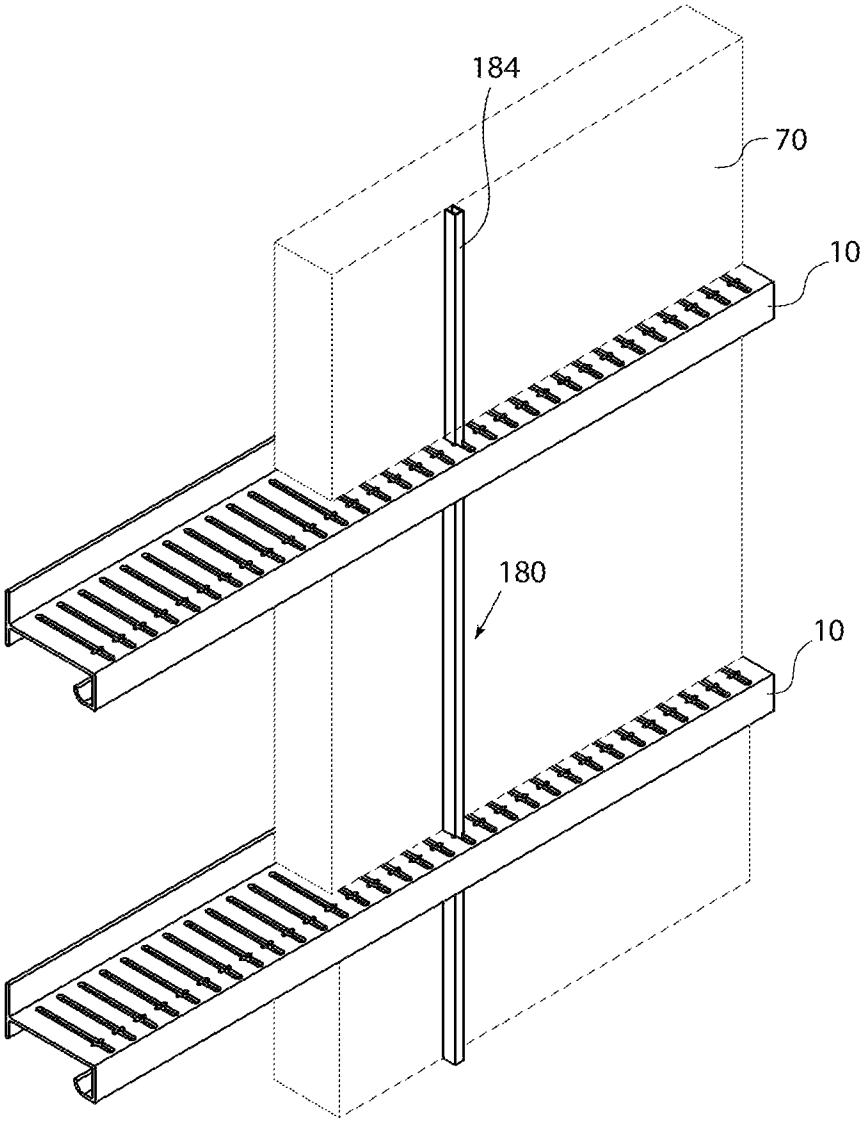
FIG. 15 demonstrates an alternative embodiment of Z-shaped components with an insulation panel installed therebetween and secured with intersecting rods.
Figure 16:
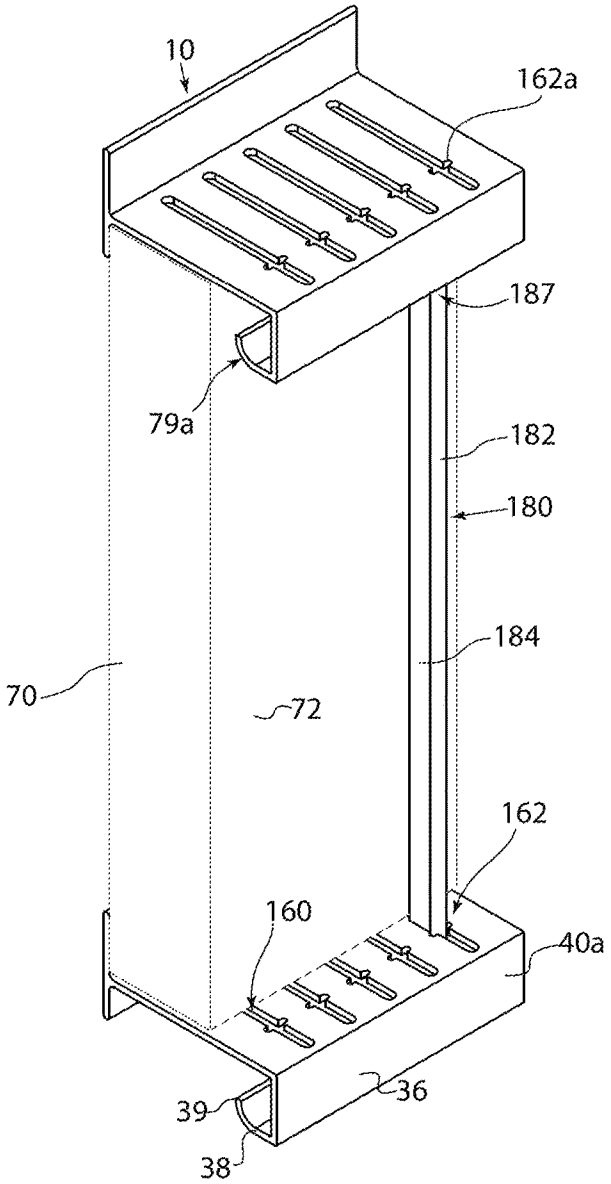
FIG. 16 is a closer view of the embodiment shown in FIG. 14.

FIGS. 15 and 16 demonstrate how the width of the gap 79 can be regulated using the rod 180. In FIG. 14, the second wall 184 was shown pointing away from the top surface 72, therefore, the first air gap 79 was the distance between the free end 41 and the wall panel 90 (FIG. 11). In FIGS. 15 and 16, the second wall 184 is pointing toward the top surface 72 of the insulation panel 70. Thus, the first air gap 79 has increased to account for the width of the wall 184.

Figure 17:
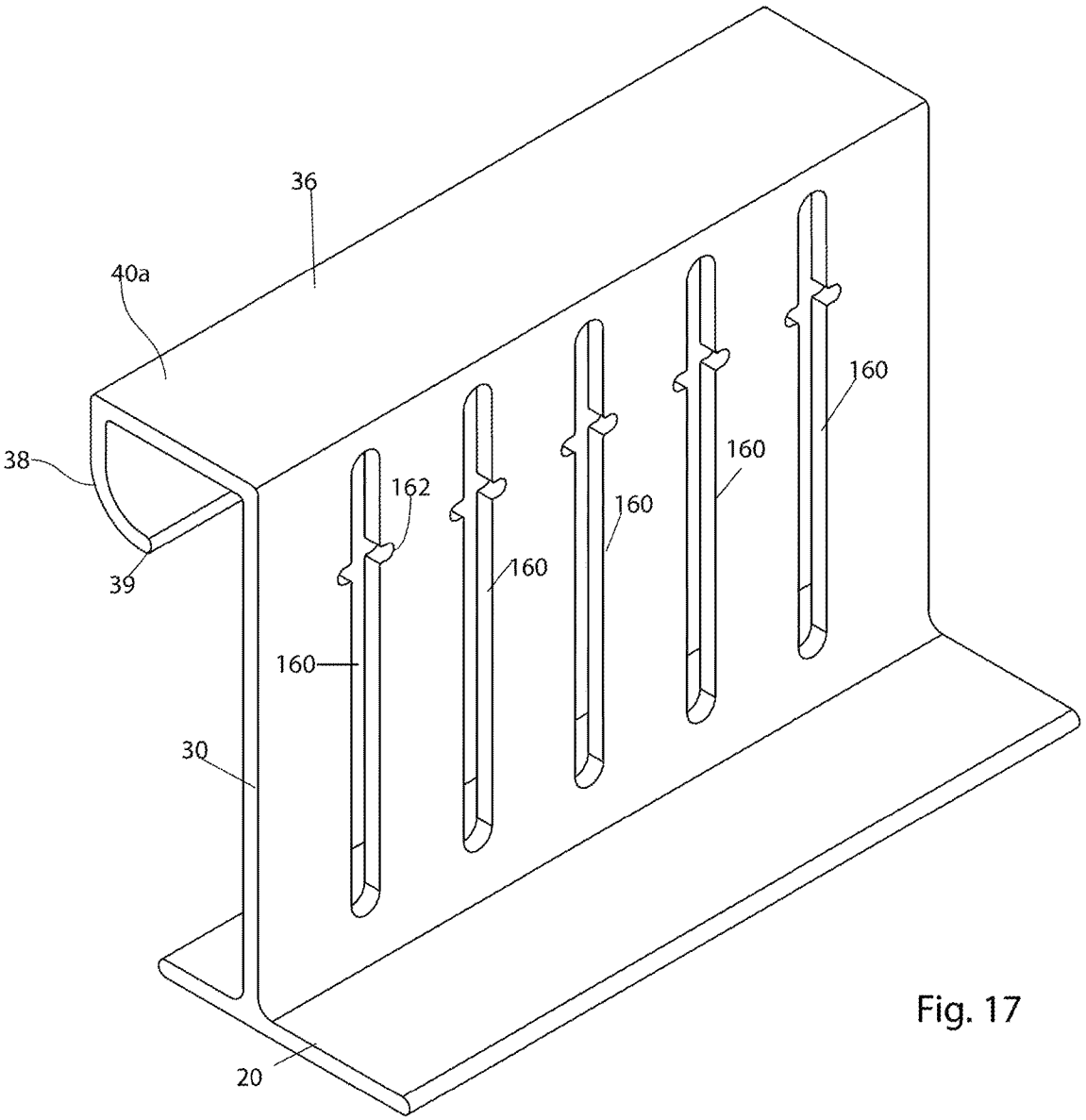
FIG. 17 is a perpendicular view of the alternative embodiment of the Z-shaped component shown in FIG. 13.
Figure 18:
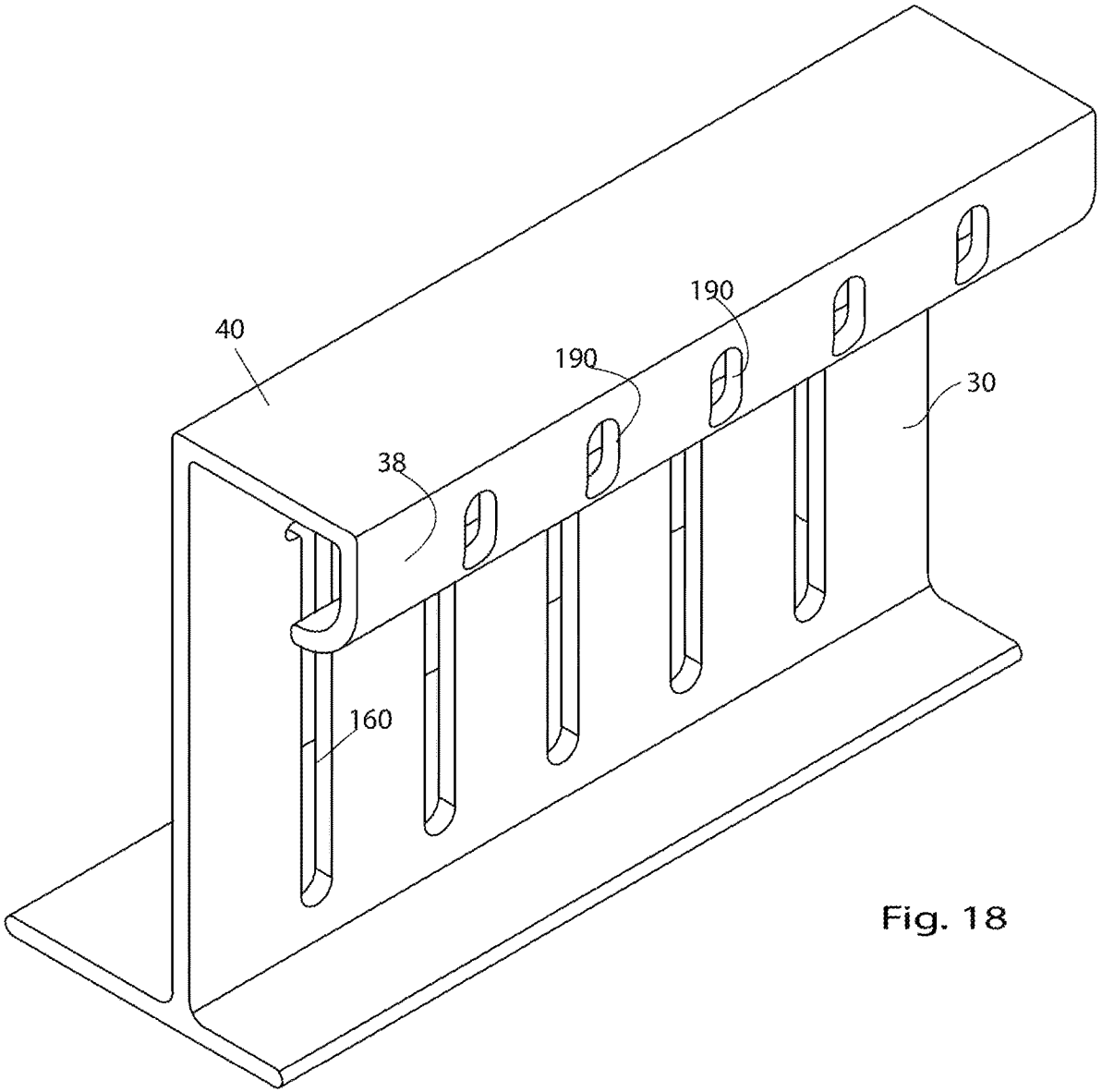
FIG. 18 is another perpendicular view of the alternative embodiment of the Z-shaped component shown in FIG. 13, shown from another angle.

FIGS. 17 and 18 demonstrate the alternative embodiments of the Z-shaped component 10 featuring a plurality of parallel elongated air gaps 160. The function of the air 160 is to permit a constant flow of air flowing through the Z-shaped components. This air flow provides the necessary ventilation to keep insulation panels 70 dry and free of mold and other harmful buildup that would otherwise result from ever-present moisture. Working together and in concert with the elongated air gaps 160 is a plurality of air openings 190 made through the second portion 38 of the J-shaped wall 40. The air openings 190 are designed to let air through even though the rest of the length of the second wall 30 may be blocked due to the presence of the insulation panel 70. The air openings 190 are preferably co-axial to or being in line and parallel with the elongated air gaps 160 but may be offset in other embodiments.

Figure 19:
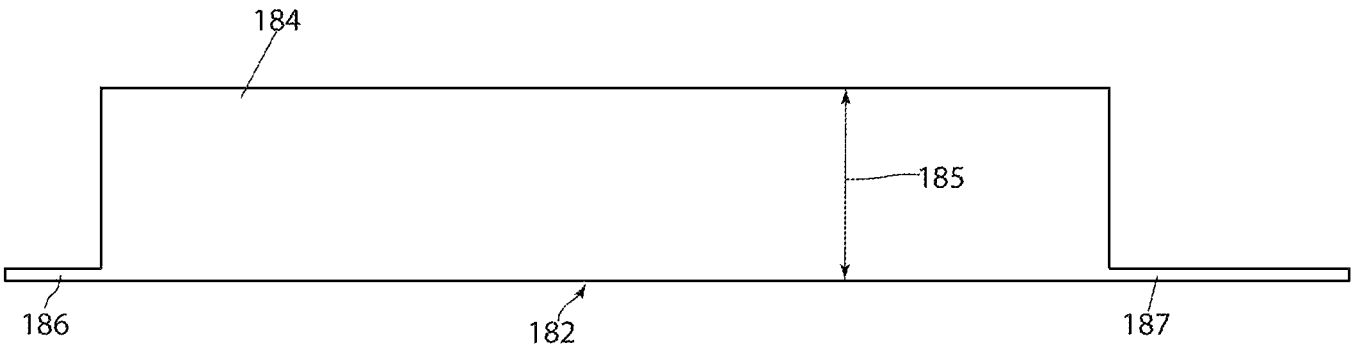
FIGS. 19 and 20 is an embodiment of a rod for retaining insulation panels between two adjacent Z-shaped components.
Figure 20:
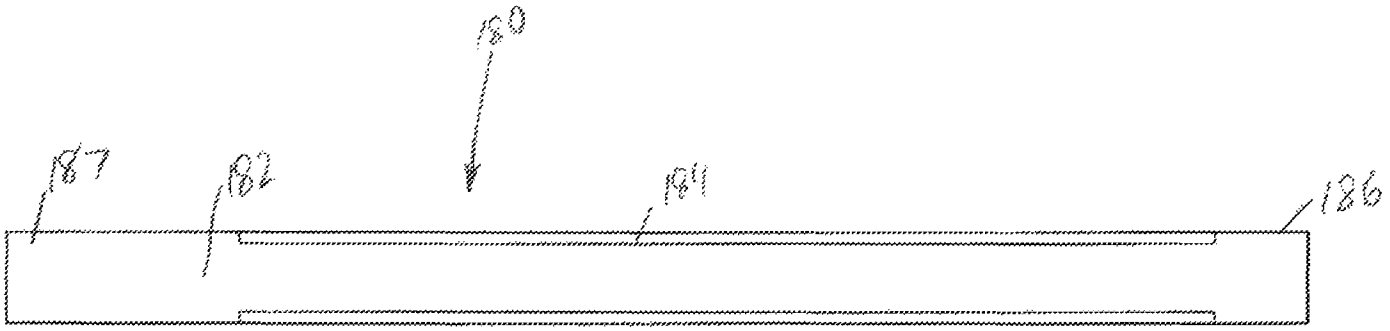
Figure 20A:
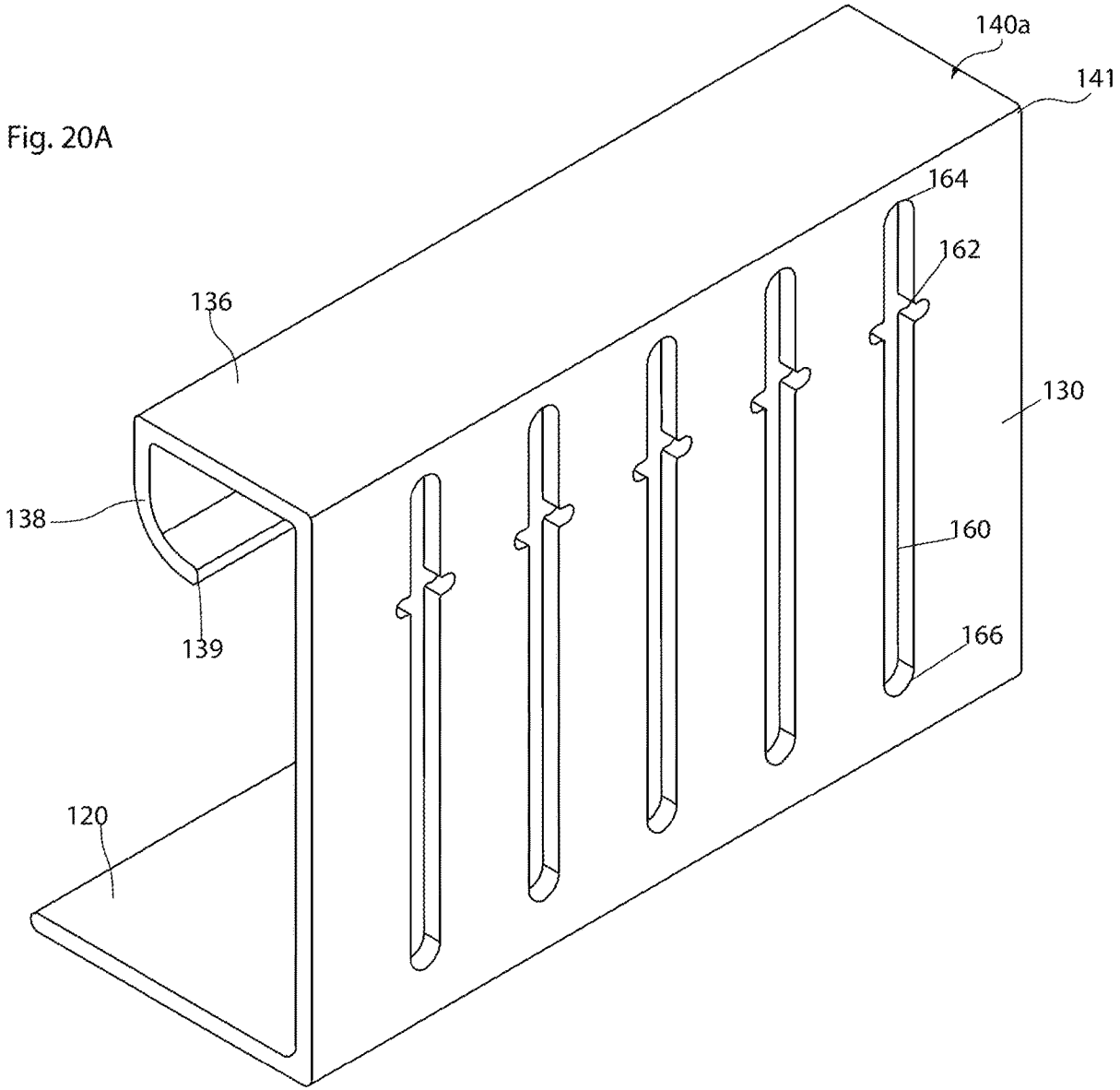
FIGS. 20A and 21 are detailed diagrams of an alternative embodiment of the edge component having a plurality of air slots and air openings.

FIGS. 19 and 20 demonstrate the rod 180. Shown is the base wall 182, at least one second wall 184, a first end 186 and a second end 187. The width 185 of the second wall 184 may vary based on preference, the thickness of the insulation panel used or the air gap desired, with the greater width 185 resulting in a greater air gap if the second wall 184 is pointed toward the top surface 72 of a panel 70. The shape of the second wall 184 may be rounded. The second walls 184 is shown to extend perpendicularly from free sides of the base wall 182. Alternatively, the angle of the second wall 184 with respect to the base wall 182 may be different and the second wall 184 may be disposed towards the middle of the base wall 182, or not be presented as a solid wall, but a series of protrusions.

FIG. 20 demonstrates the edge component having a slightly different embodiment than shown in prior figures. Shown is the edge component 110 having a first wall 120, a second wall 130 and a forwardly extending wall 140*a*. The forwardly extending wall 140*a* is comprised of a first portion 136, which originates from at an angle, preferably a right angle, from a free end 141 of the second wall 130. The first portion is parallel to and spaced apart from the first wall 120. The second portion 138 extends downward and toward the first wall 120 and is in a parallel spaced apart arrangement with the second wall 130. The free end 139 is the most distal end of the second portion 138 and preferably is coaxial (or on the same level) as a free end 39 of a Z-shaped component 10 that is mounted adjacently to the edge component 110.

Figure 21:
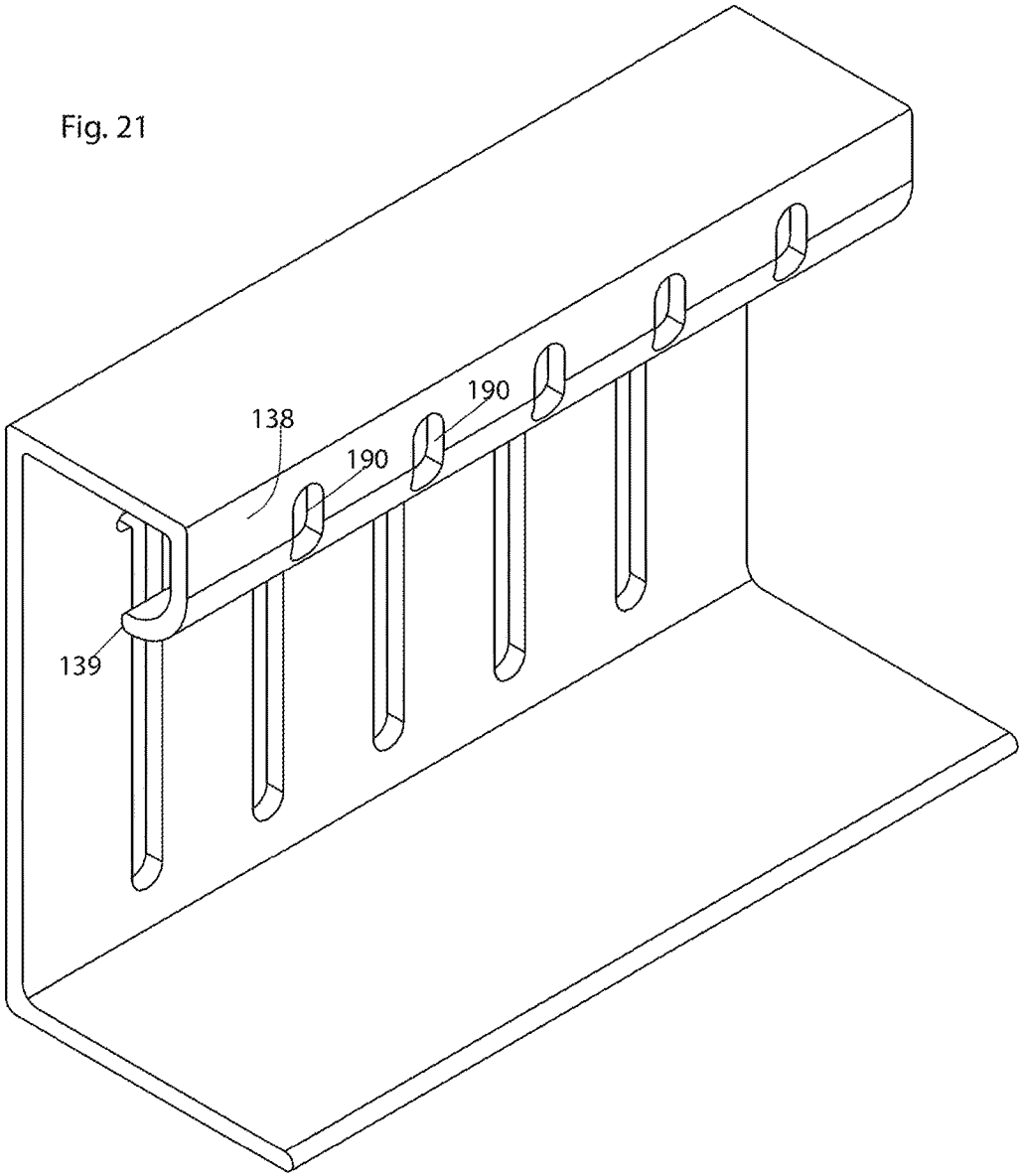

There is a plurality of elongated air gaps 160 shown running across the second wall 130, with the A end 164 being adjacently located to the forwardly extending wall 140*a* and the B end being adjacently located to the first wall 120. At least one intersecting slot 162 intersects each one of the elongated air gaps 160 preferably perpendicularly. There may be additional intersecting slots 162 on each of the air gaps 160. FIG. 21 shows a plurality of air openings 190 along the second portion 138 above the free end 139.

Figure 22:
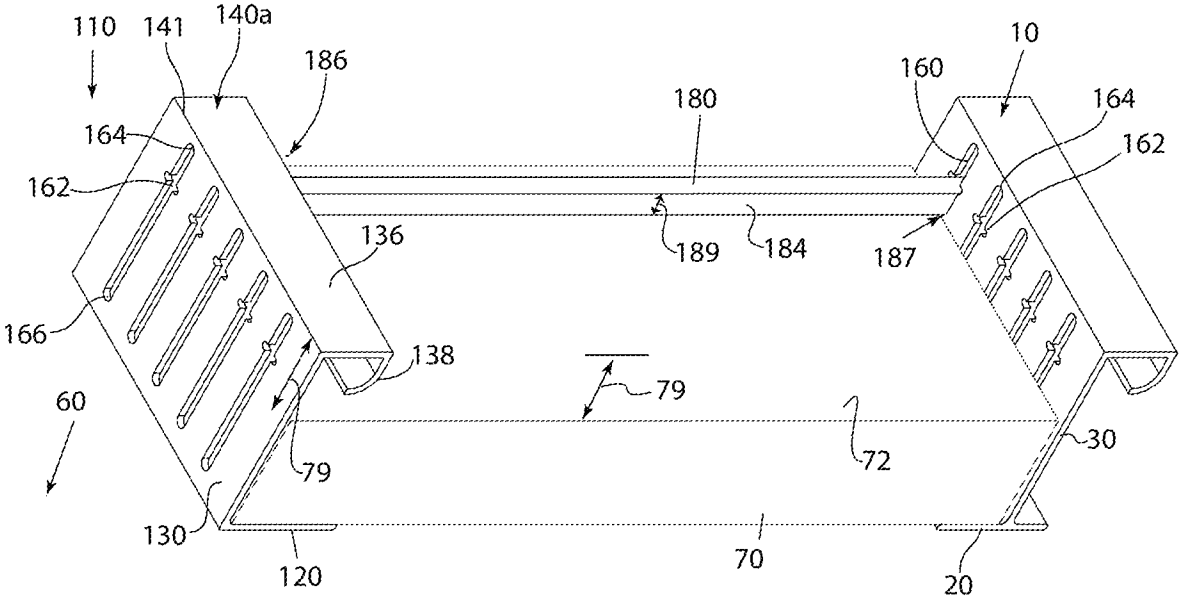
FIG. 22 is another diagram of a rod for retaining insulation panels between two adjacent Z-shaped components.
Figure 23:
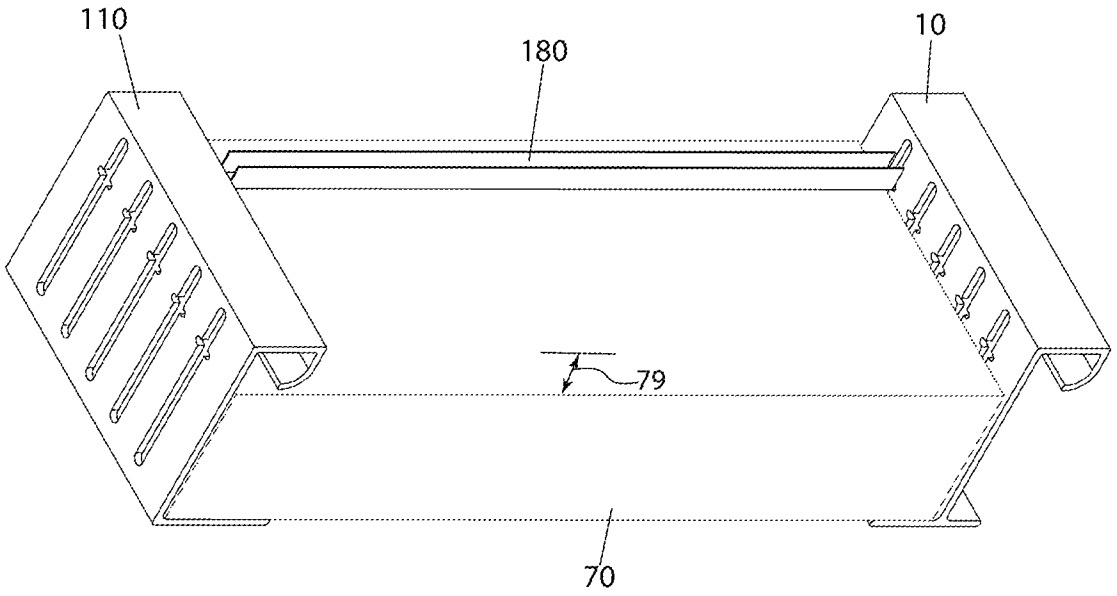
FIG. 23 demonstrates a combination of the Z-shaped component together with an edge component as shown in FIG. 13.

FIGS. 22 and 23 demonstrate how the edge component 110 works in concert with a Z-shaped component 10. The edge component 110 is deployed along an edge of an existing wall 60 or at an end of a section of wall cladding, where one section of a wall cladding 90 (FIG. 12) must be interrupted.

As shown in FIG. 22. The first end 186 of the rod 180 is mounted within one of the intersecting slots 162 of the edge component 110 and the second 187 is mounted in the intersecting slot 162 of the nearest adjacent Z-shaped component 10. The width 189 and the orientation of the second wall 184 of the rod 180 determines the width of the air gap 79. Thus in FIG. 22, the second wall is pointing towards and abuts against the top surface 72 of the insulation panel 70. This configuration is required to widen the air gap 79, or when using a thinner insulation panel 70. If the rod 180 is used to secure a section of the insulation panel 70 a configuration shown in FIG. 23 is utilized. Here the second wall 184 of the rod 180 points away from the top surface 180 and the thickness of the air gap 79 is counted from the free end 39 or 139 of the Z-shaped component 10 or the edge component 110, respectively, or from the desired level of intersecting slots 162. While the air gaps 160 are shown to be elongated, these may be formed in any shape, such as plurality of round openings, or more elliptical openings, or gaps that run across the second wall 30 or 130, and in parallel with the second wall 20 or 120.

Figure 24:
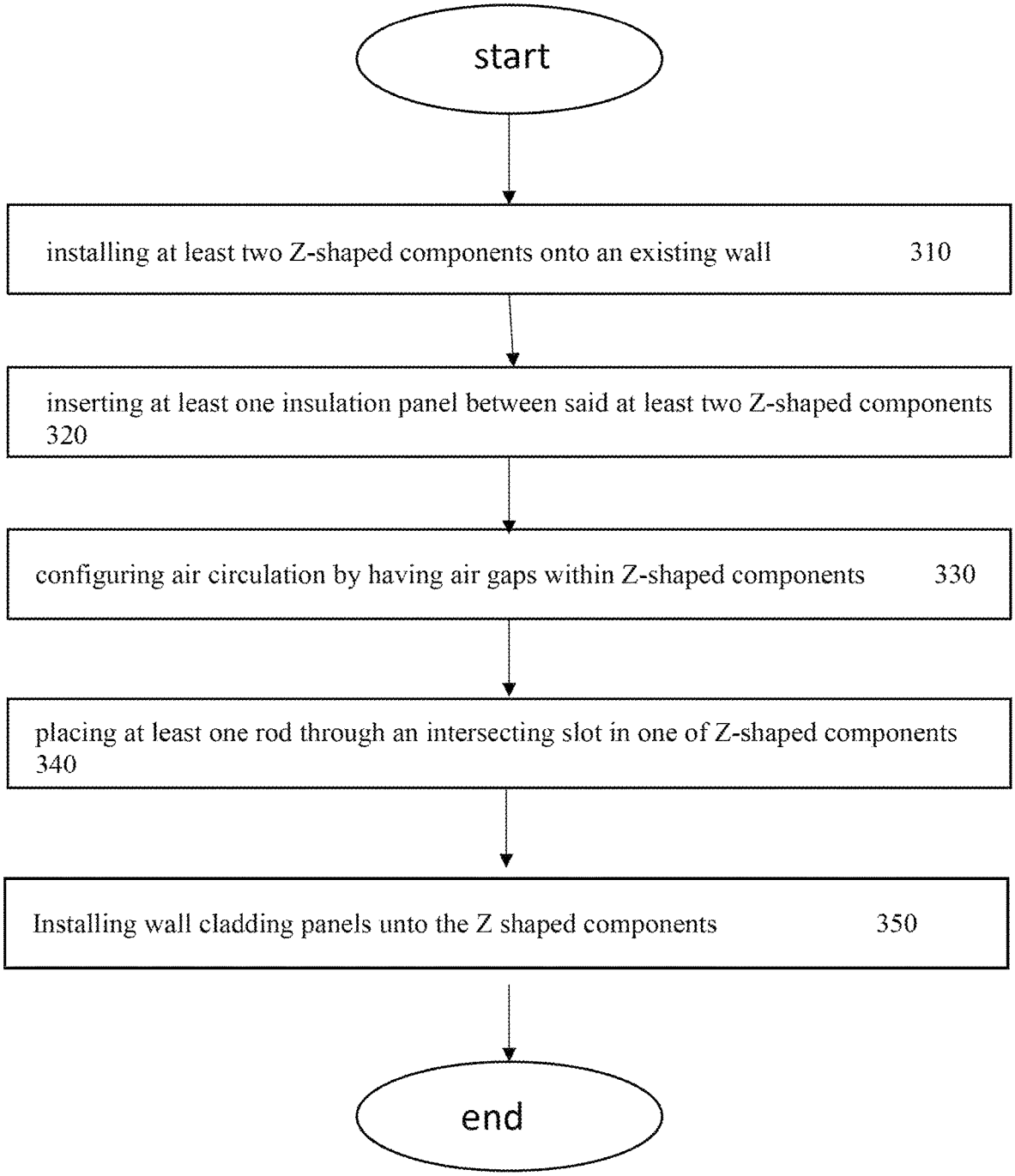
FIGS. 24 and 25 demonstrate the method of insulating and placing wall cladding on an existing wall utilizing the Z-shaped components and the edge components shown in present invention.
Figure 25:
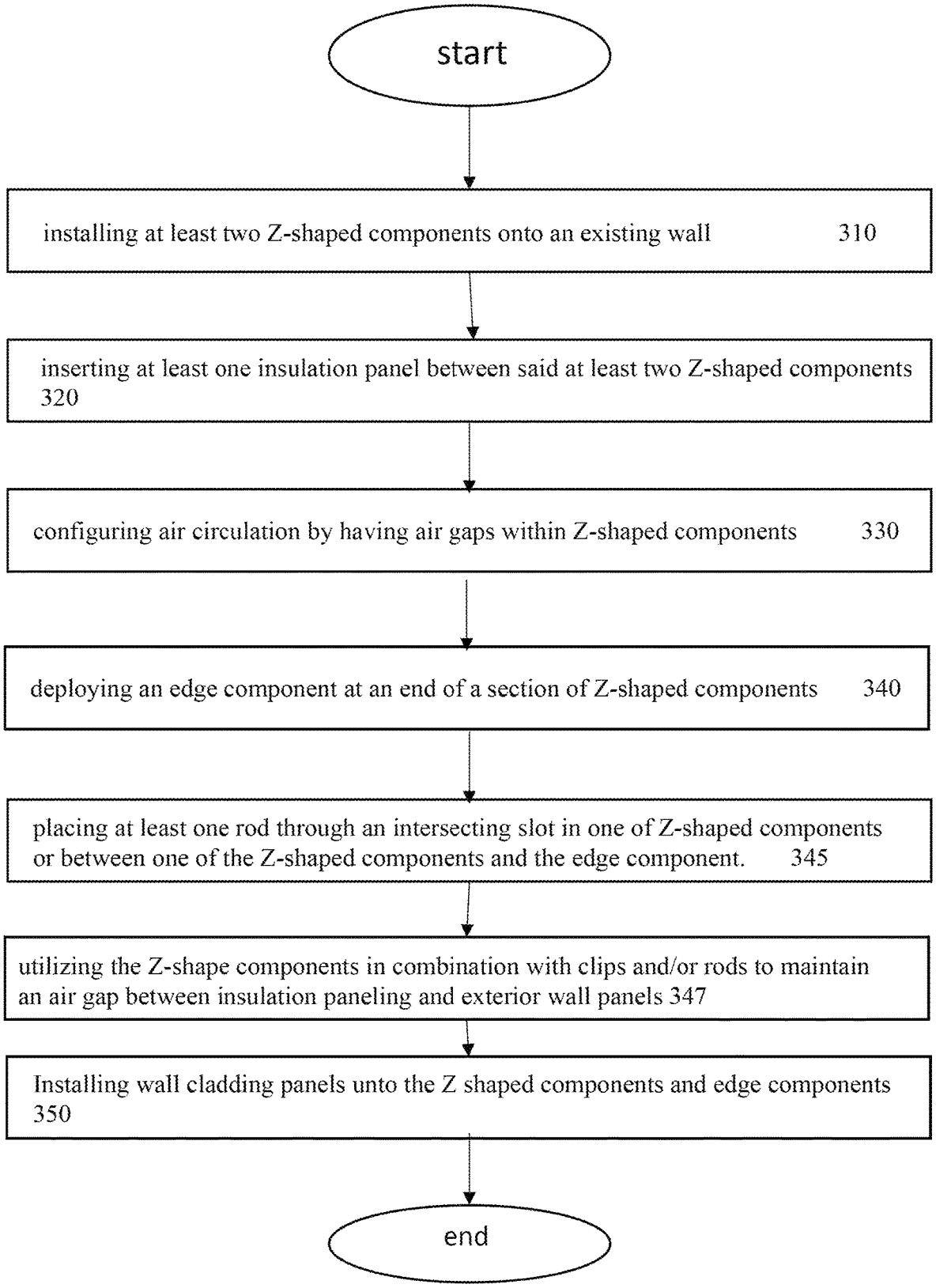

FIGS. 24 and 25 demonstrates the method of installing wall cladding over an existing wall. The method is preferably utilized along an exterior façade of a building but may be utilized for the interior as well. Shown in FIGS. 24 and 25 are steps of mounting insulation panels unto an existing wall comprising the step of installing at least two Z-shaped components onto an existing wall 310. Followed by the step of inserting at least one insulation panel between the Z-shaped components 320. Steps 310 and 320, result locking the mounted insulation panel into place between a second walls of adjacent Z-shaped components, whether two components or a series of Z-shaped components. Steps 310 and 320 work in concert with the step 330 of configuring air circulation by having air gaps within Z-shaped components, and the step 350 of installing wall panels onto the Z-shaped components.

The disclosed method further augmented with the step 340 of placing at least one rod through an intersecting slot in one of Z-shaped components, where the rod spans the distance between the two adjacent Z-shaped components or a series of adjacently placed Z-shaped components, and further comprised of the step of utilizing the Z-shape components in combination with clips and/or rods to maintain an air gap between insulation paneling and exterior wall panels 347.

Figure 26:
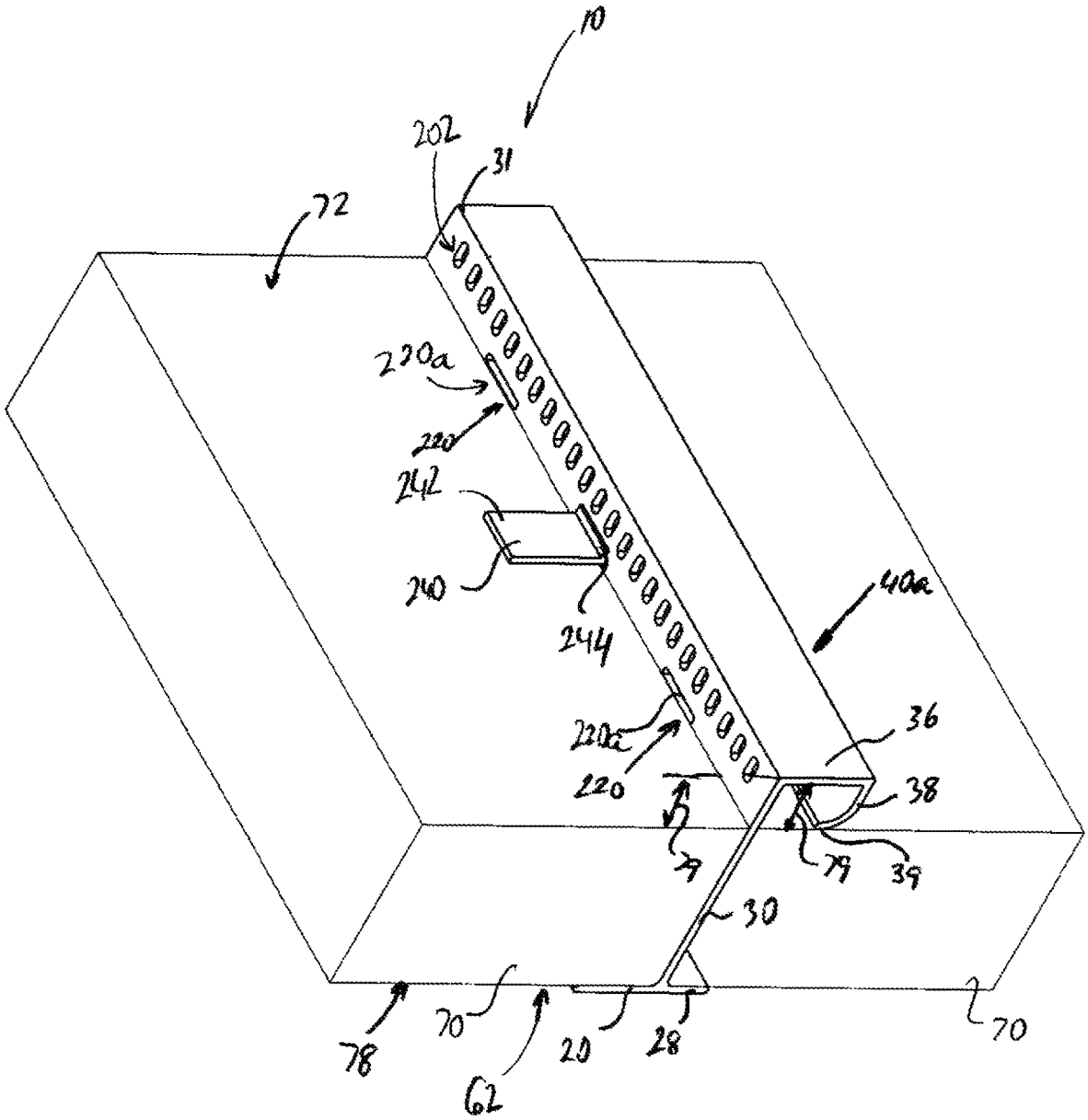
FIG. 26 is a contextual perspective of an alternative embodiment of the present invention.

FIG. 26 discloses an additional alternative embodiment demonstrating an alternative to the rod 180. Shown is a holding peg 240 that is configured to keep a section of an insulation panel 70. At least one holding peg is inserted into retaining slots 220. Retaining slots 220*a* are all on the same level and are preferably just above the top surface 72 of the insulation panel 70, such that when a plurality of holding pegs are placed within the plurality of retaining slots 220, in a one to one relationship, the holding peg 240 will adjacent to the top surface 72 and retaining the section of the insulation panel 70 securely in place. Just above the coaxial retaining slots 220*a* is a plurality of second air openings 202 which are located substantially near the free end 31 of the second wall 30. The plurality of second air openings 202 are shown disposed across the entire width in a single row. Alternatively, or as required, the second air openings 202 may be disposed sporadically cross some portions of the second wall 30 or in multiple rows.

Also shown in FIG. 26 is a rearwardly extending wall 40*a*, which in FIG. 26 is shown substantially assuming a "J" shape, comprising the first portion 36 and the second portion 38, with the free end 39 enforcing the first air gap 79. The second moisture gap 62 is an air gap that is enforced by the first wall 20 and lower lip 28 which support ends of sections of insulating panels 70.

Figure 27:
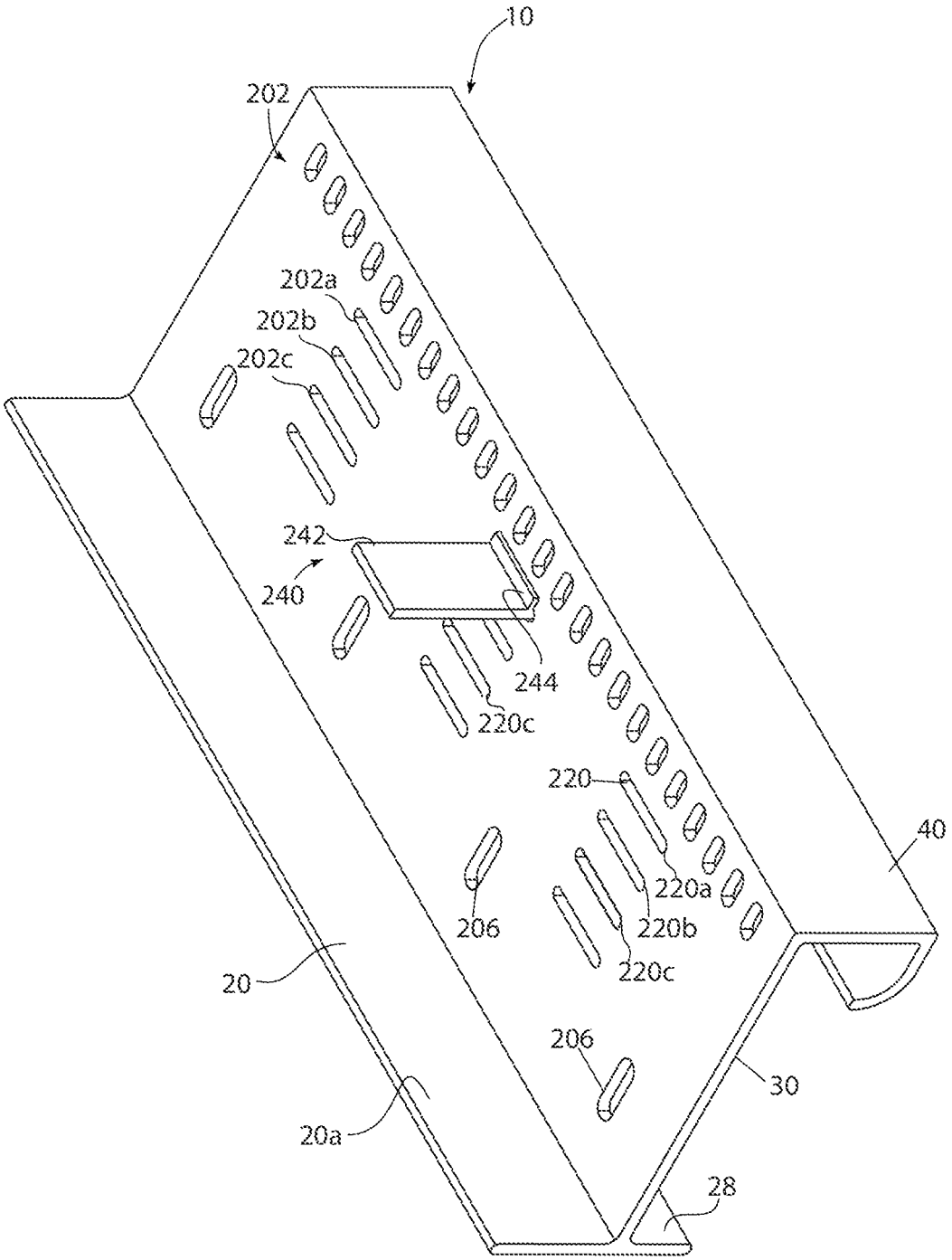
FIG. 27 is a perspective view of the Z-shaped member showing air openings and retention openings containing a holding peg.
Figure 28:
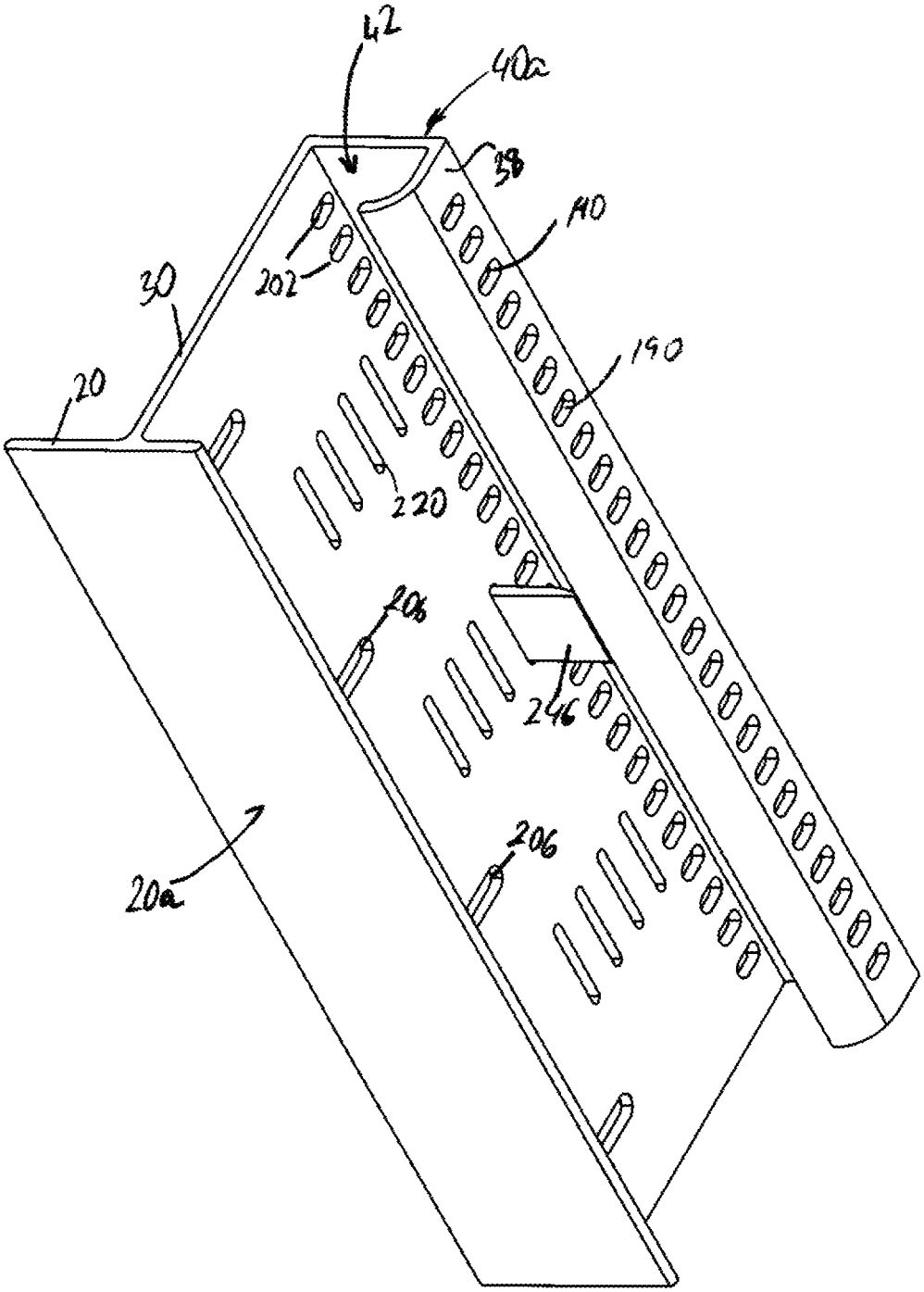
FIG. 28 shows the opposing side of the Z-shaped member shown in FIG. 27.

FIGS. 27 and 28 demonstrate the embodiment of the Z-shaped component 10 shown in FIG. 26. Shown disposed substantially across the width of the second wall is a plurality of second air openings 202. At least an additional plurality of air openings may be disposed at another area of the second wall 30. In FIG. 27, the additional plurality of air openings is the plurality of the third air openings 206 which are disposed in proximity to the first wall 20, or on the other side, in proximity to the lower lip 28. The plurality of third openings 206 is shown to be comprised of openings that are substantially larger then and more sparsely positioned than the plurality of second air openings 202. Alternatively, the second and third pluralities of air openings may be of equal or variably size, shape, and concentration.

Clearly demonstrated along fits. 27 and 28 are a plurality of retaining slots 220, which are grouped into stratified groups of coaxial retaining slots 220*a*, 220*b*, 220*c* and further levels, as necessary. Each strata of retailing slots 220 retains below it an insulating panel 70 of a particular thickness.

As shown in FIG. 28, the second or third plurality of air openings 202 or 206, respectively of the second wall 20 work in concert with air openings 190 disposed as plurality across the second portion 38 of the rearwardly extending wall 40*a*.

FIGS. 27 and 28 demonstrates the operational function of the holding peg 240. The first portion 246 is inserted into and through one of the retaining slots 220, until it juts out substantially on the other side of the second wall 30. The second portion 242 remains jutting out on the first side of the second wall 30 and is prevented from being inserted further by the lip 244. It is preferable that the first portion 246 fits snugly within an opening 220 and is not easily dislodged therefrom. Appreciably, when no holding peg 240 encumbers an opening 220, the free opening(s) 220 serve as another set of moisture wicking and ventilating openings.

The Z-shaped components shown in FIGS. 27 and 28 are intended to be used together with similarly airflow enabled components positioned adjacently, parallelly and in a spaced apart configuration from each other in a group featuring a plurality of parallel Z-shaped components. However, it is possible that ventilated Z-shaped components 10 may be used with non-ventilated Z-shaped components, or components ventilated in a differing configuration. Further, it should be appreciated that the second portion 242 retains an end of one insulating panel 70, while the first portion 246 retains an end of another insulating panel 70.

Figure 29:
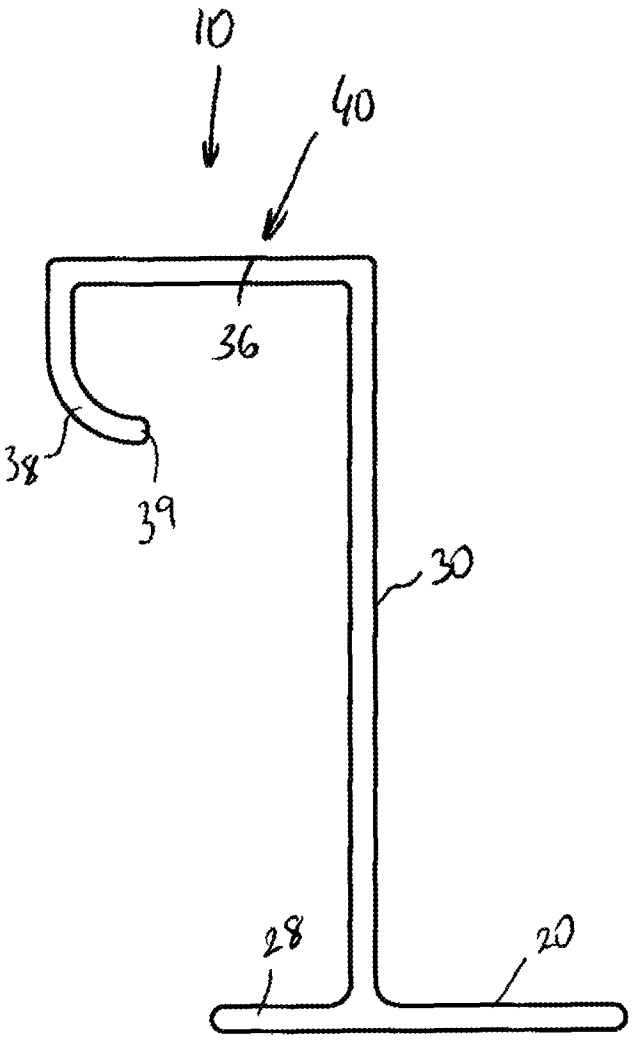
FIG. 29 is a cross-sectional figure of the Z-shaped member.

Shown in FIG. 29 is a cross sectional view of the Z-shaped component 10 showing the first wall 20, the lower lip 28, the second wall 30 and the rearwardly extending wall 40, comprised of the first portion 36 and the second portion 38 and having the free end 39.

Figure 30:
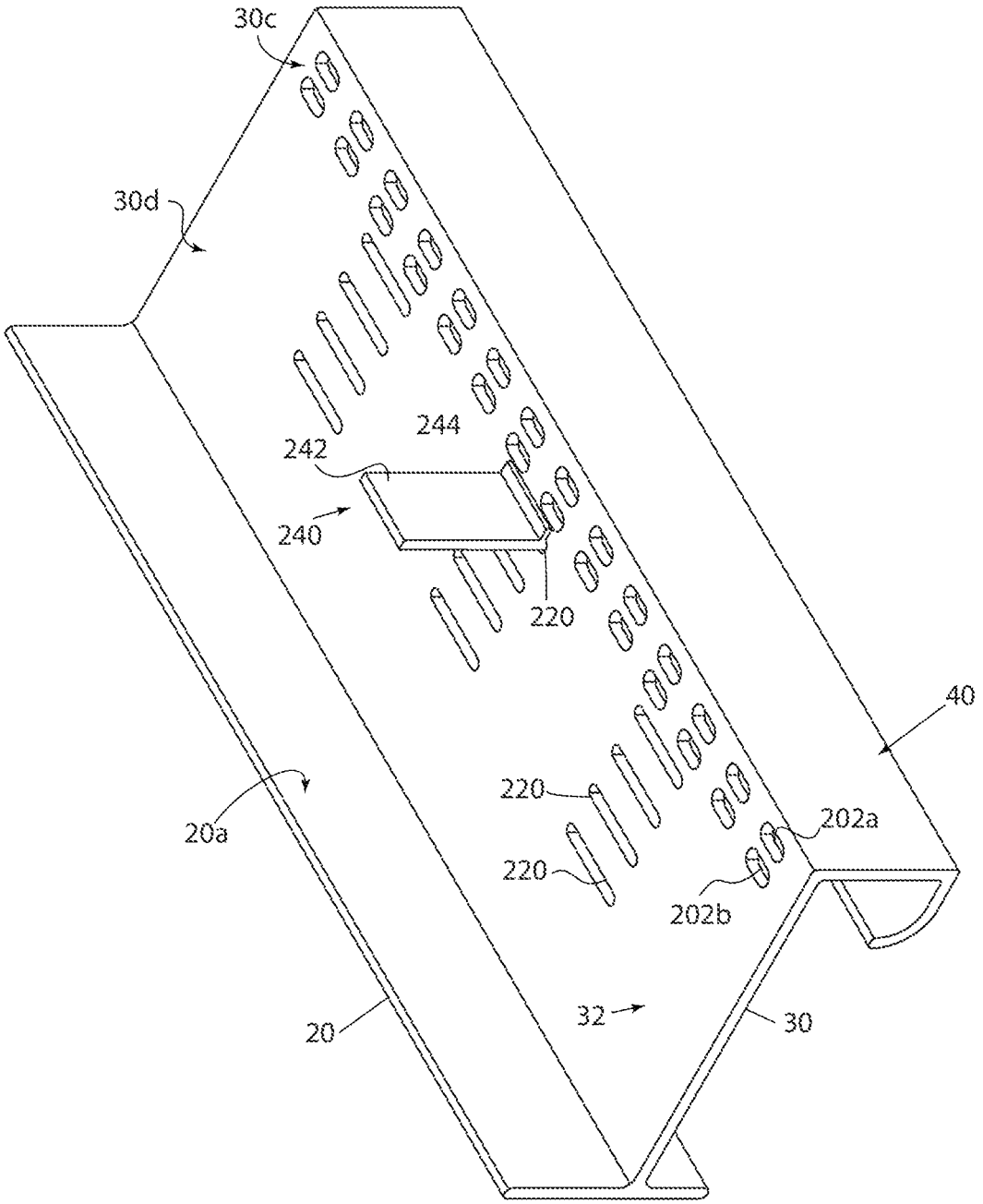
FIG. 30 is a perspective of another alternative embodiment of the present invention.

FIG. 30 demonstrates yet another variation of the Z-shaped component 10 featuring a plurality of air openings. FIG. 30 demonstrates the use of multiple adjacent rows or groupings of first plurality of second openings 202 disposed in the area 30*c*. At the same time, the area 30*d* is shown not having any air openings, with heavier concentration of air openings in another area, namely, the area 30*c*, intended to compensate for lack of air openings in another area.

Figure 31:
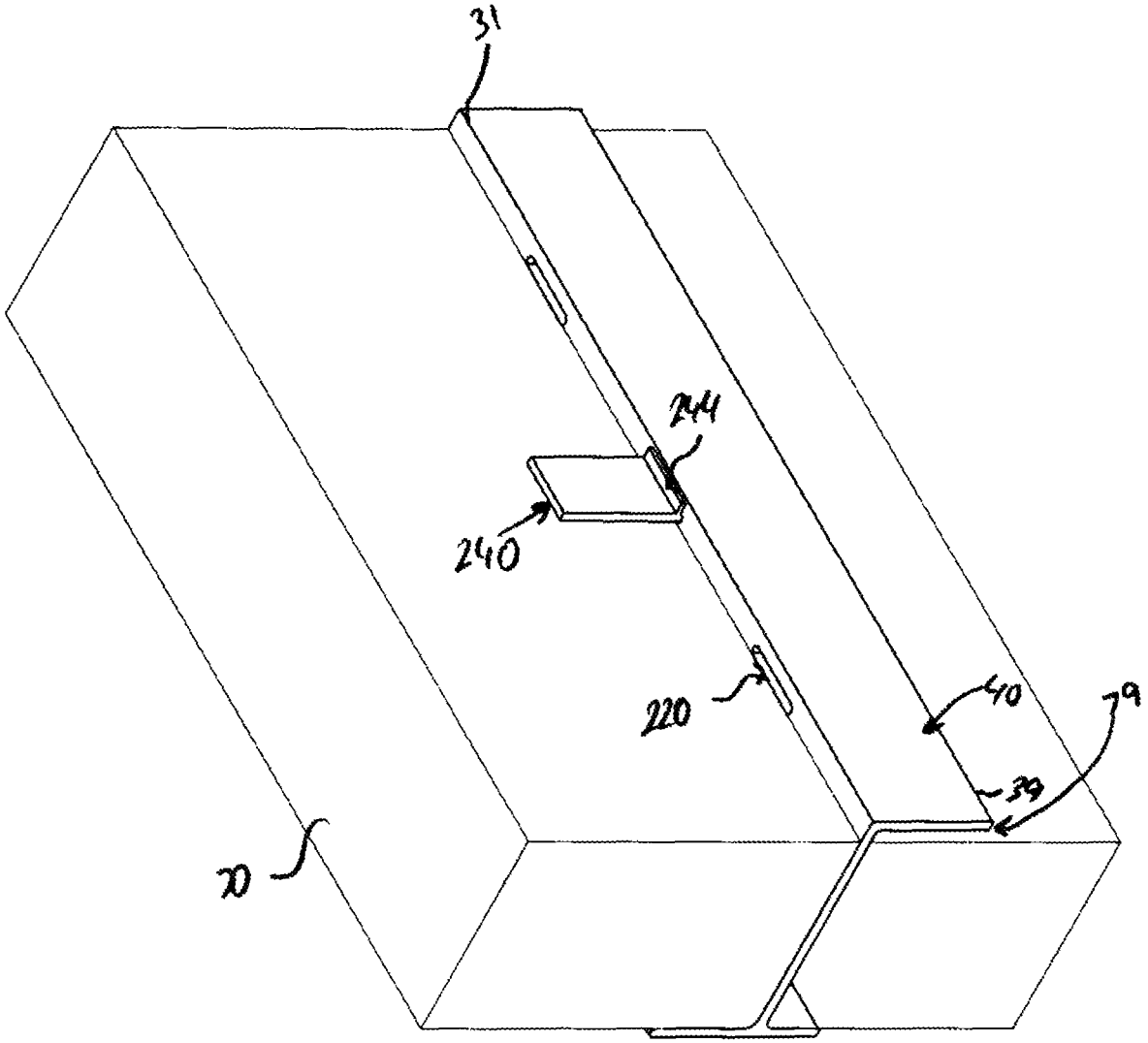
FIG. 31 is a perspective view of the holding peg in context of preferred usage.

FIG. 31 contextually demonstrates yet another embodiment of the present invention. Shown is the holding peg 240 that is placed within openings 220 that are located adjacently to, but just below the rearwardly extending wall 40*a*. The rearwardly extending wall 40*a* shown in this embodiment features no second portion 38 as in other figures, with the first air gap 79 being provided by the thickness of the holding peg 240. While openings 220 are shown to be adjacent to the rearwardly extending wall 40, the embodiment shown may utilize thinner insulation panels 70, with retaining openings 220 positioned accordingly just above such panels 70.

Figure 32:
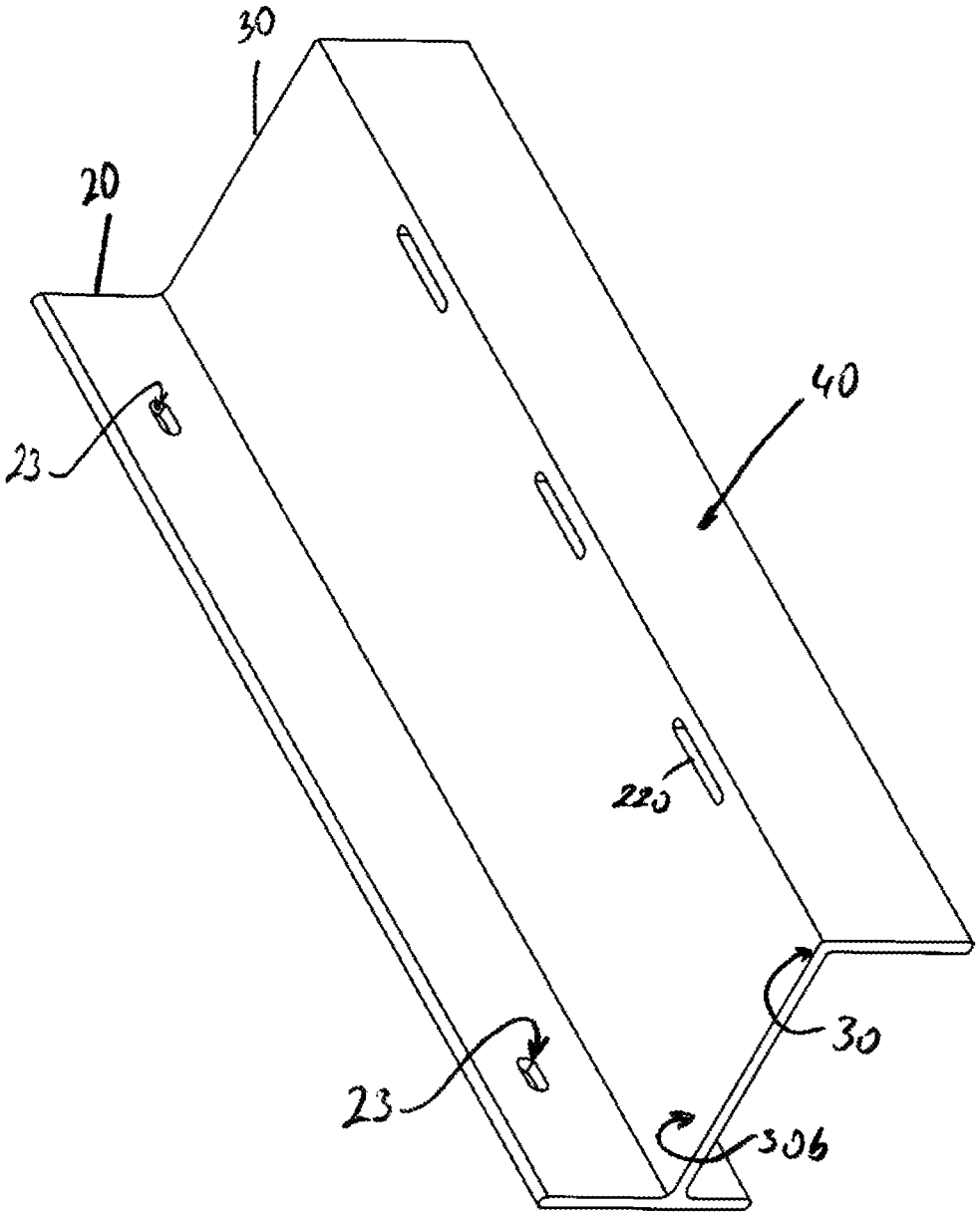
FIG. 32 is a contextual perspective of another alternative embodiment of the present invention.

FIG. 32 demonstrates that the embodiment shown in FIG. 31 has no other ventilating gaps than the retaining gaps 220. Alternatively, additional gaps may be disposed on the surface of the second wall 30. Shown on the first wall 20 are openings 23, that may be used for fastening means for attaching the Z-shaped component to a wall, or for additional ventilation capability.

Figure 33:
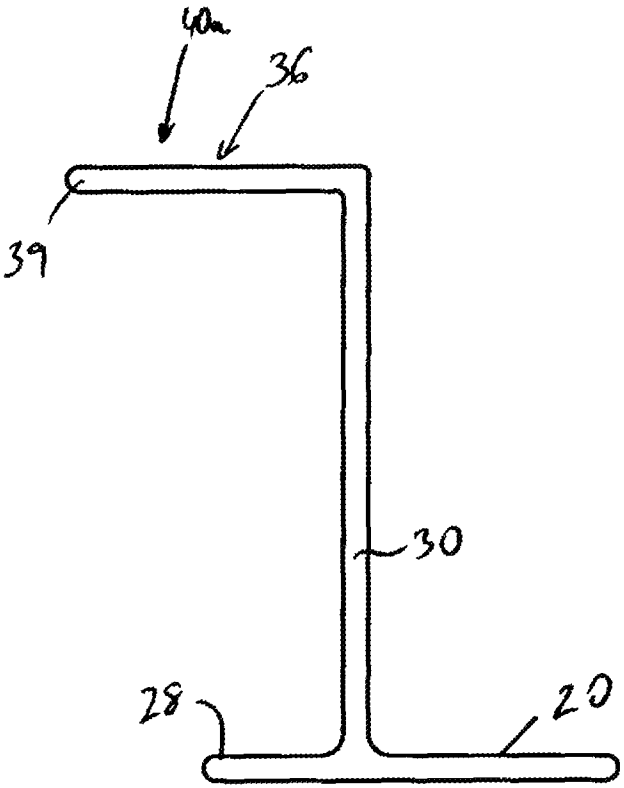
FIG. 33 is a cross sectional view of the Z-shaped member shown in FIG. 32.

FIG. 33 is a cross-sectional drawing of the embodiment of the Z-shaped component 10 shown in FIG. 32. Shown is the first wall 20, the lower lip 28 co-planar with the first wall 20. A second wall extending upwardly from the first wall 20 at an angle, preferably a right angle, to the first wall 20. A rearwardly extending wall 40*a*, connecting at an angle, preferably a right angle, at the free end 31. The rearwardly extending wall 40*a* comprised of the first section 39 and terminating in a free end 39.

Figure 34:
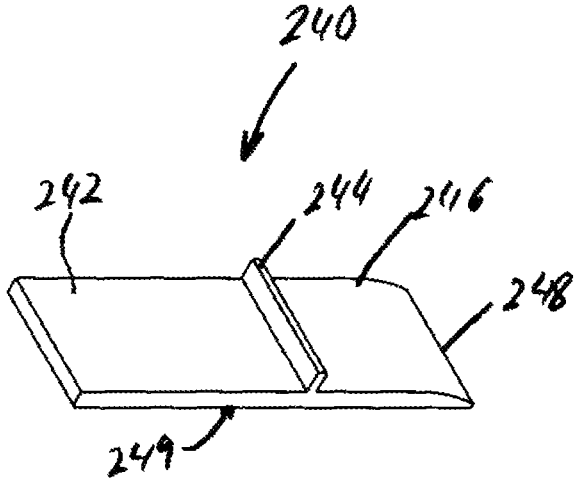
FIGS. 34 and 35 are views of the holding peg.
Figure 35:
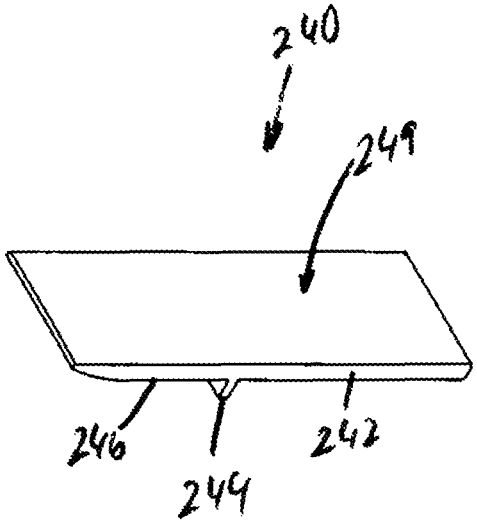

FIGS. 34 and 35 illustrate the features of the holding peg 240. Shown are the first portion 246, the second portion 242. The first and second portions co-extensive or unitary with each other and interrupted with a lip 244. A tapered portion 248 assists with the placement of the holding peg 240 within a retaining gap 220. The bottom surface 249 is shown to be uniform. Alternatively, the bottom surface 249 may instead have the lip 244 or contain a lip in addition to the lip 244. Appreciably, the retaining slots 220 are configured to retain distal ends of a rod 180 and intersecting slots 162 may accommodate the holding pegs 240.

Figure 36:
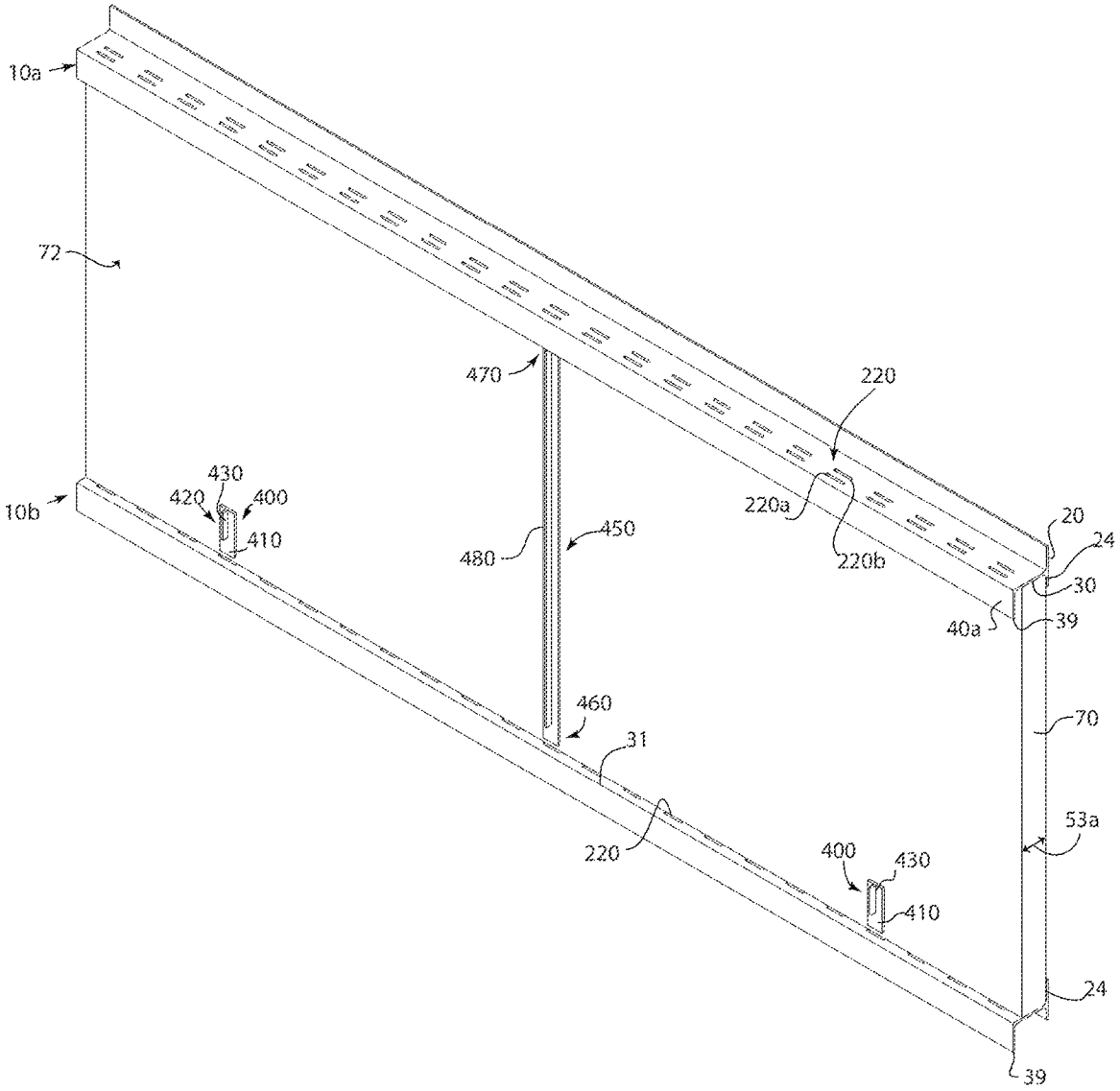
FIG. 36 diagrams the process of deploying clips or a rod into retaining slots that are between Z-shaped components, to secure insulation paneling.

The height 53 of the second wall 30 (FIG. 37) is made in accordance with the intended insulation paneling 70 and is preferably slightly longer than the thickness 53*a* of an insulation panel 70, to enforce the presence of the first air gap 79. The adjacent Z-shaped members 10*a* and 10*b* shown in FIG. 36 are in a parallel and spaced apart configuration with each other, capable of having one of a plurality of insulation panels installed in the space between the parallel Z-shaped members 10*a* and 10*b*. Additional of the plurality of the insulation panels 70 are mounted in spaces 30*a* and 30*b*, and span the distance to additional adjacent Z-shaped members (not shown) or edge components (see 110 in FIG. 10).

Figure 37:
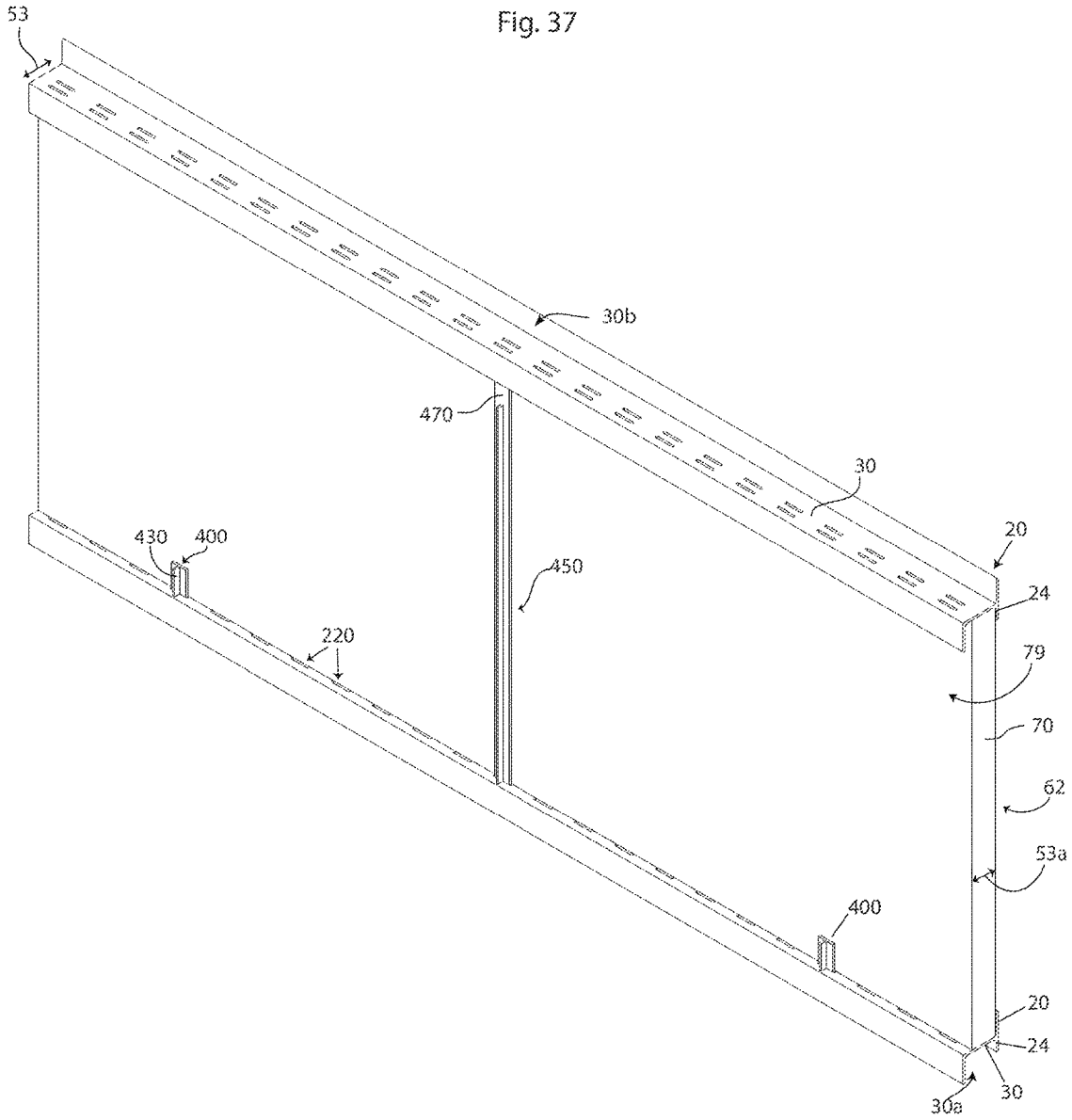
FIG. 37 is a diagram of deployed clips and rods, that secure insulation paneling.

Also shown in FIGS. 36 and 37 is a plurality of retaining slots 220. The retaining slots 220 are preferably coaxial and arranged in rows, such as a coaxial first row 220*a* and coaxial second row 220*b*. Each of the retaining slots 220 is configured to accept and hold, in a removable, but substantially snug association, the first portion 246 of a holding peg 240 (FIG. 35), or as disclosed in FIGS. 36 and 37, the first end 410 of the clip 400 or the first or second ends 460 or 470, respectively, of the rod 450. Each of the insulation panels 70 rests on the lower lip 24 of one adjacent Z-shaped member 10*a* and the first wall 20 of the opposing adjacent Z-member 10*b*, thus preserving the second air gap 62, and beneath the pegs 240, clips 400, rods 180 (FIG. 13) or rods 450 (alternative embodiment).

Figure 38:
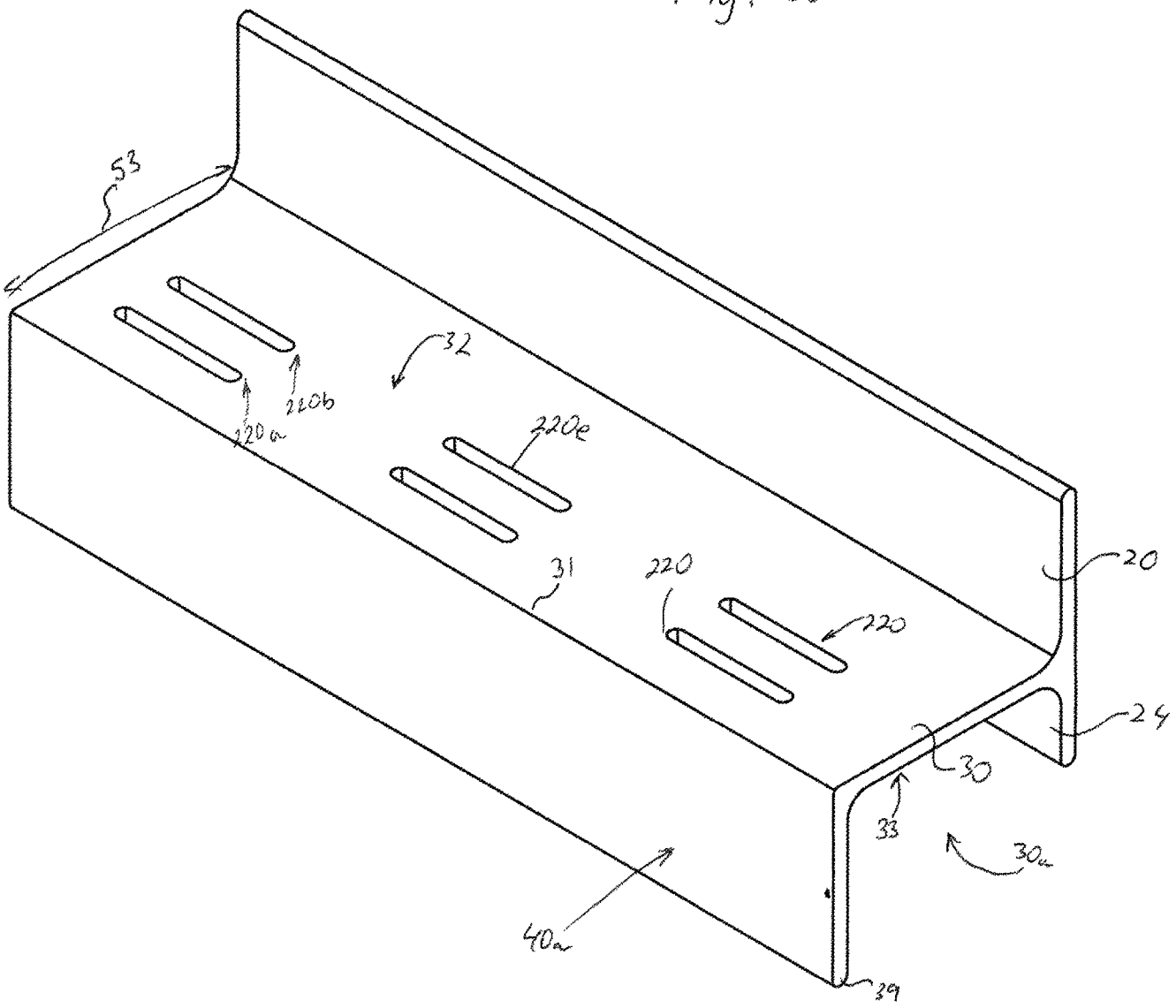
FIGS. 38-40 demonstrate various embodiments of the Z-shaped component having retaining slots, with the retaining slots having different shapes.

FIG. 38 is a detailed diagram of the Z-component embodiment shown in FIG. 36. The Z-component 10 having a first wall 20 that is mounted against an existing wall 60, which may be a waterproof membrane or exterior sheeting. A second wall 30 extending outwardly at an angle from the second end, preferably a right angle, said second wall having first side 32 and a second side 33. A lower lip 24 extending from the second end of the first wall 20 and is coplanar with the first wall 20. A rearwardly extending wall 40*a* extending from the free end 31. The rearwardly extending wall 40*a* extending in a co-axial but opposite direction from the first wall 20. The rearwardly extending wall 40*a* may be parallel to the first wall 20 or at an acute or at obtuse angle thereto. The end of the rearwardly extending wall 40*a* forming a free end 39. The height 53 of the second wall 30 may vary depending on the desired thickness of insulation 70. The plurality of retaining slots 220 may be placed anywhere in the area of the second wall 30, but preferably placed in rows of retaining slots such as first row 220*a* and second row 220*b* and so forth.

Figure 39:
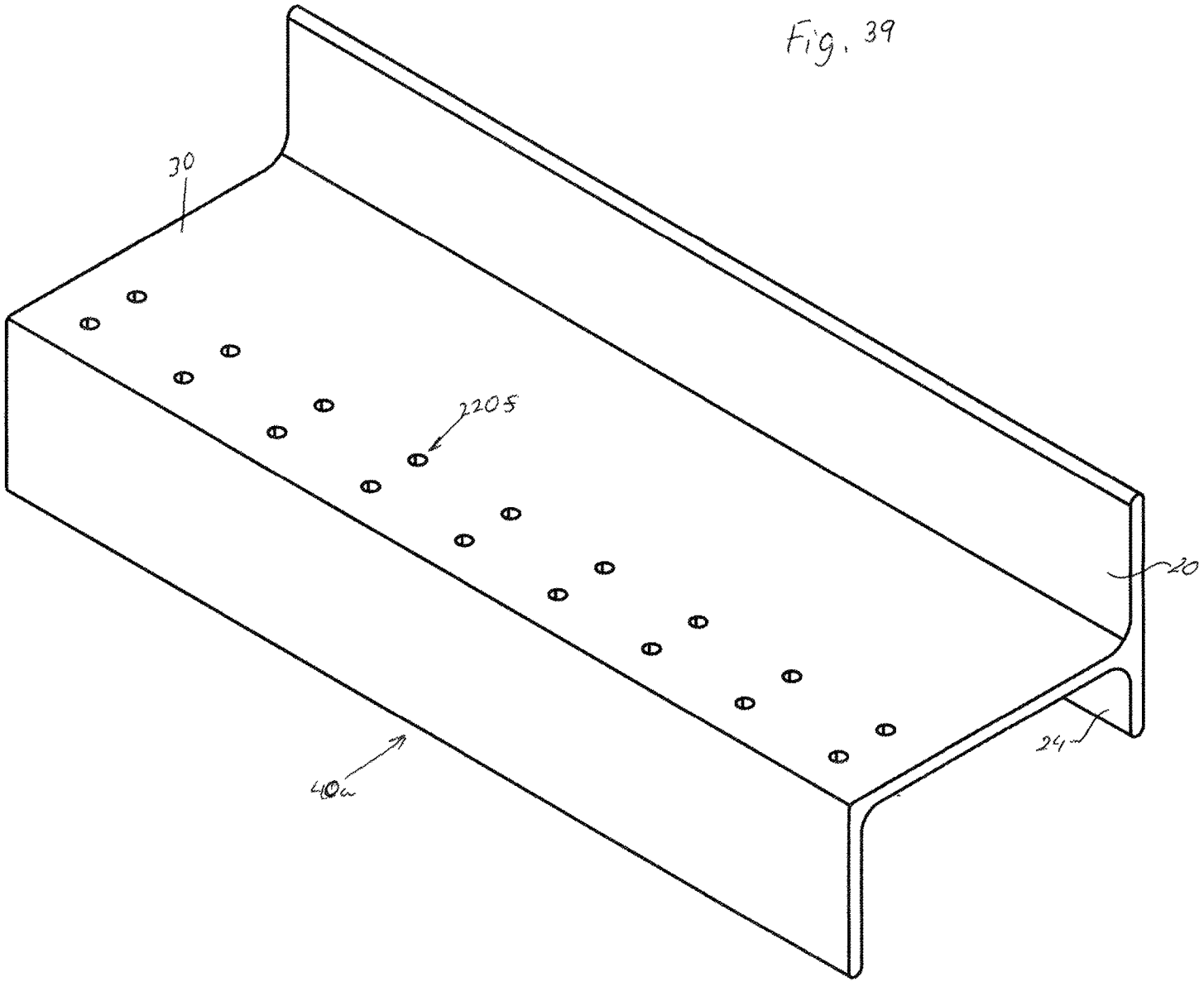
Figure 40:
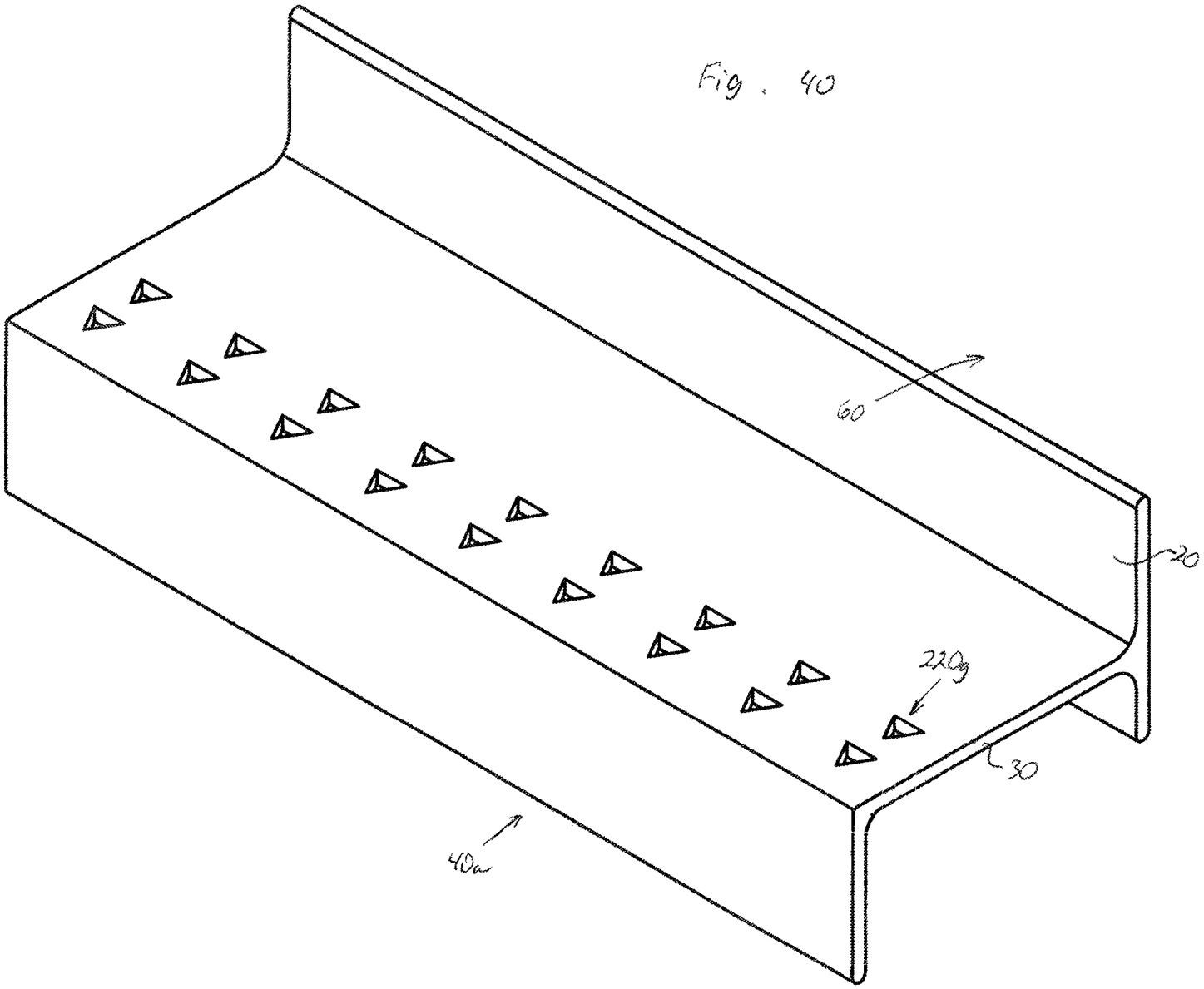

The retaining slots 220 may be in any shape. For example, elongated and elliptical 220*e* (FIG. 38), these may also be rectangular or parallelogrammical. Retaining slots 220 may be circular 220*f* (FIG. 39) or triangular 220*g* (FIG. 40), or any combination of shapes. It should be noted that any retaining slot 220 that is unobstructed by an insulation panel 70 or not holding a peg 240, clip 400 or rod 180 or 450, functions as an opening for air and moisture circulation, which promotes drying in the event of moisture penetration and thus resists buildup of mold and mildew.

Figure 41:
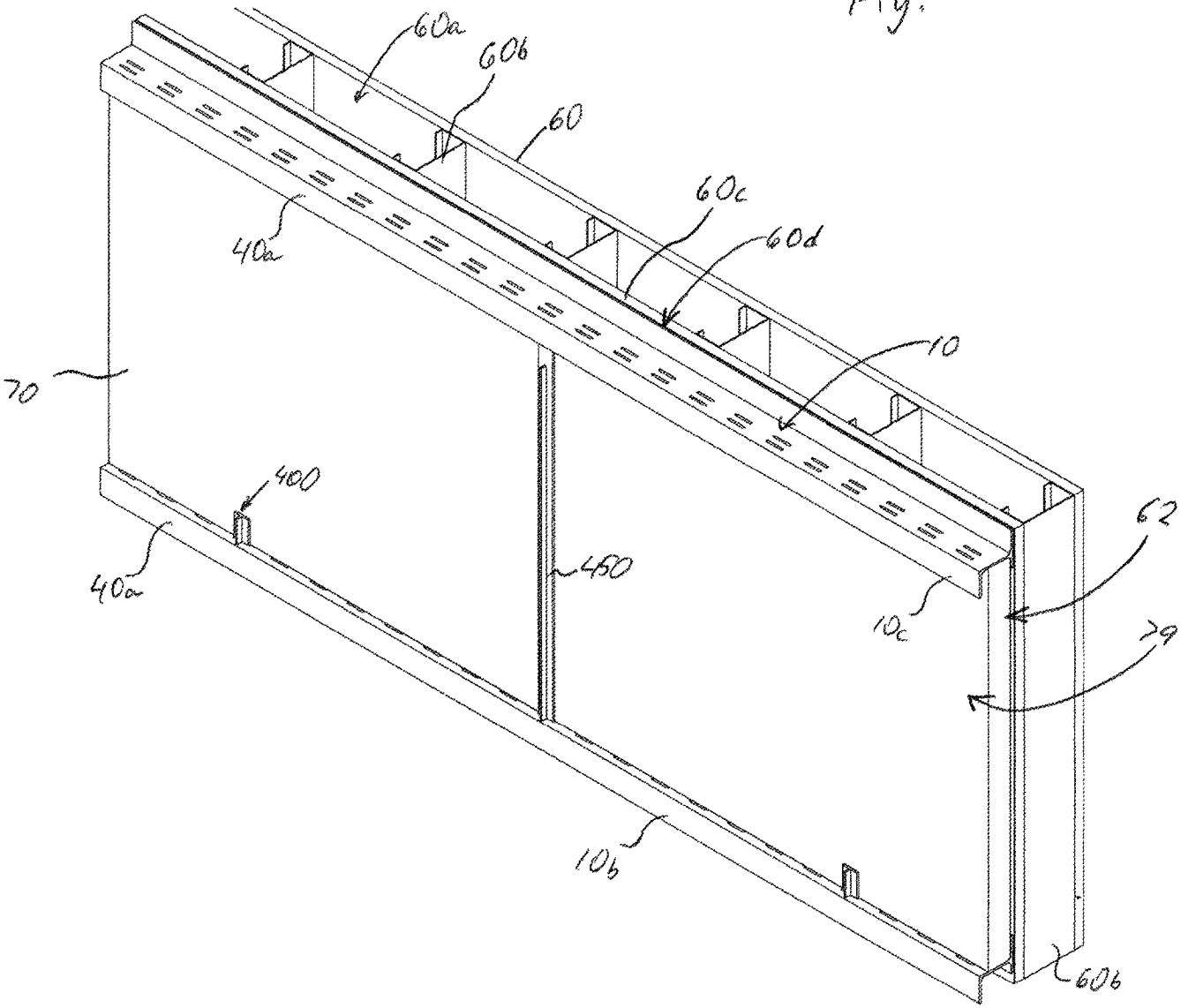
FIG. 41 is detailed contextual representation of usage of Z-shaped components as a method of securing insulation and as mount points for the attachment of wall paneling.

FIG. 41 demonstrates a contextual assembly that utilizes the Z-shaped components 10 to house exterior insulation, promote air gaps and as mount points for exterior wall paneling. Shown is the existing wall 60, which may be concrete, brick or composite wood or synthetic wall sheeting. A plurality of parallel and spaced apart studs 60*b* are mounted onto the wall sheeting 60. An additional layer of paneling 60*c* is then attached to the studs 60*b*, after the spaces 60*a* are filled with soft or sprayed insulation. A waterproof membrane 60*d* is spread on the exterior of the additional paneling 60*c*. The Z-shaped components 10 are then fastened onto the waterproof paneling 40. The Z-shaped components 10 are preferably molded of thermally exclusionary and insulating materials and thereby complement the waterproofing of the membrane 60*d*. Furthermore, the completely flush and snug coupling between the membrane surface 60*d* and the first wall 20 of the Z-shaped components 10 forms a watertight seal that compensates for the perforation of the membrane surface 60*d* during installation of the Z-shaped components 10. The plurality of clips 400 and/or plurality of rods 450 secure rigid, soft or semi-rigid insulation paneling 70 that is then installed between each of the adjacent Z-shaped components 10 (or in some cases, between the Z-shaped components 10 and adjacent edge components 110). The protruding wall 430 of the clips 400 or the protruding wall 480 of the rods 450 enforces the first air gap 79 between the top surface 72 of the panels 70 and the wall paneling 90 (FIG. 7), which are mounted onto the rearwardly extending walls 40*a*. It should be noted that the layout of components diagramed in FIG. 41 may represent the Z-shaped components 10 that are on the exterior of a wall, or alternatively, on the interior of a wall, with rearwardly extending wall 40 a mounting interior wall panels, such as plywood or composite panels or sheetrock.

Figure 42:
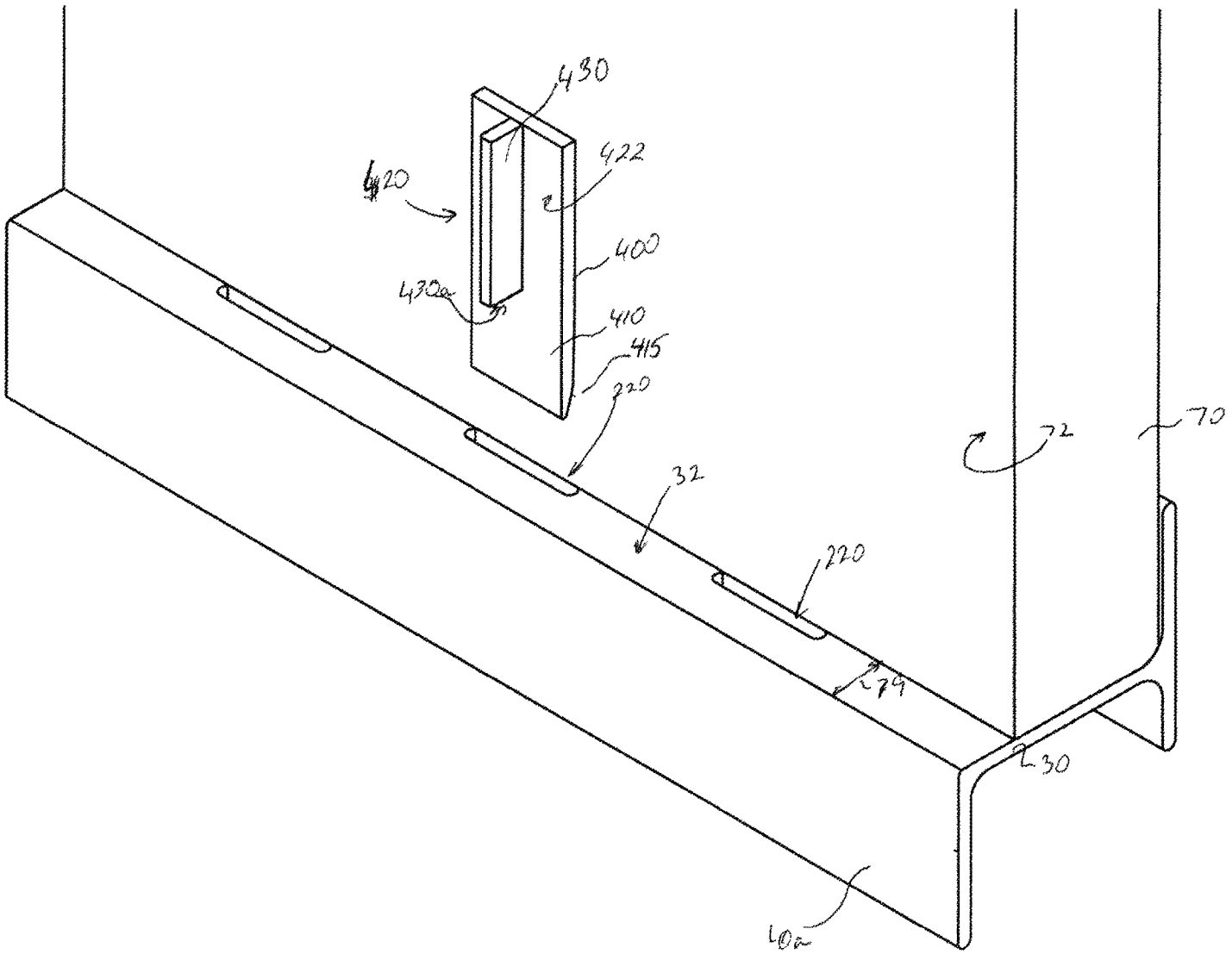
FIGS. 42 and 43 are contextual detailed diagram of the clip device.
Figure 43:
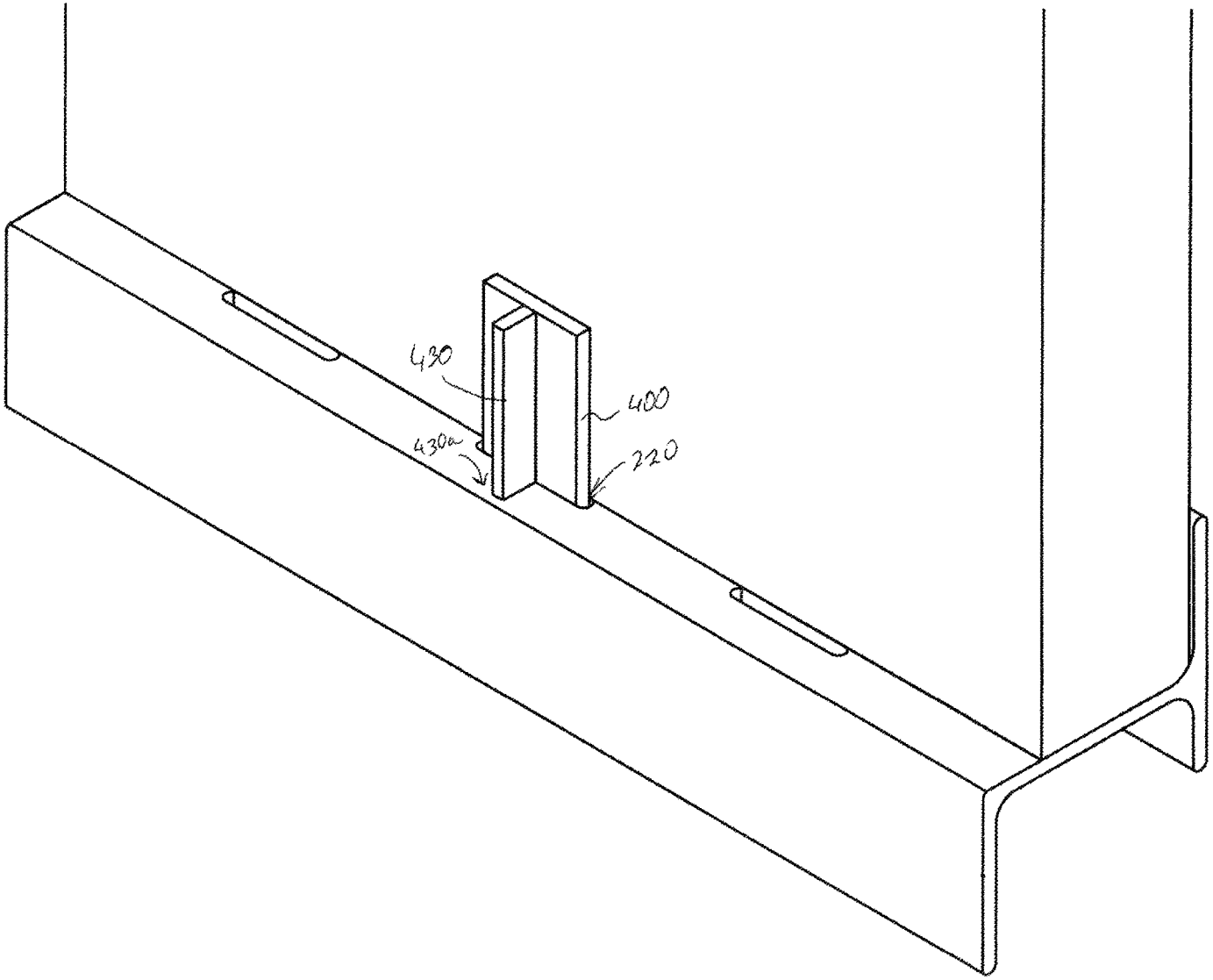

The clip 400 shown in FIG. 42 is comprised of the first portion 410 and a second portion 420. The second portion 420. The first portion 410 configured to be lodged into a retaining slot 220. The second portion is comprised of a protruding wall 430 extending from the first side 422 of the second portion 420. The extension of the protruding wall 430 is preferably equal to the minimum width of the first air gap 79. While one protruding wall 430 is shown disposed substantially lengthwise along the middle of the second portion 420, additional protruding walls 430 may be used, and may further be disposed closer to the edges of the second portion 420. The proximal end 430*a* abuts the first side 32 of the second wall 30 and prevents the clip 400 from sinking further then the optimal level of insertion, as shown in FIG. 43. The first portion 410 may contain a tapered section 415 and is configured to be in a substantially snug association with the retaining slots 220. Just like the peg 240 (FIG. 35), the clip 400 may be used to look rigid insulation panels 70 in to place.

Figure 44:
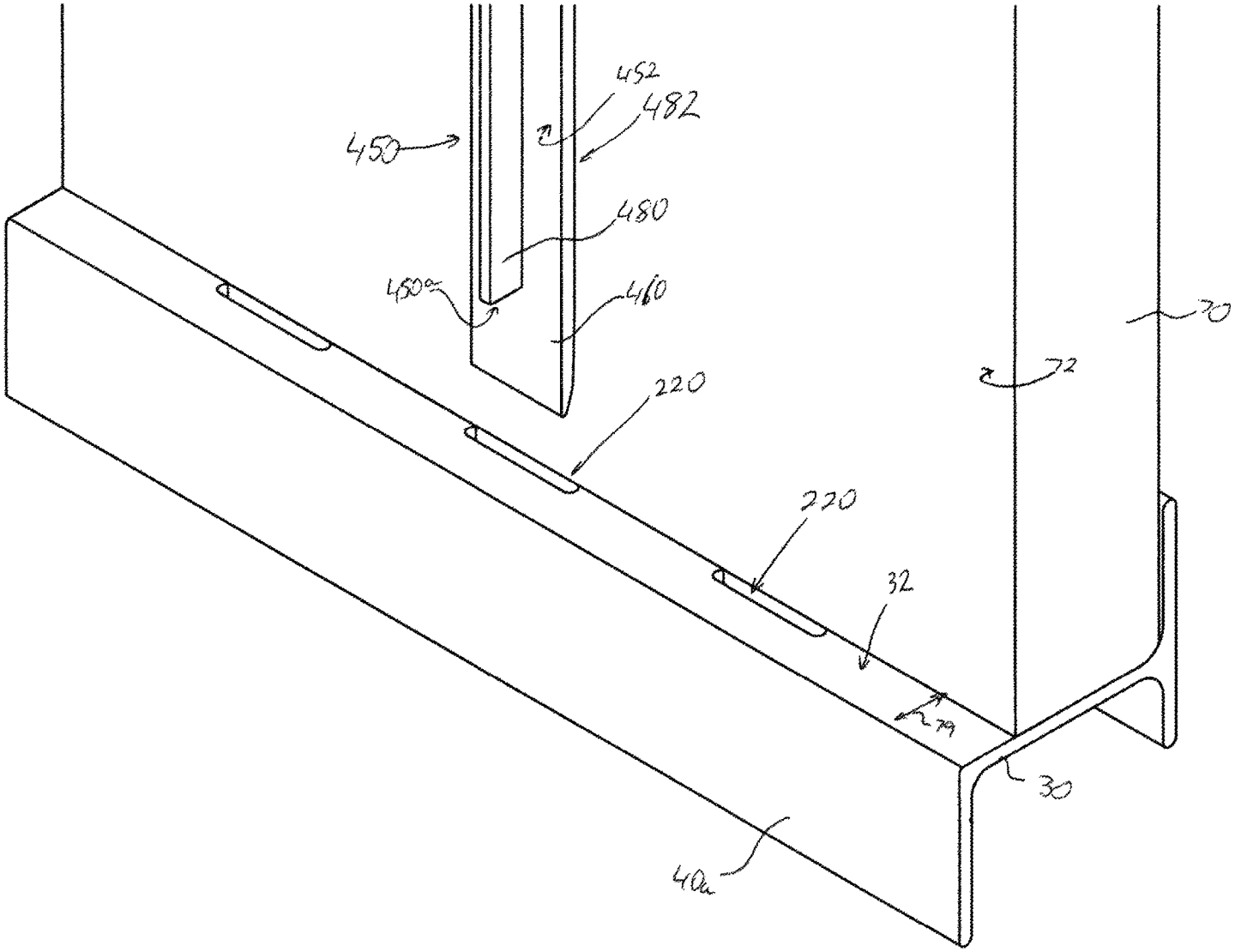
FIGS. 44 and 45 are contextual detailed diagram of a rod device.
Figure 45:
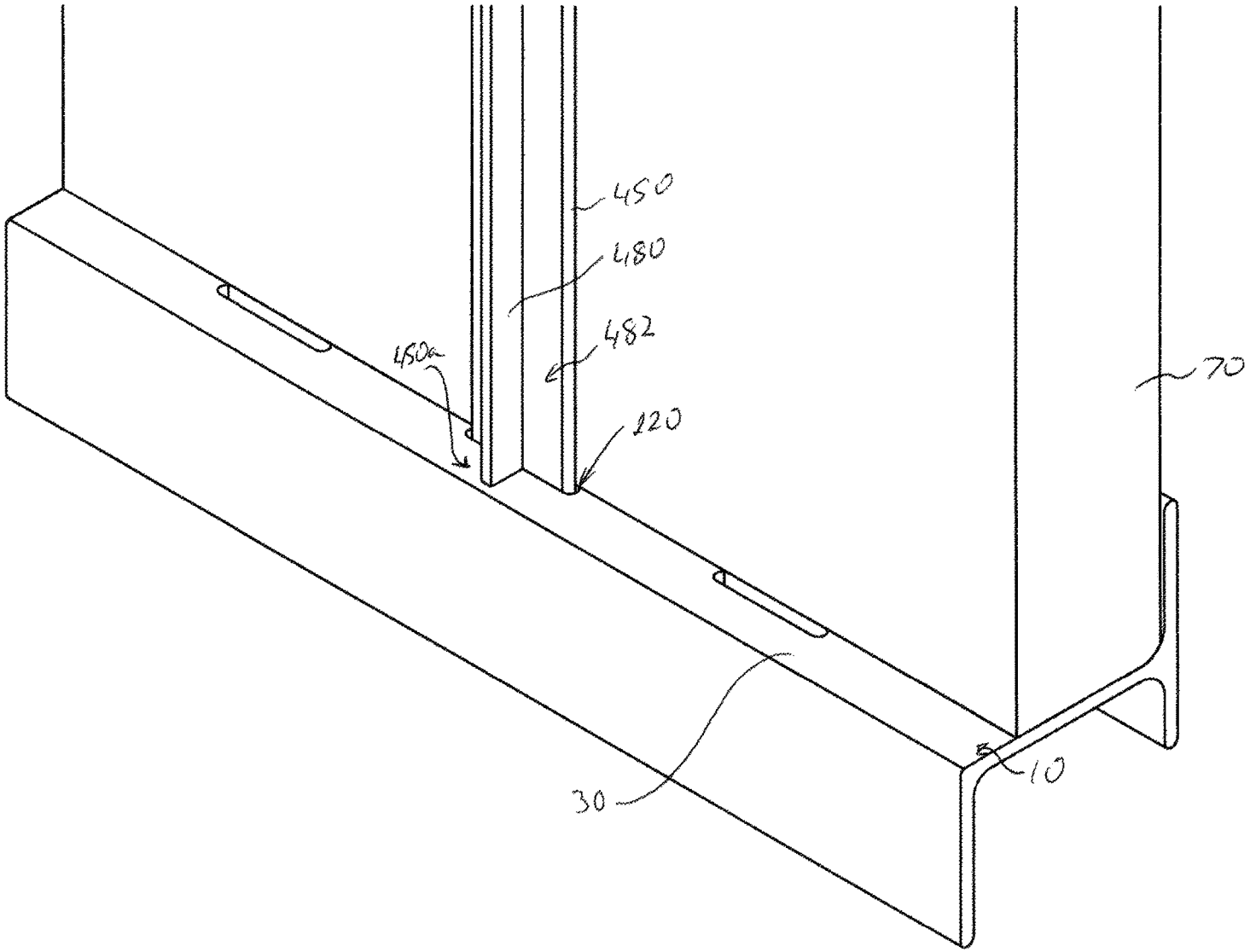
Figure 46:
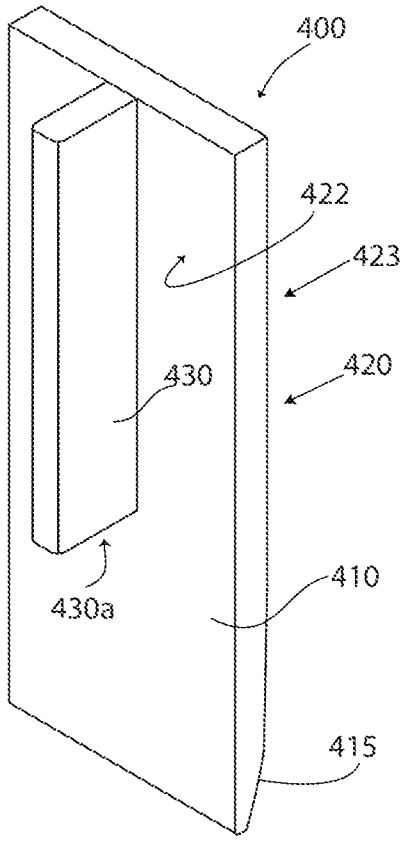
FIGS. 46 and 47 are detailed diagrams of the clip devices.
Figure 47:
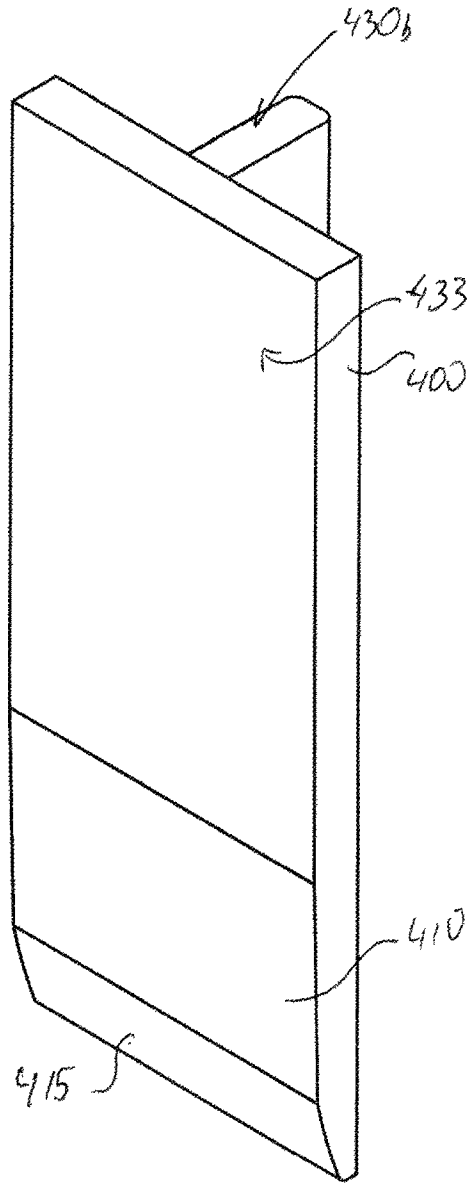

FIGS. 44 and 45 demonstrate a rod 450 having a second portion 482 that spans the distance between two parallel and adjacent Z-shaped members 10. Each rod is comprised of a second portion 482 and at least one first portion 460 configured on each of the distal ends of the rod 450. The protruding wall 480 extends from the first side 452 of the rod 450. The protruding wall preferably runs throughout the length of the second portion 482 or may instead run-in segments with gaps in between each segment. The protruding wall 480 is shown to be substantially extending from the middle of the first side 452 but may also be disposed closer to the edges as shown in FIG. 20. The proximal end 430*a* terminates the protruding wall 480 and marks the optimal insertion point of the first end 460. The proximal end 430*a* abuts the first side 32. The rod 450 is optimally suited to secure semi-rigid or flexible insulation paneling 70, and may be used in conjunction with or as a replacement for the clips 400 or the holding pegs 240. FIGS. 46 and 47 demonstrates the detailed features of the clip 400. The clip 400 is comprised of a first portion 410, the second portion 420, the first side 422 and the second side 433. At least one protruding wall 430 extends from the proximal end 430*a* until the distal end 430*b*. The first portion 410 may further comprise a tapered section 415, with the slope of the taper originating from the second side 433, which is the side that is adjacent to the top surface 72 of insulation paneling 70. The tapered section enables an installer to introduce the clip 400 at a slight angle away from the surface of insulation paneling 70, so as to permit a more comfortable and secure grip of the device, and then work the clip 400 into the retaining slot 220. Both the clip 400 and the rod 450 are preferably made from composite and/or thermally insulating materials.

Figure 48:
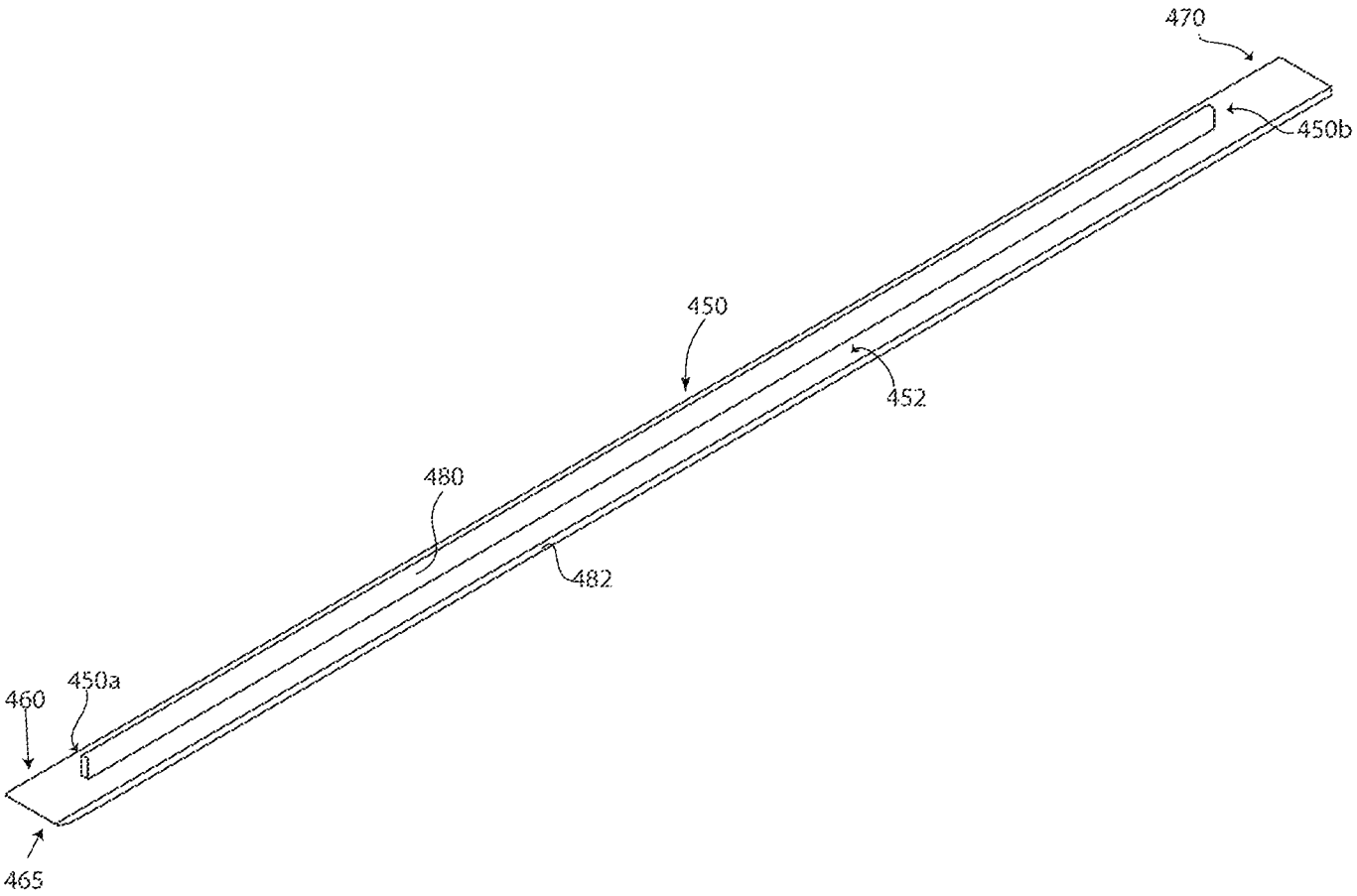
FIGS. 48 and 49 are detailed diagrams of the rod device.
Figure 49:
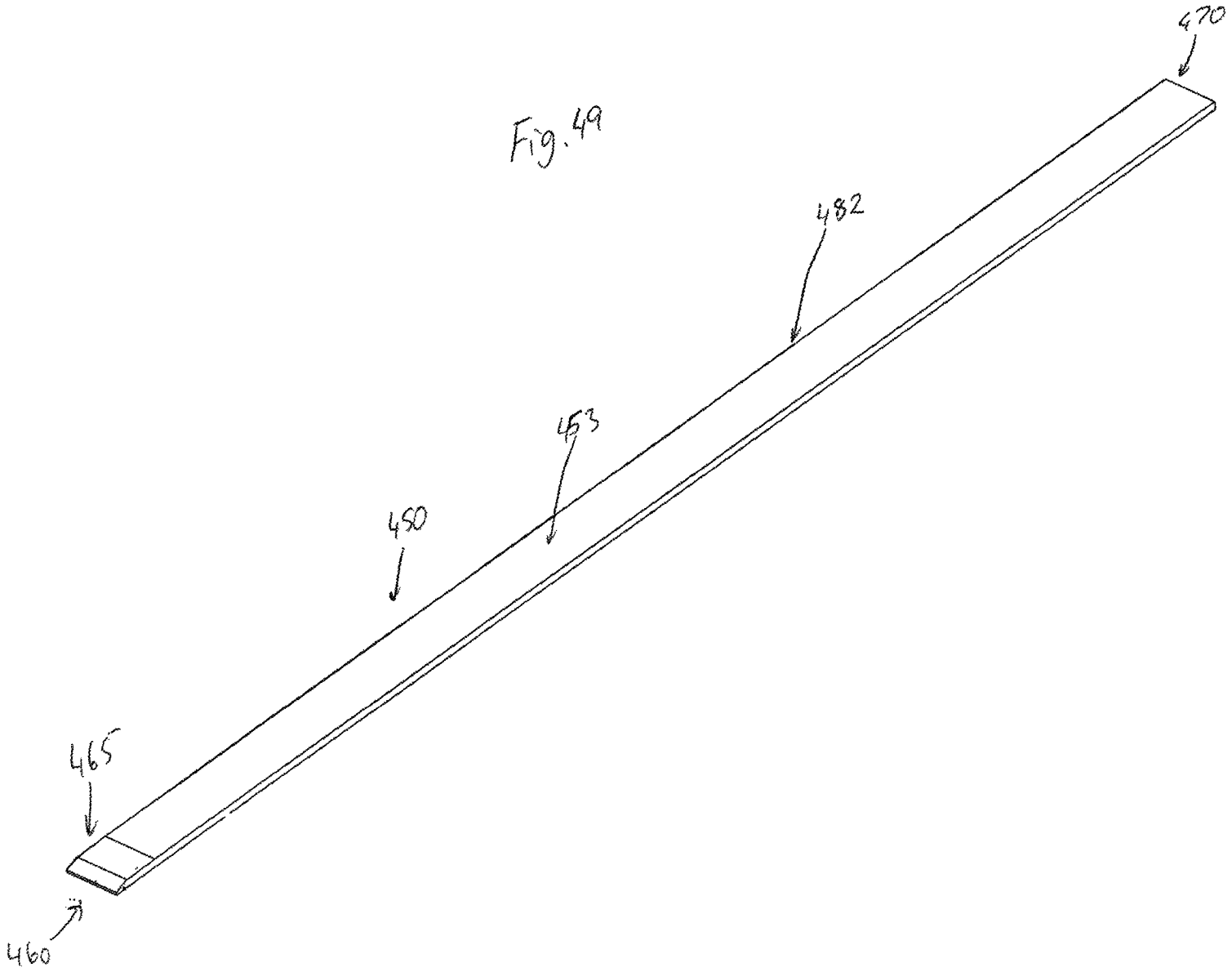

FIGS. 48 and 49 demonstrate the rod 450, which is an alternative embodiment to the rod 180 shown in FIG. 20. The rod 450 is comprised of an elongated section portion 482 and preferably two first portion 460 and 470 on each end of the elongated second portion 482. The first surface 452 along the second portion 482 further comprises at least one protruding wall 480 that is shown to be disposed along the length of the second portion 482. The protruding wall terminates at points 450*a* and 450*b*, which mark the optimal insertion points of the first portions 460 and 470. At least one of the first portions 460 may further comprise a tapered surface 465, where the slope of the taper begins on the second side 453 to enable an angled introduction of the rod 450 during installation into a retaining slot 200.

Figure 50:
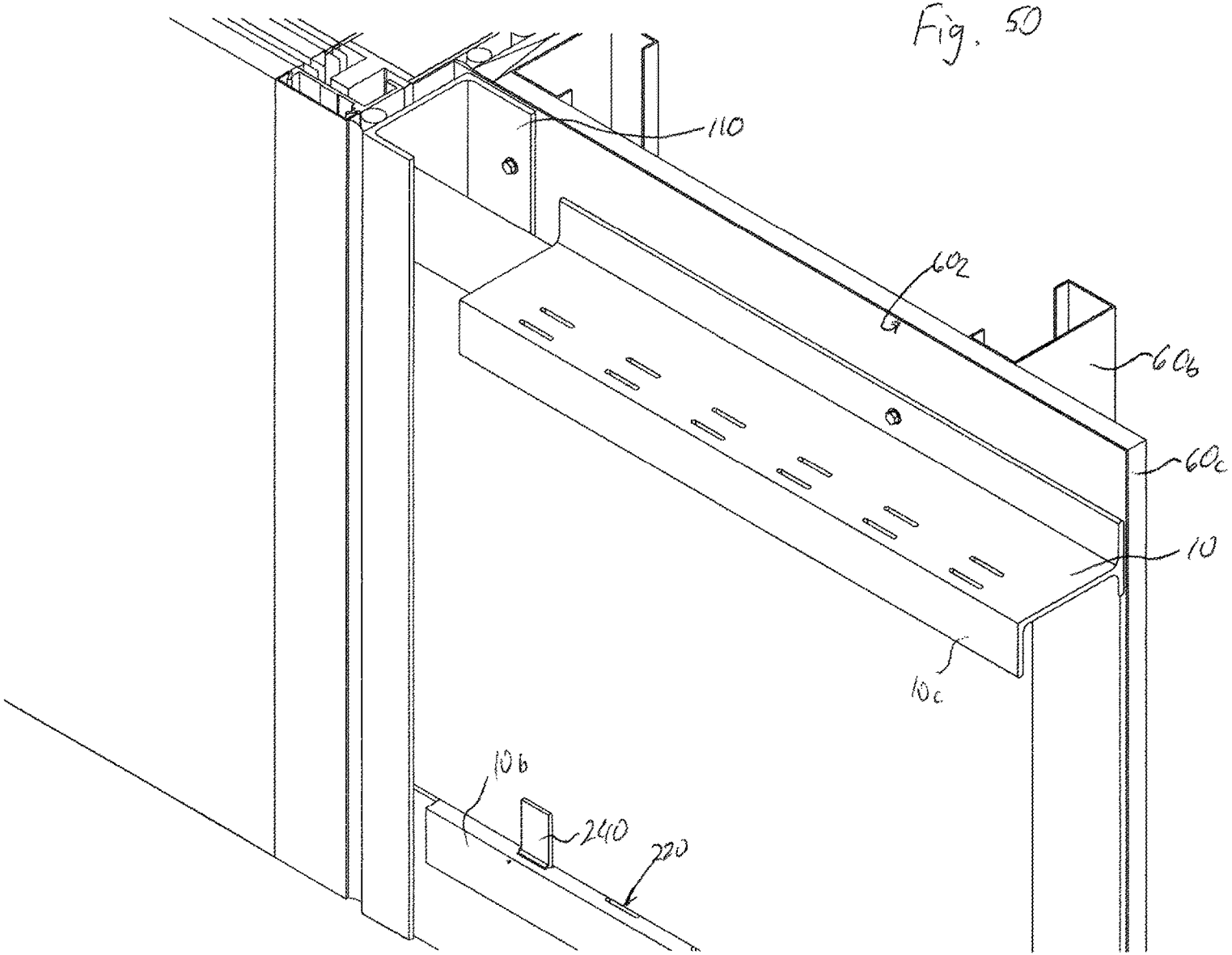
FIGS. 50 and 51 is an additional contextual representation of the Z-shaped components and structures used therewith.
Figure 51:
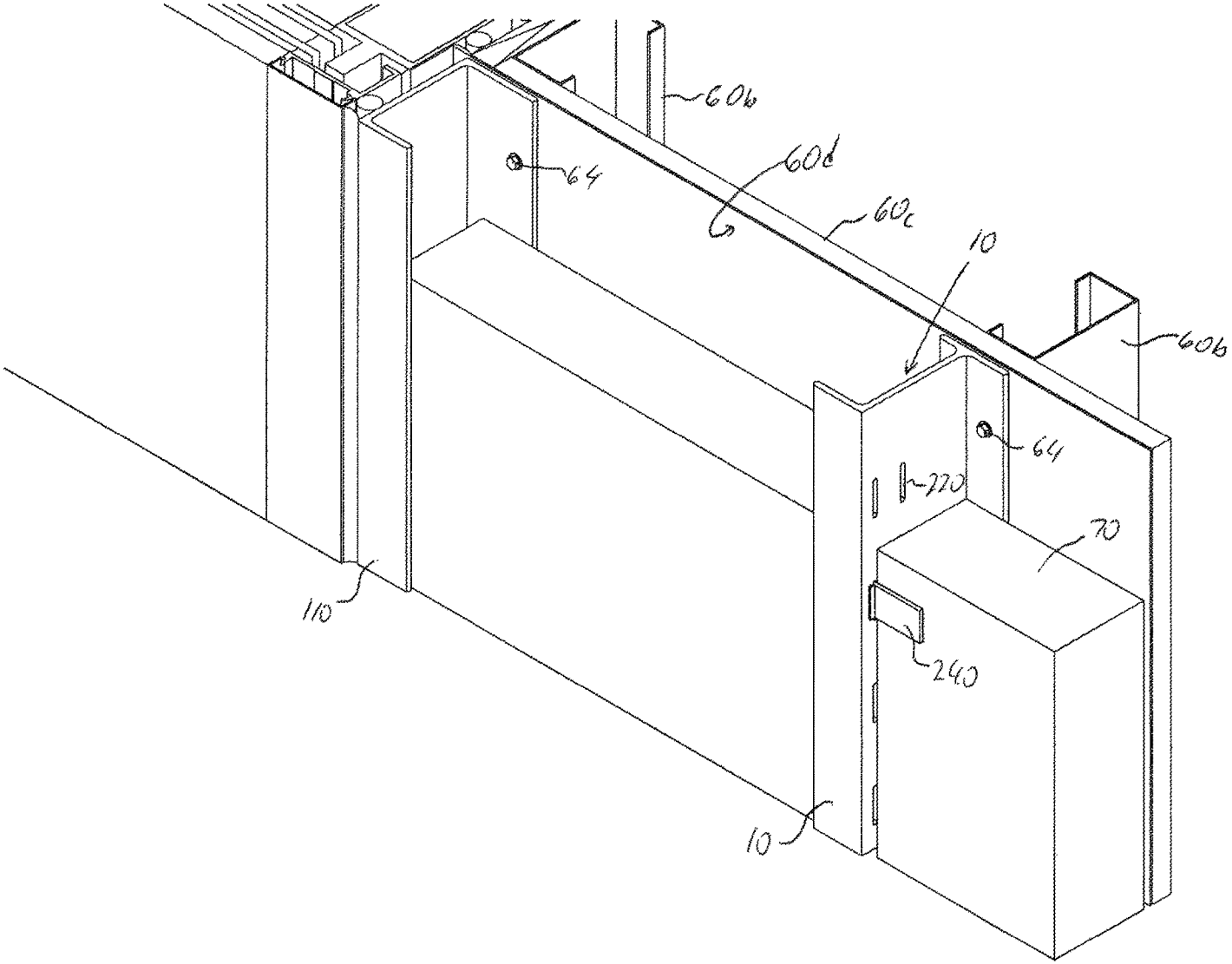

FIGS. 50 and 51 are contextual diagrams demonstrating the deployment of the Z-shaped component 10 along the wall paneling 60*c*. As shown, the Z-shaped components 10 may be deployed coaxially with the wall studs 60*b* or at an angle thereto, such as at a right angle, as shown in FIG. 50. The insulation panels may be retained between adjacent and parallel Z-shaped components 10 or between the Z-shaped component 10 and an adjacent edge component 110.

The Z-shaped component 10 and the edge component 110 are fastened to the wall sheeting 60*c* with fasteners 64. However, no further perforations of the waterproofing membrane 60*d* is required to secure the paneling 70 as these can be secured using holding pegs 240 inserted into the retaining slots 220.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed:

1. A system of securing insulation between an existing wall and exterior wall panels comprising:

a plurality of Z-shaped components;

each of said plurality of said Z-shaped components having a first wall, said first wall having a first end and a second end, said first wall being parallel to and mounting on an existing wall;

a second wall extending outwardly at an angle from said second end, said second wall having first side and a second side;

a rearwardly extending wall, said rearwardly extending wall extending from a free end of said second wall, wherein said rearwardly extending wall facing in an opposite direction from said first wall;

and wherein said second wall further comprising at least one row having a plurality of coaxial retaining slots;

wherein each one of said plurality of coaxial retaining slots configured to mount a holding element, and wherein said holding element configured to secure insulation between said first wall and said at least one row of said plurality of coaxial retaining slots.

2. The system of securing insulation between an existing wall and exterior wall panels of claim 1, wherein any one of said plurality of coaxial retaining slots forming a group comprising a round slot, a rectangular slot, a triangular slot, an elongated slot or any combination thereof.

3. The system of securing insulation between an existing wall and exterior wall panels of claim 2, wherein said rearwardly extending wall configured to have a wall panel fastened thereto; said Z-shaped component configured to retain at least one of a plurality of insulation panels, wherein each one of said plurality of insulation panels being insertable between two of said plurality of Z-shaped components; wherein a bottom surface of each of said plurality of insulation panels would be adjacent to said first wall and a top surface of each of said plurality of insulation panels would be adjacent to the free end of said rearwardly extending wall; and wherein a first end of each of said plurality of insulation panels would be adjacent to said second side of one of said plurality of Z-shaped components and wherein the second end of each of said insulation panels would be adjacent to said first side of a next mounted of said Z-shaped components.

4. The system of securing insulation between an existing wall and exterior wall panels of claim 3, wherein said second wall further comprising at least one plurality of air slots.

5. The system of securing insulation between an existing wall and exterior wall panels of claim 3, wherein any one of said plurality of coaxial retaining slots are configured to serve as air slots by remaining unobstructed after installation adjacently thereto of one of said plurality of insulation panels; and wherein any one of said plurality of coaxial retaining slots forming a group comprising a round slot, a rectangular slot, a triangular slot, an elongated slot or any combination thereof.

6. The system of securing insulation between an existing wall and exterior wall panels of claim 5, further comprising at least one holding peg, said at least one holding peg comprising a first portion and a second portion separated by a lip; said at least one holding peg configured to be inserted within one of said plurality of coaxial retaining slots; and wherein said first portion or said second portion configured to fixate an insulation panel between said at least one holding peg and said first wall.

7. The system of securing insulation between an existing wall and exterior wall panels of claim 5, further comprising an edge component, said edge component being in a spaced apart parallel relation to at least one of said plurality of said Z-shaped components; wherein said edge component having a first wall, said first wall being parallel with an existing wall and configured to be fastened thereto; a second wall extending at an angle from a free end of said first wall of the edge component, said second wall of the edge component having first side and a second side; a forward extending wall extending from a free end of said second wall of the edge component, said forward extending wall further comprising a first portion extending from a free end of said second wall of said edge component; wherein an outer surface of said first portion of the edge component configured to have a wall panel fastened thereto; wherein a free end of said second portion of the edge component being co-planar with the free end of the rear extending wall of one of the plurality of Z-shaped components that is adjacent to said edge component; and wherein one of said plurality of said insulation panels fitting in a space between said edge component and one of said Z-shaped components that is adjacent to said edge component.

8. The system of securing insulation between an existing wall and exterior wall panels of claim 2, wherein said plurality of retaining slots are grouped into at least one row of coaxial retaining slots.

9. The system of securing insulation between an existing wall and exterior wall panels of claim 5, further comprising at least one clip, wherein said at least one clip having a first end configured to be inserted into one of said plurality of retaining slots; a second portion, said second portion and said first end being co-linear and having a common first side and a second side; wherein a protruding wall extends from said first side of said second portion; and wherein said second side configured to extend above said top surface of one of said plurality of insulation panels.

10. The system of securing insulation between an existing wall and exterior wall panels of claim 7, further comprising at least one clip, wherein said at least one clip having a first end configured to be inserted into one of said plurality of retaining slots; a second portion, said second portion and said first end being co-linear and having a common first side and a second side; wherein a protruding wall extending from said first side of said second portion; and wherein said second side configured to extend above said top surface of one of said plurality of insulation panels.

11. The system of securing insulation between an existing wall and exterior wall panels of claim 5, further comprising at least one rod, wherein said at least one rod having a first portion configured to be inserted into one of said plurality of retaining slots; wherein said at least one rod having another first portion opposite said first portion, wherein said another first portion configured to be inserted into one of said plurality of said retaining slots on an adjacent of said Z-shaped components; an elongated segment having first side and a second side; a protruding wall extending from said first side; and wherein said elongated segment configured to extend above said top surface of one of said plurality of insulation panels.

12. The system of securing insulation between an existing wall and exterior wall panels of claim 11, further comprising an edge component, said edge component being in a spaced apart parallel relation to at least one of said plurality of said Z-shaped components; wherein said edge component having a first wall, said first wall being parallel with an existing wall and configured to be fastened thereto; a second wall extending at an angle from a free end of said first wall of the edge component, said second wall of the edge component having first side and a second side; a forward extending wall extending from a free end of said second wall of the edge component, said forward extending wall further comprising a first portion extending from a free end of said second wall of said edge component; a second portion of said forward extending wall of the edge component extending downwardly from said first portion in a spaced apart relation to said second wall of the edge component; wherein an outer surface of said first portion of the edge component configured to have a wall panel fastened thereto; wherein a free end of said second portion of the edge component being co-planar with the free end of the rear extending wall of one of the plurality of Z-shaped components that is adjacent to said edge component; and wherein one of said plurality of said insulation panels fitting in a space between said edge component and one of said Z-shaped components that is adjacent to said edge component.

13. The system of securing insulation between an existing wall and exterior wall panels of claim 10, wherein said plurality of said Z-shaped components are oriented at an angle from said edge component.

14. The system of securing insulation between an existing wall and exterior wall panels of claim 11, wherein said plurality of said Z-shaped components are oriented at an angle from said edge component.

15. The system of securing insulation between an existing wall and exterior wall panels of claim 2, wherein said plurality of said Z-shaped components are made of thermally insulating materials.

16. The clip member of claim 1, wherein said holding element is a peg, said peg having a first portion and at least one second portion in a co-linear orientation, said first and said second portions each having a first side and a second side, said at least one first portion configured for insertion into a retaining slot of a Z-shaped component; wherein said second portion configured to secure said insulation panel; and a lip protruding from a side of said peg separating said first portion and said second portion; and wherein said lip configured to prevent over insertion of said first portion into said retaining slot.

17. A method of mounting insulation panels unto an existing wall comprising the steps of, installing at least two Z-shaped components onto an existing wall, said at least two Z-shaped components being in a spaced apart configuration with each other; either one of said at least two Z-shaped components having at least one row of plurality of coaxial retaining slots; inserting at least one insulation panel between said at least two Z-shaped components, wherein said at least one insulation panel being locked into place between a second wall of said one of the at least two Z-shaped components and beneath the rearwardly extending wall of another of said at least two Z-shaped components; securing said at least one insulation panel so as not to block at least one of said plurality of said coaxial retaining slots; and configuring air circulation by having air gaps within Z-shaped components; and installing wall panels onto the Z-shaped components.

18. The method of mounting insulation panels of claim 17, further comprising a step of placing at least one rod through an intersecting slot in one of Z-shaped components, wherein said rod spans the distance between said at least two Z-shaped components or having a step of placing at least one clip through a holding slot in one of said Z-shaped components; wherein said rod or said clip configured to hold said at least one insulation panel; and further comprised of the step of utilizing the said at least two Z-shape components in combination with clips and/or rods to maintain an air gap between insulation paneling and exterior wall panels.

19. A clip member comprising, at least one first portion and at least one second portion in a co-linear orientation, said first and said second portions each having a first side and a second side, said at least one first portion configured for insertion into a retaining slot of a Z-shaped component; wherein said second portion having at least one protruding wall protruding perpendicularly from said first side; wherein either said second side of said second portion or said at least one protruding wall configured to abut against a top surface of an insulation panel; wherein said at least one protruding wall configured to secure said insulation panel in place or to prevent over insertion of said first portion into said retaining slot; and wherein said insulation panel being insertable between one of said Z-shaped component and another of said Z-shaped components that is in parallel spaced apart orientation with said one of said Z-shaped components.

20. The clip member of claim 19, wherein said second portion further comprising another of said at least one first portions, wherein said another of said at least one first portion being on opposite end of said second portion from said at least one first portion.

21. The clip member of claim 19, wherein said clip member is made of a thermally insulating material.

* * * * *